US010988276B2

(12) United States Patent
McNestry et al.

(10) Patent No.: US 10,988,276 B2
(45) Date of Patent: Apr. 27, 2021

(54) MACHINE AND METHOD FOR ITS OPERATION

(71) Applicant: VIDEOJET TECHNOLOGIES INC., Wood Dale, IL (US)

(72) Inventors: Martin McNestry, Derbyshire (GB); Gary Pfeffer, Northamptonshire (GB); Philip Hart, Nottinghamshire (GB); James Butcher, Nottinghamshire (GB); Steven Buckby, Nottinghamshire (GB)

(73) Assignee: VIDEOJET TECHNOLOGIES INC., Wood Dale, IL (US)

( * ) Notice: Subject to any disclaimer, the term of this patent is extended or adjusted under 35 U.S.C. 154(b) by 102 days.

(21) Appl. No.: 16/059,809

(22) Filed: Aug. 9, 2018

(65) Prior Publication Data

US 2019/0039771 A1 Feb. 7, 2019

Related U.S. Application Data

(62) Division of application No. 14/438,549, filed as application No. PCT/GB2013/052934 on Nov. 7, 2013, now Pat. No. 10,065,760.

(30) Foreign Application Priority Data

Nov. 7, 2012 (GB) ..... 1220059
Nov. 7, 2012 (GB) ..... 1220060
(Continued)

(51) Int. Cl.
*B65C 9/42* (2006.01)
*B65C 9/18* (2006.01)
(Continued)

(52) U.S. Cl.
CPC ..... *B65C 9/42* (2013.01); *B65C 9/0006* (2013.01); *B65C 9/1865* (2013.01);
(Continued)

(58) Field of Classification Search
CPC ..... B65C 9/0006; B65C 9/18; B65C 9/1803; B65C 9/1865; B65C 9/1892; B65C 9/40;
(Continued)

(56) References Cited

U.S. PATENT DOCUMENTS 4,288,272 A * 9/1981 Pfeffer ..... B65C 9/1869 156/361
2011/0132544 A1* 6/2011 McNestry ..... B65C 9/1865 156/361

* cited by examiner

*Primary Examiner* — George R Koch
(74) *Attorney, Agent, or Firm* — Wolter Van Dyke Davis, PLLC; Robert L. Wolter

(57) ABSTRACT

A labelling machine comprises a supply spool support for supporting a supply spool comprising label stock comprising a web and a plurality of labels attached to the web and which are separable from the web; a take-up spool support adapted to take up a portion of web; a motive means configured to propel the web along a web path from the supply spool support towards the take up spool support. A sensor has a transmitter portion and a receiver portion, the receiver portion comprising a plurality of receivers, the transmitter portion and receiver portion are configured to receive a portion of the label stock therebetween, and the plurality of receivers are each configured to produce a respective sensor signal which is a function of a property of a portion of label stock at a plurality of positions spaced from one another in a direction non-parallel to the web path. In addition, a controller is configured to monitor each of the sensor signals produced by the receivers and to select one of the sensor signals produced by the receivers based on said monitoring of each of the sensor signals produced by the receivers.

16 Claims, 31 Drawing Sheets

(30) Foreign Application Priority Data

| | | |
|---|---|---|
| Nov. 7, 2012 | (GB) | 1220063 |
| Nov. 7, 2012 | (GB) | 1220067 |
| Nov. 7, 2012 | (GB) | 1220070 |
| Oct. 11, 2013 | (GB) | 1318068 |

(51) Int. Cl.
*B65C 9/00* (2006.01)
*B65C 9/26* (2006.01)
*B65C 9/40* (2006.01)

(52) U.S. Cl.
CPC ..... *B65C 9/1892* (2013.01); *B65C 9/26* (2013.01); *B65C 2009/0087* (2013.01); *B65C 2009/0096* (2013.01); *B65C 2009/404* (2013.01)

(58) Field of Classification Search
CPC ..... B65C 9/42; B65C 9/46; B65C 9/2009; B65C 9/0087; B65C 2009/0096; B65C 2009/402; B65C 2009/404; B21C 47/30
USPC ..... 156/361, 378, 538, 542, DIG. 44, 156/DIG. 45, DIG. 46; 242/586, 586.4, 242/587.2
See application file for complete search history.

MACHINE AND METHOD FOR ITS OPERATION

CROSS-REFERENCE TO RELATED APPLICATIONS

This application is a divisional of application Ser. No. 14/438,549, filed on Apr. 24, 2015, now U.S. Pat. No. 10,065,760. Application Ser. No. 14/438,549 is a National Stage entry ("a 371 of international") of Application No. PCT/GB2013/052934, filed Nov. 7, 2013, both of which are hereby incorporated in their entirety.

The present invention relates to a labelling machine and particularly to a labelling machine for use with label stock comprising a web and a plurality of labels attached to the web and which are separable from the web. Such machines are sometimes referred to as "roll-fed self-adhesive labelling machines".

A label stock comprising a web carrying labels is usually manufactured and supplied as a wound roll (hereinafter referred to as a spool). For a given spool, all the labels are typically the same size, within manufacturing tolerances. However, in some instances, this is not the case.

Labels are commonly used to display information relating to an article and are commonly disposed on the article such that the information is easily readable either manually or automatically. Such labels may, for example, display product information, barcodes, stock information or the like. Labels may be adhered to a product or to a container in which the product is packaged.

In the manufacturing industry, where such labels are read automatically, it is important for the information to be printed such that it is clear and positioned accurately so that an automated reader can consistently and correctly read the information.

Some known labelling machines apply pre-printed labels to an article. Other known labelling machines print information onto labels immediately before printed labels are applied to an article. Such labelling machines may be referred to as print and apply labelling machines.

It is desirable to be able to advance a web of labels to be applied to an article accurately, so as to ensure that print is accurately positioned on the label and/or to ensure that the label is accurately positioned on the article. This may be particularly important in print and apply labelling machines in which printing is typically carried out while the label moves relative to the printhead, making accurate control of the label (and hence the label stock) important if printing is to be properly carried out such that the desired information is correctly reproduced on the label.

Given that labels are often removed from the moving web by passing the label stock under tension around a labelling peel beak (sometimes referred to as a peel beak, a peel blade or a label separating beak), it is sometimes desirable to ensure that a predetermined optimum tension in the web of the label stock is maintained. In some applications, it is also desirable that the label stock can be moved at a predetermined speed of travel along a defined web path, so as to ensure that the speed at which labels are dispensed is compatible with the speed at which products or containers move along a path adjacent the device.

A known labelling machine comprises a tape drive which advances the label stock from a supply spool support to a take up spool support. The tape drive has a capstan roller of known diameter which is accurately driven to achieve desired linear movement of the label stock along the web path. This capstan roller is also often referred to as a drive roller. The label stock is often pressed against the capstan roller by a nip roller, in order to mitigate risk of slip between the capstan roller and the label stock. For the reliable running of such machines the nip/capstan mechanical arrangement is designed so as to ensure respective axes of the two rollers are substantially parallel to one another and that the pressure exerted by the nip roller (which is typically sprung loaded) is generally even across the width of the label carrying web. This often results in relatively expensive and complex mechanical arrangements, and it is often a time consuming process to load the machine with a supply spool of label stock and feed the label stock from the supply spool support to the take-up spool support, through the nip/capstan rollers, before the labelling machine is operated. This is because the nip roller has to be temporarily disengaged or removed to allow the web of the label stock to be positioned along the web path between the supply spool support and the take up spool support. The nip roller is then repositioned such that the label stock is pressed against the capstan roller by the nip roller and the web of the label stock can be moved between the spool supports by rotation of the capstan roller.

Furthermore, in such labelling machines, the take-up spool (and hence the take up spool support) itself typically needs to be driven in order to maintain adequate tension in the web, between the nip/capstan roller and the take-up spool support. If the tension is too low, the web can become wrapped around the capstan roller, causing the machine to fail, and if the tension is too high, the capstan roller can be "over-driven" by the take-up spool support, resulting in the web being fed at the wrong speed, or indeed the web snapping. The drive for the take-up spool support must also deal with the changing diameter of the take-up spool which carries the web from which labels have been removed. This is because the diameter of the take-up spool increases from an initial value where the take-up spool is empty, to a value many times greater than the initial value, when the supply spool is exhausted.

Known tape drives of labelling machines have mechanisms for achieving appropriate drive of the take-up spool including so-called slipping clutch arrangements. The take-up spool support may either driven by an independent drive means, such as a variable torque motor, or driven via a pulley belt and gears from a motor driving the capstan roller.

Tape drive mechanisms which rely upon capstan rollers add cost and complexity to the labelling machine, and have the disadvantages referred to above.

Another known problem associated with nip/capstan roller arrangements of the type described above is that the pressure exerted by the nip roller onto the web and against the capstan roller can cause label adhesive to "bleed" out, over time, from the edges of the label. This adhesive can eventually build up on the capstan or nip rollers. This adhesive can then cause the label stock to stick to the rollers such that it is not transported properly along the desired web path. Furthermore, it is common for labels to be accidentally removed from the web and become attached to the capstan roller or nip roller, impeding proper operation of the labelling machine.

It is therefore desirable in the manufacturing industry for there to be means and a method for transporting a label stock and applying labels from the web of the label stock to a product or container, which is accurate, reliable, simple to use and adaptable to different applications.

A further problem with known labelling machines is that certain components of the labelling machine may operate at different speeds. For example, a labelling peel beak may operate at a faster speed than a printer. That is to say, label stock can pass the labelling peak beak at a speed which is greater than the speed at which the label stock can pass the printer. In labelling machines in which components of the labelling machine operate at different speeds, the operating speed of the slower component may dictate the speed at which the label stock is advanced along the entire web path. Consequently, the operating speed of the slower component may limit the throughput of the labelling machine.

Some embodiments of labelling machine which incorporate a printer may be referred to as print and apply labelling machines. A known type of print and apply labelling machine is a 'last label out' labelling machine. 'Last label out' labelling machines function so as to print a specific label for a specific article and then apply that label to the specific article. For example, a 'Last label out' labelling machine may operate such that for each article that passes the labelling machine a unique label is printed and then applied to the article. In some 'last label out' machines the printed label differs for each article, whereas in other 'last label out machines' the printed label may differ during the course of a production batch passing the labelling machine.

Due to the fact that 'Last label out' labelling machines may print a unique label for each article before it is applied to the article, it is common for the printer of the labelling machine to be located in close proximity to the labelling peel beak. The location of the printer adjacent the labelling peel beak may make the portion of the labelling machine which includes the labelling peel beak bulky.

Certain known label and/or barcode positioning standards require that labels incorporating a barcode are applied by the labelling machine at a particular position on an article. For example, if the labelling machine is configured to apply labels to articles which pass the labelling machine on a conveyor, then known label positioning standards may necessitate that the labelling machine is configured to apply labels to each article on the conveyor at less than a predetermined height from the conveyor and at a less than a predetermined distance from a front edge of the article.

In cases where known print and apply labelling machines of the 'last label out' type are required to apply labels to articles at a relatively low height from a conveyor, due to the fact that the portion of the labelling machine which includes the labelling peel beak is bulky, it may not be possible to position such a known print and apply labelling machine of the 'last label out' type adjacent the conveyor such that labels can be printed and subsequently applied to an article at a position adjacent the labelling peel beak and printer of the labelling machine.

In order to solve this problem, known print and apply labelling machines of the 'last label out' type may be located at a position such that the labelling peel beak and printer are remote from the conveyor (and hence articles on the conveyor). The labelling machine may also incorporate a tamp (or any other appropriate label transfer device) which is controllably moved so as to transfer each label from the labelling peel beak of the labelling machine and subsequently apply it to the required position on each article. However, the use of a tamp (or any other appropriate label transfer device) in this manner may be disadvantageous.

For example, the label transfer means will increase the complexity and cost of the labelling machine. In addition, the label transfer device is an additional component of the labelling machine which may fail, thus causing the labelling machine to become inoperable. Furthermore, the time it takes for a printed label to be transferred by the label transfer device from the labelling machine to the desired article on the conveyor may increase the time it take for labels to be applied to an article, thereby reducing the throughput of the labelling machine and/or conveyor.

Another problem with known print and apply labelling machines of a 'last label out' configuration is that it may not be possible to locate such a machine adjacent a conveyor of a production line such that the labelling machine can apply labels beneath a certain height on an article conveyed by the conveyor.

Known tape drives of labelling machines have mechanisms for achieving appropriate drive of the take-up spool including so-called slipping clutch arrangements. The take-up spool support may be either driven by an independent drive means, such as a variable torque motor, or driven via a pulley belt and gears from a motor driving the capstan roller.

Some known labelling machines include a braking assembly. The braking assembly may include at least one component that is subject to wear over time. Once said at least one component of the braking assembly has worn to the extent that performance of the labelling machine is unacceptably adversely affected then said at least one component may require replacement. In order to replace said at least one component it may require that the labelling machine is shut down at an inconvenient time which results in down time of a production line of which the labelling machine forms part.

A further problem with known labelling machines is that it is difficult for an operator of the labelling machine to assess the amount of label stock that remains on the supply spool support at any given time and to act appropriately on the basis of diminishing label stock remaining on the supply spool support.

A further problem with known tape drives is that it may not be possible to determine the width of the tape (in the case of a labelling machine, the label stock) moved by the tape drive. The ability to determine the width of the tape may be useful in determining at least one operating characteristic of the tape drive, for example the tension required in the tape. Given that known tape drives are not capable of determining the width of the tape, they may require a user to manually supply information as to the width of the tape. The supply of such information is susceptible to human error and incorrect information as to the width of the tape may result in sub-optimal performance of the tape drive.

It is an object of embodiments of the present invention to obviate or mitigate one or more of the problems of known labelling machines whether set out above or otherwise, and/or to provide an alternative labelling machine.

According to an aspect of the present invention there is provided a labelling machine comprising a supply spool support for supporting a supply spool comprising label stock; a take-up spool support adapted to take up a portion of web; a motive means configured to propel the web along a web path from the supply spool support towards the take up spool support, a printer for printing on the labels, the printer being configured to perform a printing operation at a first linear speed as labels pass along the web path; a labelling component configured to perform a labelling operation at a second linear speed; and a path length adjuster comprising a movable member configured to contact a portion of the label stock and define a portion of the web path between the printer and the labelling component; an actuator configured to move the movable member so as to modify a length of the web path between the printer and the labelling component; and a controller configured to control the actuator and motive means so as to permit a first portion of the label stock to pass the printer at the first linear speed and a second portion of the label stock to pass the labelling component at the second linear speed.

By enabling a first portion of the label stock to pass the printer at the first linear speed and a second portion of the label stock to pass the labelling component at the second linear speed, both the printer and labelling component can operate at their own speed and it is not necessary for both to operate at the same speed, which may be the slower of the printing speed and labelling component speed. This may lead to an increase in throughput of the labelling machine.

The first linear speed may be less than the second linear speed. In other cases, the first linear speed may be greater than the second linear speed.

The motive means may comprise a motor configured to rotate the take up spool support.

The motor may be selected from the group consisting of a DC motor, an open-loop position controlled motor (e.g. a stepper motor) and an closed loop position controlled motor (e.g. a torque controller motor, such as a DC motor, together with an appropriate positional sensor and feedback control circuit). However any suitable motor may be used. Those skilled in the art will be aware of control schemes which are suitable to control rotation of the motors to achieve the methods described herein, depending upon the type of motor selected for use. Those skilled in the art will further be aware of the relative merits of various motor types and will be able to select a suitable motor type on that basis.

The printer may be a thermal printer. The printer may be a thermal transfer printer.

The printer may be upstream, having regard to the direction of movement of the label stock from the supply spool support to the take up spool support, of the labelling component. In other cases, the printer may be downstream, having regard to the direction of movement of the label stock from the supply spool support to the take up spool support, of the labelling component.

The label stock may comprise a web and a plurality of spaced labels attached to the web and which are separable from the web, and the labelling component may be a labelling peel beak. The labelling component may be any other appropriate labelling component.

The actuator and movable member may be configured such that the actuator moves the movable member in a generally linear manner. The actuator and movable member may be configured such that the actuator moves the movable member in any appropriate manner, for example, in an arcuate manner.

The labelling machine may further comprise a generally linear guide configured to guide the generally linear movement of the movable member. The labelling machine may further comprise a generally arcuate guide configured to guide the generally arcuate movement of the movable member.

The movable member may comprise a roller and a portion which is mechanically linked to the actuator.

The actuator may comprise a stepper motor. Any other appropriate actuator may be used to control the position of the movable member.

The controller may be configured, for a given time t, to control the actuator to move the movable member so as to change a length of the web path between the printer and the labelling component by an amount $L_{PL}$ given by:

$$L_{PL} = \left| \frac{S_1 - S_2}{t} \right|$$

where $S_1$ is the first linear speed and $S_2$ is the second linear speed.

The label stock may comprise a region to be printed on and an adjacent region which is not to be printed upon; and the controller may be configured to control the actuator and motive means so as to advance the region to be printed on past the printer at the first linear speed, and simultaneously control the actuator to move the movable member so as to decrease the length of the web path between the printer and the labelling component; and advance the region which is not to be printed on past the printer at a speed which is greater than the second linear speed, and simultaneously control the actuator to move the movable member so as to increase the length of the web path between the printer and the labelling component.

The movable member may oscillate. The movable member may be configured to increase the length of the web path between the printer and labelling component and subsequently decrease the length of the path between the printer and the labelling component. This may occur repetitively.

The labelling component may comprise a label applicator located in a location along said web path between said take up and supply supports and arranged to separate labels from the web for application to a receiving surface.

The labelling machine may be arranged to apply pre-printed labels to packages in a product packaging facility.

The printer may be arranged to print onto labels prior to application of labels onto the receiving surface. The labels printed upon may be pre-printed.

The label stock may comprise labels which are spaced from one another along the web.

Within the description, label stock may be used to refer to the web with attached labels. Label stock may also be used to refer to a portion of web from which labels have been separated.

According to another aspect of the present invention there is provided a method of operating a labelling machine, the labelling machine comprising a supply spool support for supporting a supply spool comprising label stock; a take-up spool support adapted to take up a portion of web; a motive means; a printer for printing on the labels; a labelling component; a path length adjuster comprising a movable member; an actuator; and a controller; wherein the method comprises the motive means propelling the web along a web path from the supply spool support towards the take up spool support; the printer performing a printing operation on a portion of the label stock at a first linear speed; the labelling component performing a labelling operation on a portion of the label stock at a second linear speed; the movable member contacting a portion of the label stock and defining a portion of the web path between the printer and the labelling component; the actuator moving the movable member so as to modify a length of the web path between the printer and the labelling component; and the controller controlling the actuator and motive means so that a first portion of the label stock passes the printer at the first linear speed and a second portion of the label stock passes the labelling component at the second linear speed.

Any of the features described in relation to the labelling machine above may be applied to the method above.

According to another aspect of the invention, there is provided a labelling machine comprising a supply spool support for supporting a supply spool comprising label stock comprising a web and a plurality of labels attached to the web and which are separable from the web; a take-up spool support adapted to take up a portion of web; a first motive means configured to propel the web along a web path from the supply spool support towards the take up spool support, the first motive means comprising a first motor including a first stator and a first rotor; a labelling peel beak located along the web path and configured to peel the labels from label web as the label stock passes the labelling peel beak; and a printer for printing on the labels, the printer including a ribbon supply spool support for supporting a ribbon supply spool comprising printer ribbon for the printer; a ribbon take-up spool support adapted to take up a portion of the printer ribbon; and a second motive means configured to propel the printer ribbon from the supply spool support towards the take up spool support, the second motive means comprising a second motor including a second stator and a second rotor; wherein the labelling machine further comprises a base plate; wherein the following list of components are mounted to the base plate such that the majority of each component is located on one side of a first surface of the base plate, the list including: supply spool support, take-up spool support, first stator, labelling peel beak, ribbon supply spool support, ribbon take-up spool support and second stator. In other embodiments, any of the components in the list may be removed from the list.

If the first surface of the base plate is an upper surface, then mounting all of the listed components to the base plate such that the majority of each component is located on one side of a first surface of the base plate means that very little (if any of each of the components extends beyond a lower surface of the base plate. Consequently, the lower surface of the base plate may be located close to a conveyor of a production line, thereby reducing the minimum height above the conveyor at which the labelling machine can apply a label. This may help the labelling machine to apply labels which meet certain standards relating to the positioning of labels.

In some embodiments, at least one of the supply spool support, take-up spool support, first rotor, ribbon supply spool support, ribbon take-up spool support and second rotor may include a shaft which extends through an aperture between the first surface of the base plate and a second surface of the base plate.

The first rotor and one of the supply spool support and take-up spool support may each include a shaft which extends through an aperture between the first surface of the base plate and the second surface of the base plate, the labelling machine further comprising a linkage which links the shaft of the first rotor and the shaft of said one of the supply spool support and take-up spool support, such that rotation of the shaft of the first rotor is transmitted to the shaft of said one of the supply spool support and take-up spool support via said linkage, and wherein the second surface is between the first surface and the linkage.

The second rotor and one of the ribbon supply spool support and ribbon take-up spool support may each include a shaft which extends through an aperture between the first surface of the base plate and the second surface of the base plate, the labelling machine further comprising a ribbon drive linkage which links the shaft of the second rotor and the shaft of said one of the ribbon supply spool support and ribbon take-up spool support, such that rotation of the shaft of the second rotor is transmitted to the shaft of said one of the ribbon supply spool support and ribbon take-up spool support via said ribbon drive linkage, and wherein the second surface is between the first surface and the ribbon drive linkage.

The linkage may comprise a first pulley mounted to the shaft of the first rotor and a second pulley mounted to the shaft of said one of the supply spool support and take-up spool support, and a flexible elongate member which extends between the first and second pulleys.

The labelling machine may further comprise a linkage which links the first rotor and one of the supply spool support and the take-up spool support, such that rotation of the first rotor is transmitted to said one of the supply spool support and take-up spool support via said linkage, and wherein the linkage is located on said one side of the first surface of the base plate.

Although the above-described aspects of the invention relate to a labelling machine and a method of controlling a labelling machine, it will be appreciated that the invention may also be applied to a tape drive and method of controlling a tape drive. The tape drive may form part of a labelling machine or a printer (such as a thermal transfer printer). Whereas the tape in the labelling machine is label stock, the tape in a printer may be a print ribbon.

According to a another aspect of the invention there is provided a labelling machine comprising a supply spool support for supporting a supply spool comprising label stock; a take-up spool support adapted to take up a portion of the label stock; a movable element which defines a portion of a web path between the supply spool and the take-up spool support; a sensor configured to produce a sensor signal indicative of the position of the movable element; a controller configured to receive the sensor signal and output a brake assembly control signal based upon the sensor signal; a brake assembly configured to apply a braking force to one of said spool supports based upon the brake assembly control signal, the braking force resisting rotation of said one of said spool supports; wherein the controller is configured to control the brake assembly based upon the sensor signal so as to cause the moveable element to move towards a desired position. In other words the controller is configured to control the brake assembly based upon the sensor signal so as to urge the moveable element towards a desired position.

In some embodiments it may be desirable to urge the moveable element towards a desired position so that a path length of the web path between the supply spool and take-up spool (which is defined in part by the movable element) is maintained substantially constant. In other embodiments it may be desirable to urge the moveable element towards a desired position so as to reduce the likelihood that relative movement between the take-up spool and the supply spool will result in the movable element reaching a limit of its movement.

Tension in the label stock may change based upon the position of the movable element and wherein the desired position of the movable element may correspond to a desired tension within the label stock.

The labelling machine may further comprise a motive means configured to propel the web along the web path from the supply spool support towards the take up spool support; and the controller may be configured to control the brake assembly and the motive means based upon the sensor signal so as to urge the moveable element towards a desired position.

The desired position may be defined in any convenient way. For example a single position or a range of positions may be specified. The controller may implement a control algorithm to determine a control signal to be applied to the brake assembly (and optionally the motive means) to cause the moveable element to be urged towards the desired position. The control algorithm may be a PID (proportional, integral, derivative) algorithm. The control algorithm may process data indicating a current position of the moveable element and data indicating the desired position and determine the control signal based upon the processed data.

According to a further aspect of the invention there is provided a labelling machine comprising a supply spool support for supporting a supply spool comprising label stock; a take-up spool support adapted to take up a portion of the label stock; a movable element which defines a portion of a web path between the supply spool and the take-up spool support; a sensor configured to produce a sensor signal indicative of the position of the movable element; and a brake assembly configured to apply a braking force to one of said spool supports based upon the sensor signal, the braking force resisting rotation of said one of said spool supports; and wherein the brake assembly comprises a frictional brake comprising a first braking surface mechanically linked to said one of said spool supports and a second braking surface, the first and second braking surfaces being configured such that when the first and second braking surfaces are urged together, friction between the first and second braking surfaces produces said braking force. In other words, the first and second braking surfaces may be configured such that when the first and second braking surfaces are urged into contact, friction between the first and second braking surfaces produces said braking force According to another aspect of the invention there is provided a labelling machine comprising a supply spool support for supporting a supply spool comprising label stock; a take-up spool support adapted to take up a portion of the label stock; a movable element which defines a portion of a web path between the supply spool and the take-up spool; a sensor configured to produce a sensor signal indicative of the position of the movable element; a controller configured to receive the sensor signal and output a brake assembly control signal based upon the sensor signal; and a brake assembly configured to apply a braking force to one of said spool supports based upon the brake assembly control signal, the braking force resisting rotation of said one of said spool supports.

The label stock may comprise the web and a plurality of labels attached to the web and which are separable from the web. The web may be referred to as a backing.

The label stock may comprise labels which are spaced from one another along the web.

Within the description, label stock may be used to refer to the web with attached labels. Label stock may also be used to refer to a portion of web from which labels have been separated.

The brake assembly may be controlled independently of movement of the moveable element (which may be a dancing arm), thereby allowing for greater control of the labelling machine. In particular, movement of the moveable element may cause tension in the label web to vary. This is the case where the movable element is biased by a spring which generally obeys Hooke's law such that movement of the moveable member against that biasing force requires an increasing force to be applied to the moveable element and therefore increasing tension in the label web. In such a case the relationship between movement of the moveable element (and therefore tension in the label web) and operation of the brake creates a potentially undesirable relationship between web path length, web tension and braking force. Allowing independent control of the brake provides additionally flexibility.

The labelling machine may further comprise a motor mechanically linked to the second braking surface, the motor being configured to selectively urge the second braking surface and the first braking surface together to produce said braking force. In other words, the motor may be configured to selectively urge the second braking surface into contact with (or towards) the first braking surface to produce said braking force.

The motor may be a torque controlled motor. For example, the motor may be a DC motor in which the torque applied by the motor is related to the current supplied to the motor, as is well known in the art.

The motor may be a position controlled motor. The position controlled motor may be a stepper motor.

The brake assembly may comprise a brake disc mechanically linked to said one of said spool supports, the brake disc having said first braking surface (which may be a circumferential surface of the brake disc); and a belt passing around at least part of the brake disc, the belt having said second braking surface. The motor may be mechanically linked to the belt.

The motor may be mechanically linked to the belt via a cam, wherein the motor and cam are configured such that rotation of the motor produces rotation of the cam.

The cam may be linked to a first portion of the belt, and a second portion of the belt is fixed against movement; and wherein the cam is configured such that when it is rotated in a first direction by the motor, the cam urges at least a portion of the second braking surface towards the first portion of the belt, thereby urging the second braking surface towards (e.g. into contact with) the first braking surface. In other words, the cam may urge at least a portion of the second braking surface and the first portion of the belt together, thereby urging the second braking surface and the first braking surface together.

The brake assembly may further comprise a controller and a solenoid, wherein the controller is configured to receive said sensor signal indicative of the position of the movable element, and configured to supply a control signal to the solenoid to thereby apply said braking force to one of said spool supports based upon the sensor signal.

The brake assembly may further comprise a solenoid, wherein the controller may be configured to supply the brake assembly control signal to the solenoid to thereby apply said braking force to one of said spool supports based upon the brake assembly control signal.

The solenoid may comprise a coil and an armature having an extent of movement relative to the coil defined by first and second end positions. The brake assembly may further comprise an armature position sensor configured to output an armature position signal which is indicative of the position of the armature relative to the coil.

The controller may be configured to control current supplied to the coil based upon the armature position signal so as to urge the armature towards a desired position relative to the coil which is intermediate the first and second end positions. The desired position may be a desired rest position. That is to say, the controller may be configured to control the current of the coil so as to attempt to position the armature at a desired position intermediate the first and second end positions. The armature may be biased towards one of the first and second end positions.

One of the first and second braking surfaces may be associated with the coil or the armature of the solenoid, and the controller may be further configured to control the current supplied to the coil such that the solenoid urges the second braking surface and first braking surface together (or into contact).

The armature position sensor may comprise a transmitter configured to transmit electromagnetic radiation; a reflective element associated with one of the armature or coil and movable therewith during relative movement between the armature and the coil, the reflective element being configured to reflect at least part of the electromagnetic radiation transmitted by the transmitter; and a receiver configured such that electromagnetic radiation transmitted by the transmitter and reflected by the reflective element is incident on the receiver.

The brake assembly may comprise a motor.

The motor may be a DC motor mechanically linked to said one of said spool supports which is configured to apply said braking force to said one of said spool supports. It will be appreciated, however, that in alternative embodiments other types of motor may be used and appropriately controlled.

The brake assembly may further comprise a controller configured to receive said sensor signal indicative of the position of the movable element, and configured to supply a control signal to the DC motor to thereby apply said braking force to one of said spool supports based upon the sensor signal.

The controller may be configured to supply the brake assembly control signal to the DC motor to thereby apply said braking force to one of said spool supports based upon the brake assembly control signal.

The motor may be a stepper motor mechanically linked to said one of said spool supports, the stepper motor comprising a plurality of motor windings and the brake assembly further comprises a variable electrical impedance device connected across at least one of said windings, the variable electrical impedance device being configured to vary the electrical impedance across said at least one winding to thereby vary said braking force applied to said one of said spool supports.

The brake assembly may further comprise a controller configured to receive said sensor signal indicative of the position of the movable element, and configured to supply a control signal to the variable electrical impedance device based upon the sensor signal, to thereby vary the electrical impedance across said at least one winding and hence vary said braking force applied to said one of said spool supports.

The controller may be configured to supply the braking assembly control signal to the variable electrical impedance device, to thereby vary the electrical impedance across said at least one winding and hence vary said braking force applied to said one of said spool supports based upon the braking assembly control signal.

The labelling machine may be configured such that in a powered down state of the labelling machine, the brake assembly applies a braking force applied to said one of said spool supports. This ensures that when the labelling machine is switched off or when power is removed from the labelling machine, the brake is applied.

The brake assembly may further comprise a resilient biasing member, the resilient biasing member being mechanically linked to one of the first and second braking surfaces and being configured to urge the first and second braking surfaces together (or into contact with one another). The resilient biasing member may be a spring.

The movable element may be a dancing arm. The dancing arm may be mounted such that it moves along any predetermined path. For example the movement of the dancing arm may be linear or arcuate.

Each of the supply spool support and take up spool support may be mounted for rotation about a respective spool support rotation axis, and wherein the dancing arm rotation axis is co-axial with one of the spool support rotation axes.

The dancing arm rotation axis may be co-axial with the spool support rotation axis of the spool support to which the brake assembly is configured to apply said braking force.

The sensor configured to produce a sensor signal indicative of the position of the movable element may comprise a magnetic sensor attached to one of the moveable element or a portion of labelling machine which is fixed relative to the movable element; and a magnet attached to the other of said movable element or said portion of the labelling machine.

The magnet may be selected from the group consisting of a multi-pole magnet and a plurality of magnets.

The labelling machine may further comprise a motive means configured to propel the web along the web path from the supply spool support towards the take up spool support.

The motive means may comprise a motor configured to rotate the take up spool support.

The motor may be selected from the group consisting of a DC motor, an open loop position controlled motor (e.g. a stepper motor) and a closed loop position controlled motor (e.g. a torque controller motor, such as a DC motor, together with an appropriate positional sensor and feedback control circuit). However any suitable motor may be used. Those skilled in the art will be aware of control schemes which are suitable to control rotation of the motors to achieve the methods described herein, depending upon the type of motor selected for use. Those skilled in the art will further be aware of the relative merits of various motor types and will be able to select a suitable motor type on that basis.

The labelling machine may further comprise a controller configured to control the motive means and the brake assembly based upon the sensor signal so as to urge the moveable element towards a desired position or range of positions.

A tension in the label stock may change based upon the position of the movable element and the desired position or range of positions of the movable element may correspond to a desired tension or range of tensions within the label stock.

The controller may be configured to determine the desired tension or desired range of tensions based upon at least one characteristic of the label stock.

Said at least one characteristic of the label stock may be at least one of width and breaking strain. The width and breaking strain may be that of the web, The controller may be configured to determine at least one of said at least one characteristic of the label stock based upon user input to the controller.

The controller may be configured such that at least one of said at least one characteristic of the label stock is determined by the controller based upon the sensor signal.

The labelling machine may further comprise a biasing member, the biasing member being configured to bias the movable member towards a home position and to exert a force on the label stock via the movable member.

The labelling machine may further comprise a label applicator located in a location along said web path between said take up and supply spool supports and arranged to separate labels from the web for application to a receiving surface.

The labelling machine may be arranged to apply preprinted labels to packages in a product packaging facility.

The labelling machine may further comprise a printer arranged to print onto labels prior to application of labels onto the receiving surface. The labels printed upon may be pre-printed.

The labelling machine may further comprise a memory, and the controller may be configured to monitor at least one of the sensor signal and brake assembly control signal and periodically, based upon the at least one of the sensor signal and brake assembly control signal, update a value stored in the memory which is indicative of the accumulated use of the braking assembly, the controller further being configured such that, when the value stored in the memory falls within a predetermined range, the controller outputs a signal indicative that maintenance of the braking assembly may be required.

Because the controller outputs a signal which is indicative that maintenance of the braking assembly may be required before the braking assembly fails, it is possible to perform maintenance on the braking assembly at a convenient time and not at a potentially inconvenient time at which failure of the braking assembly actually occurs.

The value stored in the memory may fall within a predetermined range if it is above a predetermined amount. The value stored in the memory may fall within a predetermined range if it is below a predetermined amount.

According to another aspect of the present invention there is provided a method of operating a labelling machine, the labelling machine comprising a supply spool support for supporting a supply spool comprising label stock; a take-up spool support adapted to take up a portion of the label stock; a movable element which defines a portion of a web path between the supply spool and the take-up spool support; a sensor; and a brake assembly comprising a frictional brake comprising a first braking surface mechanically linked to said one of said spool supports and a second braking surface; wherein the method comprises the sensor producing a sensor signal indicative of the position of the movable element; and the brake assembly applying a braking force to one of said spool supports based upon the sensor signal, the braking force resisting rotation of said one of said spool supports, wherein the first and second braking surfaces are urged together and friction between the first and second braking surfaces produces said braking force. In other words, the first and second braking surfaces may be urged into contact and friction between the first and second braking surfaces produces said braking force.

According to a further aspect of the invention there is provided a method of monitoring operation of a braking assembly in a labelling machine, the method comprising generating data based upon applied braking; and generating an output signal if said generated data has a predetermined relationship with a predetermined threshold.

Generating data based upon applied braking may comprise generating data indicating cumulative applied braking.

Said predetermined threshold may be based upon operation of the braking assembly in a first condition.

Said predetermined old is based upon average operation of the braking assembly in said first condition over a predetermined time period.

The first condition may occur when the labelling machine is operated using a first spool of label stock. The first spool of label stock may be the first spool of label stock which is used by the labelling machine after a maintenance operation has been carried out on the braking assembly, for example, the first spool of label stock may be used by the labelling machine immediately after the maintenance operation. The first condition may occur when the labelling machine is operated using a first spool of label stock which is the first spool of label stock which is used by the labelling machine.

The output signal may indicate degradation in braking performance or wear of a portion of the braking assembly.

Generating data based upon applied braking may comprise monitoring the position of a moveable element. The movable element may define a portion of a web path between a label supply spool and a label take-up spool.

A control signal may be provided to control said applied braking and generating data based upon applied braking may comprise monitoring said control signal.

Said at least one of the data generated based upon applied braking and the predetermined threshold may be stored on a memory of the labelling machine.

According to another aspect of the invention there may be provided a labelling machine arranged to transport label carrying web from a supply spool support to a take up spool support and comprising means for removing labels from the web between said supply spool support and said take up spool support, and a brake assembly arranged to resist movement of one of the supply spool support and the take up spool support, the labelling machine further comprising a controller arranged to carry out a method according to the previously discussed aspect of the invention.

Although the above-described aspects of the invention relate to a labelling machine and a method of controlling a labelling machine, it will be appreciated that the invention may also be applied to a tape drive and method of controlling a tape drive. The tape drive may form part of a labelling machine or a printer (such as a thermal transfer printer). Whereas the tape in the labelling machine is label stock, the tape in a printer may be a print ribbon.

According to a further aspect of the present invention there is provided a tape drive suitable for a labelling machine or printer, comprising a supply spool support for supporting a supply spool of tape; a take-up spool support adapted to take up a portion of said tape; and a brake assembly configured to apply a braking force to one of said spool supports, the brake assembly comprising a solenoid comprising a coil and an armature having an extent of movement relative to the coil defined by first and second end positions, an armature position sensor configured to output an armature position signal which is indicative of the position of the armature relative to the coil, and a controller configured to control current supplied to the coil based upon the armature position signal so as to urge the armature towards a desired position relative to the coil which is intermediate the first and second end positions, the desired position applying a desired braking force to said one of said spool supports.

The tape drive may further comprise a first braking surface; and a second braking surface; wherein the first braking surface is associated with one of said spool supports, and the second braking surface is associated with the coil or the armature of the solenoid, and wherein the controller is further configured such that in a braking mode the solenoid controller controls the current supplied to the coil so as to urge the first braking surface and second braking surface into contact. In other words, the controller is further configured such that in a braking mode the solenoid controller controls the current supplied to the coil so as to urge the first braking surface and second braking surface together.

The armature position sensor may comprise a transmitter configured to transmit electromagnetic radiation; a reflective element associated with one of the armature or coil and movable therewith during relative movement between the armature and the coil, the reflective element being configured to reflect at least part of the electromagnetic radiation transmitted by the transmitter; and a receiver in a fixed positional relationship with respect to the other of said armature or coil, the receiver also being configured such that electromagnetic radiation transmitted by the transmitter and reflected by the reflective element is incident on the receiver.

According to another aspect of the invention there is provided a labelling machine comprising a supply spool support for supporting a supply spool comprising label stock; a take-up spool support adapted to take up a portion of the label stock; and a brake assembly configured to apply a braking force to one of said spool supports, the braking force resisting rotation of said one of said spool supports; wherein the brake assembly comprises a frictional brake comprising a first braking surface mechanically linked to said one of said spool supports and a second braking surface, the first and second braking surfaces being configured such that when the first and second braking surfaces are urged into contact (or together), friction between the first and second braking surfaces produces said braking force; and a motor mechanically linked to the second braking surface, the motor being configured to selectively urge the second braking surface and first braking surface together to produce said braking force. In other words, the motor may be configured to selectively urge the second braking surface into contact (or together) with the first braking surface to produce said braking force.

The motor may be a torque controlled motor. For example, the motor may be a DC motor in which the torque applied by the motor is related to the current supplied to the motor, as is well known in the art.

The motor may be a position controlled motor. The position controlled motor may be a stepper motor.

The brake assembly may comprise a brake disc mechanically linked to said one of said spool supports, the brake disc having said first braking surface; and a belt passing around at least part of the brake disc, the belt having said second braking surface. The motor may be mechanically linked to the belt.

The motor may be mechanically linked to the belt via a cam, wherein the motor and cam are configured such that rotation of the motor produces rotation of the cam.

The cam may be linked to a first portion of the belt, and a second portion of the belt is fixed against movement; and wherein the cam is configured such that when it is rotated in a first direction by the motor, the cam urges at least a portion of the second braking surface towards the first portion of the belt, thereby urging the second braking surface into contact with (or towards) the first braking surface. In other words, the cam may urge at least a portion of the second braking surface towards the first portion of the belt, thereby urging the second braking surface and the first braking surface together.

The labelling machine may be configured such that in a powered down state of the labelling machine, the brake assembly applies a braking force applied to said one of said spool supports.

The brake assembly may further comprise a resilient biasing member, the resilient biasing member being mechanically linked to the cam or the second braking surface and being configured to urge the first and second braking surfaces into contact with (or towards) one another.

The brake assembly may comprise a manual brake release assembly, the manual brake release assembly being configured to move the second braking surface in a direction so as to reduce the braking force.

The manual brake release assembly may comprise a movable element which defines a portion of a web path between the supply spool and the take-up spool.

The manual brake release assembly may include a first engagement member attached to the cam, such that movement of the first engagement member causes movement of the cam, thereby causing said movement of the second braking surface.

The movable element may comprise a second engagement member; and the first and second engagement members may be configured such that the movable element may be moved by a user such that the first and second engagement members engage such that movement of the movable element causes movement of the engaged first and second engagement members thereby causing movement of the cam and hence said movement of the second braking surface.

According to another aspect of the invention there is provided a labelling machine comprising a supply spool support for supporting a supply spool comprising label stock; a take-up spool support adapted to take up a portion of the label stock; a movable element which defines a portion of a web path between the supply spool and the take-up spool support; and a brake assembly configured to apply a braking force to one of said spool supports, the braking force resisting rotation of said one of said spool supports; wherein the brake assembly comprises a frictional brake comprising a first braking surface mechanically linked to said one of said spool supports and a second braking surface, the first and second braking surfaces being configured such that when the first and second braking surfaces are urged into contact (or together, or towards one another), friction between the first and second braking surfaces produces said braking force; and wherein the brake assembly comprises a manual brake release assembly, the manual brake release assembly being configured to move the second braking surface in a direction so as to reduce the braking force.

The manual brake release assembly may include a first engagement member mechanically linked to the second braking surface, such that movement of the first engagement member causes said movement of the second braking surface.

The movable element may comprise a second engagement member; the first and second engagement members may be configured such that the movable element may be moved by a user such that the first and second engagement members engage such that movement of the movable element causes movement of the engaged first and second engagement members thereby causing said movement of the second braking surface.

According to an aspect of the invention there is provided a labelling machine comprising a supply spool support for supporting a supply spool comprising label stock comprising a web and a plurality of labels attached to the web and which are separable from the web; a take-up spool support adapted to take up a portion of web;

a sensor configured to produce a sensor signal indicative of a periodic property of at least a portion of the label stock; and a controller configured to calculate a displacement of the web a web path defined between the supply spool and the take-up spool based upon the sensor signal and a length of a component of the label stock.

By measuring displacement of the web along the web path as a function of the sensor signal, and hence as a function of a periodic property of a portion of the label stock, the controller can monitor movement and/or position of the web.

The sensor may be configured such that it does not contact the label stock. This may be advantageous in some applications because, in some applications, a component which contacts the label stock may be prone to wear or has the potential to impair movement of the label stock or misalign the label stock.

The sensor may comprise an electromagnetic radiation detector. Any suitable electromagnetic radiation may be used as a basis for sensing including, for example, visible light, infrared radiation and ultraviolet radiation. Any appropriate electromagnetic radiation detector may be used. An example of a suitable electromagnetic radiation detector is a photovoltaic cell.

The sensor may further comprise an electromagnetic radiation source. Any appropriate radiation source may be used. Likewise, any appropriate electromagnetic radiation source may be used. Examples of suitable electromagnetic radiation sources include a light emitting diode and a laser.

The label stock may comprise labels which are spaced from one another along the web.

Within the description, label stock may be used to refer to the web with attached labels. Label stock may also be used to refer to a portion of web from which labels have been separated.

The property of at least a portion of the label stock may be the electromagnetic transmittance or reflectance of at least a portion of the label stock.

The periodic property may arise from the spatial arrangement of labels on the web. For example the periodic property may arise from the label length and/or spacing between adjacent labels. This may be because the labels, the web and/or web with attached label may have different properties which give rise to the periodic nature of a property of the label web.

The sensor may be arranged to sense differences between a property of the web and a label attached thereto and a property of the web. For example, the electromagnetic transmittance of the label web with a label attached thereto may be lower than the electromagnetic transmittance of the web without a label attached thereto.

The portion of the label stock may comprise the web and attached labels.

The length of a component of the label stock may be selected from the group consisting of a length of a label, a pitch length between adjacent labels and a gap length between adjacent labels.

Where the periodic property arises from the spatial arrangement of the labels on web, the described method allows displacement of the web to be determined based upon a number of labels (which need not be an integer number) which pass the sensor and a distance related to label length (or label lengths in the case of label stocks having labels with differing lengths) in the direction of label web movement and/or label spacing.

The labelling machine may further comprise a rotation monitor configured to monitor the rotation of one of said spool supports, the rotation monitor being configured to output a rotation signal indicative of the rotation of said one of said spool supports. Any appropriate rotation monitor may be used and any appropriate method may be used to produce a rotation signal indicative of the rotation of the spool support. Various rotation monitors are described throughout the specification, any of which may be used. For example, rotation monitors using optical or magnetic sensors can be employed.

The controller may be configured to calculate a diameter of a spool supported by one of said spool supports based upon the calculated displacement of the web and the rotation signal. That is, if it is known that a particular (linear) displacement of the web corresponds to a particular number (which need not be an integer number) of rotations of one of the spools, it is a straightforward matter to determine spool diameter (or radius) using the known relationship between spool diameter and spool circumference.

The displacement of the web calculated by the controller may be used to cause movement of web along the web path such that a target portion of the label stock is moved to a desired position along the web path.

The target portion of the label stock may be a leading edge of a label and the desired position is adjacent an edge of a labelling peel beak. Any appropriate portion of the label stock may be the target portion. For example, the target portion may be a trailing edge of a label, or a portion of a label which is spaced from the leading or trailing edge of a label by a predetermined distance. The target portion may be a portion of the web. For example the target portion may be a portion of the web between adjacent labels. The desired position may be spaced a predetermined distance from an edge of a labelling beak. The desired position may be any appropriate position along the web path. For example, the desired position may be adjacent a printer or may be adjacent a component of the labelling machine.

The labelling machine may further comprise motive means for advancing the label stock along the web path from the supply spool support to the take up spool support.

The motive means may comprise a motor configured to rotate the take up spool support. The motor may be configured to rotate the take up spool support in the direction of transport of the label web.

The motor may be selected from the group consisting of a DC motor, an open loop position controlled motor (e.g. a stepper motor) and a closed loop position controlled motor (e.g. a torque controller motor, such as a DC motor, together with an appropriate positional sensor and feedback control circuit). However any suitable motor may be used. Those skilled in the art will be aware of control schemes which are suitable to control rotation of the motors to achieve the methods described herein, depending upon the type of motor selected for use. Those skilled in the art will further be aware of the relative merits of various motor types and will be able to select a suitable motor type on that basis.

The motive means may include a motor configured to rotate the supply spool support and/or a capstan roller which engages the label web. The motor may be configured to rotate the supply spool support and/or capstan roller in the direction of transport of the label web.

The controller may be configured to control the motive means to advance the label stock such that the target portion of the label stock is moved to the desired position (e.g. such that a particular part of the label stock—such as a label edge—is positioned in a predetermined spatial relationship with a label peel beak).

The sensor may be further configured to measure the length of the component of the label stock.

The controller may be configured to determine the length of the component of the label stock based upon monitored rotation one of said spool supports during sensing of an integer number of periods of said sensor signal. For example, the controller may count the number of steps that the take up motor is commanded to advance for a single period of the sensor signal. Based on the number of steps the take up motor is commanded to advance for a single period of the sensor signal and the diameter of the take up spool, the controller may determine a pitch length of the label stock. It will be appreciated that other similar parameters of the label stock may be similarly determined.

The controller may be configured to determine the length of the component of the label stock based upon a diameter of a spool supported by the spool support the rotation of which is monitored. Various methods of determining the diameter of a spool support are described within this specification. Any of these methods may be used to determine the diameter of the spool support.

The labelling machine may further comprise a further sensor configured to measure the length of the component of the label stock.

The labelling machine may further comprise a label applicator located in a location along said web path between said take up and supply spool supports and arranged to separate labels from the web for application to a receiving surface. The label applicator may include a labelling peel beak.

The labelling machine may be arranged to apply pre-printed labels to packages in a product packaging facility.

The labelling machine may further comprise a printer arranged to print onto labels prior to application of labels onto the receiving surface. The labels printed upon may be pre-printed. The labelling machine may be a print and apply labelling machine.

According to another aspect of the invention there is provided a method of controlling a labelling machine, the labelling machine comprising a supply spool support for supporting a supply spool comprising label stock comprising a web and a plurality of labels attached to the web and which are separable from the web; a take-up spool support adapted to take up a portion of web; a sensor; and a controller; wherein the method comprises the sensor producing a sensor signal indicative of a periodic property of at least a portion of the label stock; providing the sensor signal to the controller; and the controller calculating a displacement of the web along a web path defined between the supply spool and the take-up spool based upon the sensor signal and a length of a component of the label stock.

According to a further aspect of the invention there is provided a labelling machine configured to carry out labelling operations, the labelling machine comprising a supply spool support for supporting a replaceable supply spool; a take-up spool support adapted to take up a portion of web, a web path being defined between the supply spool and the take-up spool; and a controller configured to calculate a time indicative of when the supply spool requires replacement in order for the labelling machine to carry out further labelling operations.

The time may be a time of day and/or date.

In this way an operator of the labelling machine may be provided with an easy to understand indication of when supply spool replacement is required. This allows operators of the labelling machines to plan work accordingly. For example it allows operators to ensure that they are ready to replace a supply spool at the relevant time thereby minimising labelling machine downtime.

The controller may be configured to calculate the time indicative of when the supply spool requires replacement based on a diameter of the supply spool.

Although the above-described aspects of the invention relate to a labelling machine and a method of controlling a labelling machine, it will be appreciated that the invention may also be applied to a tape drive and method of controlling a tape drive. The tape drive may form part of a labelling machine or a printer (such as a thermal transfer printer). Whereas the tape in the labelling machine is label stock, the tape in a printer may be a print ribbon.

According to an aspect of the invention there is provided a labelling machine comprising a supply spool support for supporting a supply spool comprising label stock comprising a web and a plurality of spaced labels attached to the web and which are separable from the web; a take-up spool support adapted to take up a portion of web; a motive means configured to propel the web along a web path from the supply spool support to the take-up spool support; a controller, and a sensor having a transmitter portion and a receiver portion, the transmitter portion and receiver portion being configured to receive a portion of the label stock therebetween, and to produce a sensor signal which is a function of a property of a portion of label stock at a plurality of positions spaced from one another in a direction non-parallel to the web path.

By having a sensor which produces a sensor signal which is a function of a property of a portion of label stock at a plurality of positions spaced from one another in a direction non-parallel to the web path the a labelling machine according to the invention is better able to handle label stock which includes labels which have an irregular shape, for example, labels having a leading and/or trailing edge which is non-perpendicular to the web path. In particular, in some known labelling machines sensors are used which produce a sensor signal which is a function of a property of a portion of the label stock only at a single point in a direction non-parallel to the label web. It has been appreciated that such sensors are disadvantageous as, where the property of the label web varies in the non-parallel direction, such variations cannot be sensed by the sensor although knowledge of such variations is useful in control of the labelling machine. This is particularly so when the sensor is used as a so-called "gap sensor" as gaps between adjacent labels can be more readily detected than is the case when a single position sensor is used.

The controller may be configured to control the motive means based upon a change in the sensor signal in order to position a target portion of the label stock at a desired location along the web path.

The label stock may comprise labels which are spaced from one another along the web.

Within the description, label stock may be used to refer to the web with attached labels. Label stock may also be used to refer to a portion of web from which labels have been separated.

The part of the label stock may be a leading edge of a label and the desired location along the web path may be an edge of a labelling peel beak. Any appropriate portion of the label stock may be the target portion. For example, the target portion may be a trailing edge of a label, or a portion of a label which is spaced from the leading or trailing edge of a label by a predetermined distance. The target portion may be a portion of the web. For example the target portion may be a portion of the web between adjacent labels. The desired position may be spaced a predetermined distance from an edge of a labelling peak. The desired position may be any appropriate position along the web path. For example, the desired position may be adjacent a printer or may be adjacent a component of the labelling machine.

The controller may be configured to detect a feature of the label stock based upon a change in the sensor signal.

The feature of the label stock may be selected from the group consisting of: a length of a portion of the label stock, the presence of a label of the label stock, the absence of a label of the label stock, the leading edge of a label of the label stock and the trailing edge of a label of the label stock. The feature of the label stock may be any appropriate portion of the label stock. The detected feature may be the target portion of the label stock. The target portion may be a portion of a label which is spaced from the leading or trailing edge of a label by a predetermined distance. The target portion may be a portion of the web. For example the target portion may be a portion of the web between adjacent labels.

The feature of the label stock may be a length of a portion of the label stock and the length of the portion of the label stock may be selected from the group consisting of a length of a label, a pitch length between adjacent labels and a gap length between adjacent labels. The length of a label may be any appropriate length of a label. For example, the length of a label may be the length between two desired portions of a label.

The controller may be configured to control the motive means based upon a change in the sensor signal in order to position the detected feature of the label stock at a desired location along the web path. The detected feature may be the target portion of the label stock.

The motive means may comprise a motor configured to rotate the take-up spool support.

The motor may be selected from the group consisting of a DC motor, an open loop position controlled motor (e.g. a stepper motor) and a closed loop position controlled motor (e.g. a torque controller motor, such as a DC motor, together with an appropriate positional sensor and feedback control circuit). However any suitable motor may be used. Those skilled in the art will be aware of control schemes which are suitable to control rotation of the motors to achieve the methods described herein, depending upon the type of motor selected for use. Those skilled in the art will further be aware of the relative merits of various motor types and will be able to select a suitable motor type on that basis.

The transmitter portion may comprise an electromagnetic radiation source and the receiver portion may comprise an electromagnetic radiation detector. Any suitable electromagnetic radiation may be used as a basis for sensing including, for example, visible light, infrared radiation and ultraviolet radiation. Any appropriate electromagnetic radiation detector may be used. An example of a suitable electromagnetic radiation detector is a photovoltaic cell. Any appropriate electromagnetic radiation source may be used. Examples of suitable electromagnetic radiation sources include a light emitting diode and a laser.

The transmitter portion may be configured to produce beam of electromagnetic radiation which has a power density or intensity which is substantially the same at said plurality of positions.

The electromagnetic radiation source may comprise a plurality of light emitting diodes arranged in a substantially linear formation.

The receiver portion may comprise a photovoltaic device which is configured to produce a sensor signal which is a function of a property of a portion of label stock at said plurality of positions. The photovoltaic device may receive radiation which has passed through or reflected off said plurality of positions. The photovoltaic device may output a signal which is proportional to the total amount of radiation which is incident upon it.

The receiver portion may comprise a plurality of receivers.

The transmitter portion may comprise a plurality of transmitters.

Each of the transmitters and receivers may form part of a sensor pair, each sensor pair having a transmitter and a receiver. The transmitter of each pair may be configured to transmit a signal to the receiver of the pair via the label stock.

The property of a portion of label stock may be the electromagnetic transmittance of the portion of label stock. The property may be any other appropriate property of the label stock.

The portion of the label stock may comprise the web and attached labels. The portion of the label stock may comprise the web without an attached label.

The sensor may be arranged to sense differences between a property of the web and a label attached thereto and a property of the web. For example, the electromagnetic transmittance of the label web with a label attached thereto may be lower than the electromagnetic transmittance of the web without a label attached thereto.

Said plurality of positions may be spaced from one another in a direction substantially perpendicular to the web path. Said plurality of positions may be spaced from one another in a direction which is angled with respect to the web path.

The plurality of positions may form a substantially linear arrangement.

The sensor may be configured such that the spacing between an adjacent pair of said plurality of positions are spaced by a distance which is greater than approximately one twentieth of a width of a label of the label stock. The distance may be greater than at least one of one fiftieth, one fortieth, one thirtieth, one tenth and one fifth of a width of a label of the label stock. The width of the label may be the width of the label perpendicular to the web path.

The sensor may be configured such that the spacing between two of said plurality of positions are spaced by a distance which is greater than approximately one fifth of a width of a label of the label stock. The sensor may be configured such that the spacing between two of said plurality of positions are spaced by a distance which is greater than at least one of approximately one tenth, one seventh, one quarter, one third, one half of a width of a label of the label stock. The spacing between two of said plurality of positions may be the spacing between the two outer positions. The spacing between two of said plurality of positions may be the spacing between the two positions which have the greatest spacing.

The controller may be configured to control the motive means and/or detect the feature of the label stock based upon a first order or second order differential of the sensor signal. The controller may be configured to control the motive means and/or detect the feature of the label stock based upon a higher order differential of the sensor signal.

The controller may be configured to control the motive means and/or detect a feature of the label stock based on whether at least one of the sensor signal, a first order derivative of the sensor signal and a second order derivative of the sensor signal, have a predetermined relationship with a threshold value. For example, the at least one of the sensor signal, a first order derivative of the sensor signal and a second order derivative of the sensor signal may be greater than a thresh The controller may be configured to control the motive means and/or detect a feature of the label stock based on whether at least one of the sensor signal, a first order derivative of the sensor signal and a second order derivative of the sensor signal exhibit a predetermined signature, wherein the signature is a predetermined temporal pattern in the values of said at least one of the sensor signal, the first order derivative of the sensor signal and the second order derivative of the sensor signal.

The labelling machine may further comprise a label applicator located in a location along said web path between said take up and supply supports and arranged to separate labels from the web for application to a receiving surface.

The labelling machine may be arranged to apply pre-printed labels to packages in a product packaging facility.

The labelling machine may further comprise a printer arranged to print onto labels prior to application of labels onto the receiving surface. The labels printed upon may be pre-printed.

According to another aspect of the present invention there is provided a method of operating a labelling machine, the labelling machine comprising a supply spool support for supporting a supply spool comprising label stock comprising a web and a plurality of spaced labels attached to the web and which are separable from the web;

a take-up spool support adapted to take up a portion of web; a motive means, a controller, and a sensor having a transmitter portion and a receiver portion;

the method comprising the motive means propelling the web along a web path from the supply spool support towards the take up spool support; the transmitter portion and receiver portion receiving a portion of the label stock therebetween; and the sensor producing a sensor signal which is a function of a property of a portion of label stock at a plurality of positions spaced from one another in a direction non-parallel to the web path.

The controller may control the motive means based upon a change in the sensor signal in order to position a portion of the label stock at a desired location along the web path.

The controller may detect a feature of the label stock based upon a change in the sensor signal.

The receiver portion of the sensor may further comprise a plurality of receivers; and the method may comprise the receivers each producing a respective sensor signal which is a function of a property of a portion of label stock; the controller monitoring each of the sensor signals produced by the receivers; the controller selecting one of the sensor signals produced by the receivers based on said monitoring of each of the sensor signals produced by the receivers.

Said selected signal may be used by the controller to control the motive means based upon a change in the selected sensor signal in order to position a portion of the label stock at a desired location along the web path.

The controller may detect a feature of the label stock based upon a change in the selected sensor signal.

The controller may select one of the sensor signals produced by the receivers based on a predetermined criteria and wherein the predetermined criteria is selected from the group consisting of the sensor signal which exceeds a predetermined threshold for the greatest proportion of time; the sensor signal which is less than a predetermined threshold for the greatest proportion of time; the sensor signal which is the first sensor signal to exceed a predetermined threshold; the sensor signal which is the last sensor signal to exceed a predetermined threshold; the sensor signal which is the first sensor signal to be less than a predetermined threshold; the sensor signal which is the last sensor signal to be less than a predetermined threshold.

Said selected signal may be used by the controller to control the motive means based upon a change in the selected sensor signal in order to position a portion of the label stock at a desired location along the web path.

The controller may detect a feature of the label stock based upon a change in the selected sensor signal.

The controller may select one of the sensor signals produced by the receivers based on a predetermined criteria and wherein the predetermined criteria is selected from the group consisting of:

a sensor signal which exceeds a predetermined threshold for a greatest proportion of a monitoring time, a sensor signal which is less than a predetermined threshold for a greatest proportion of a monitoring time, a sensor signal which is the first sensor signal to exceed a predetermined threshold during a monitoring time, a sensor signal which is the last sensor signal to exceed a predetermined threshold during a monitoring time, a sensor signal which is the first sensor signal to be less than a predetermined threshold during a monitoring time, and a sensor signal which is the last sensor signal to be less than a predetermined threshold during a monitoring time.

Any of the features described in relation to the labelling machine above may be applied to the method above.

Although the above-described aspects of the invention relate to a labelling machine and a method of controlling a labelling machine, it will be appreciated that the invention may also be applied to a tape drive and method of controlling a tape drive. The tape drive may form part of a labelling machine or a printer (such as a thermal transfer printer). Whereas the tape in the labelling machine is label stock, the tape in a printer may be a print ribbon.

According to another aspect of the invention there is provided a labelling machine comprising a supply spool support for supporting a supply spool comprising label stock; a take-up spool support adapted to take up a portion of web, a web path being defined between the supply spool and the take-up spool; a rotation monitor configured to monitor the rotation of one of said spool supports, the rotation monitor being configured to output a rotation signal indicative of the rotation of said one of said spool supports; a torque application member configured to apply a torque to said one of said spool supports; a controller configured to determine a measure indicative of a width of the label stock based on the rotation signal and the torque applied to said one of said spool supports.

By determining a measure indicative of a width of the label stock the labelling machine does not require a user to manually supply the labelling machine with information relating to the width of the label stock. This eliminates the possibility of human error contributing to the labelling machine being provided with incorrect information about the width of the label stock and hence enables optimal performance of the labelling machine based on the measure indicative of a width of the label stock.

The torque application member may be configured to apply the torque directly to said one of said spool supports.

The torque application member may comprise a motor mechanically linked to said one of said spool supports, the motor being configured to rotate said spool support, and thereby apply the torque to said spool support.

The motor may be a DC motor and the controller may be configured to monitor the current supplied to the motor to thereby determine the torque applied to said spool support. It will be appreciated, however, that in alternative embodiments other types of motor may be used and appropriately controlled.

The torque application member may be configured to apply the torque indirectly to said one of said spool supports. For example, the torque may be applied to said one of said spool supports by the label stock.

The torque application member may comprise a movable member which defines a portion of the web path and which is configured to contact the label stock and apply a force thereto, the force applied to the label stock being transmitted to said one of said spool supports via the label stock and thereby applying a torque to said one of said spool supports.

The labelling machine may comprise a biasing member configured to bias the movable member towards a home position. The biasing member may be a spring.

The force applied by the movable member to the label stock may depend on the position of the movable member. For example, if the movable member is biased by a spring that generally obeys Hooke's law, the greater the extension (or compression) of the spring the greater the force applied by the movable member to the label stock.

The labelling machine may further comprise a sensor configured to produce a sensor signal indicative of the position of the movable member.

The sensor configured to produce a sensor signal indicative of the position of the movable element may comprise a magnetic sensor attached to one of the moveable element or a portion of labelling machine which is fixed relative to the movable element; and a magnet attached to the other of said movable element or said portion of the labelling machine.

The magnet may be selected from the group consisting of a multi-pole magnet and a plurality of magnets.

The labelling machine may further comprise a brake assembly configured to apply a braking force to said one of said spool supports.

The rotation monitor may comprise a Hall effect sensor or reed switch.

The controller may be configured to determine an angular acceleration of said one of said spool supports based on the rotation signal.

The controller may be configured to determine the measure indicative of a width of the label stock on based on said angular acceleration of said one of said spool supports and the torque applied to said one of said spool supports.

The controller may be configured to determine the measure indicative of a width of the label stock based on a moment of inertia of said one of said spool supports and any supported spool.

The controller may be configured to determine the measure indicative of a width of the label stock based on the outer diameter of the spool supported by said one of said spool supports.

The controller may be configured to determine the measure indicative of a width of the label stock based on the average density of the spool supported by said one of said spool supports.

The controller may be configured to determine a desired label stock tension based on the measure indicative of a width of the label stock.

The labelling machine may further comprise a label applicator located at a location along said web path between said take up and supply supports and arranged to separate labels from the web for application to a receiving surface.

The labelling machine may be arranged to apply preprinted labels to packages in a product packaging facility.

The labelling machine may further comprise a printer arranged to print onto labels prior to application of labels onto the receiving surface.

According to a further aspect of the invention there is provided a method of operating a labelling machine, the labelling machine comprising a supply spool support for supporting a supply spool comprising label stock; a take-up spool support adapted to take up a portion of web; a web path being defined between the supply spool and the take-up spool; a rotation monitor; a torque application member; and a controller; wherein the method comprises the rotation monitor monitoring the rotation of one of said spool supports, and outputting a rotation signal indicative of the rotation of said one of said spool supports; the torque application member applying a torque to said one of said spool supports; and the controller determining a measure indicative of a width of the label stock based on the rotation signal and the torque applied to said one of said spool supports.

The labelling machine may further comprise a brake assembly; and the torque application member may comprise a movable member which defines a portion of the web path; and the method may further comprise the brake assembly applying a braking force to said one of said spool supports which substantially prevents rotation of said one of said spool supports; the movable member contacting the label stock and applying a force thereto, the force applied to the label stock being transmitted to said one of said spool supports via the label stock and thereby applying a torque to said one of said spool supports; and the brake assembly being released such that it allows rotation of said one of said spool supports resulting from the torque applied to said one of said spool supports.

The labelling machine may comprise a biasing member, the biasing member biasing the movable member towards a home position.

The force applied by the movable member to the label stock may depend on the position of the movable member.

The labelling machine may further comprise a sensor, the sensor producing a sensor signal indicative of the position of the movable member.

Although the above-described aspects of the invention relate to a labelling machine and a method of controlling a labelling machine, it will be appreciated that the invention may also be applied to a tape drive and method of controlling a tape drive. The tape drive may form part of a labelling machine or a printer (such as a thermal transfer printer). Whereas the tape in the labelling machine is label stock, the tape in a printer may be a print ribbon.

Where features have been described above in the context of one aspect of the invention, it will be appreciated that where appropriate such features may be applied to other aspects of the invention. Indeed, any of the features described above and elsewhere herein can be combined in any operative combination and such combination is expressly foreseen in the present disclosure.

To the extent appropriate, control methods described herein may be implemented by way of suitable computer programs and as such computer programs comprising processor readable instructions arranged to cause a processor to execute such control methods are provided. Such computer programs may be carried on any appropriate carrier medium (which may be a tangible or non-tangible carrier medium).

Specific embodiments of the present invention will now be described, by way of example only, with reference to the accompanying drawings, in which.

Figure 1:
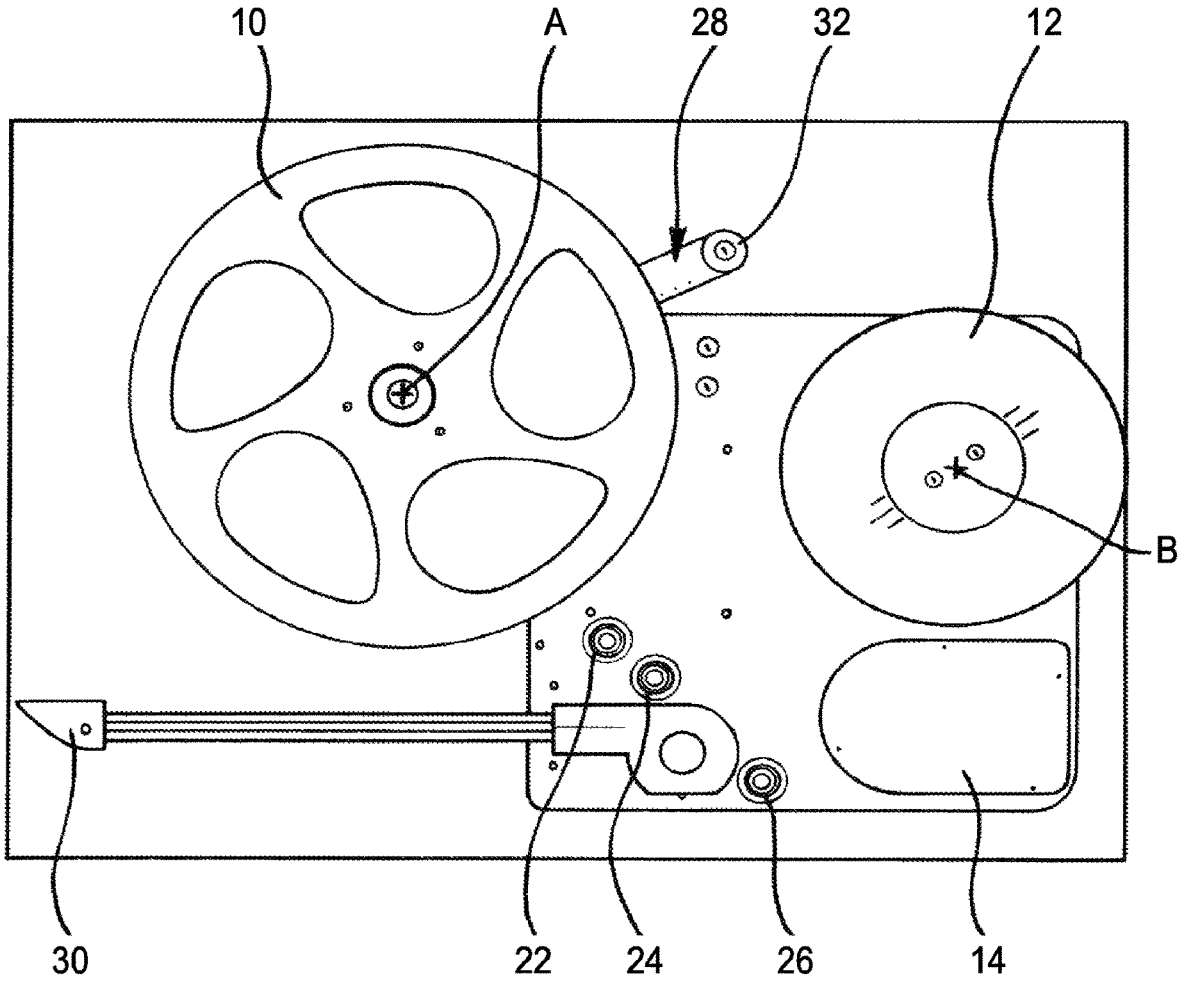
FIG. 1 shows a schematic side elevation of a portion of a labelling machine in accordance with an embodiment of the invention.
Figure 2:
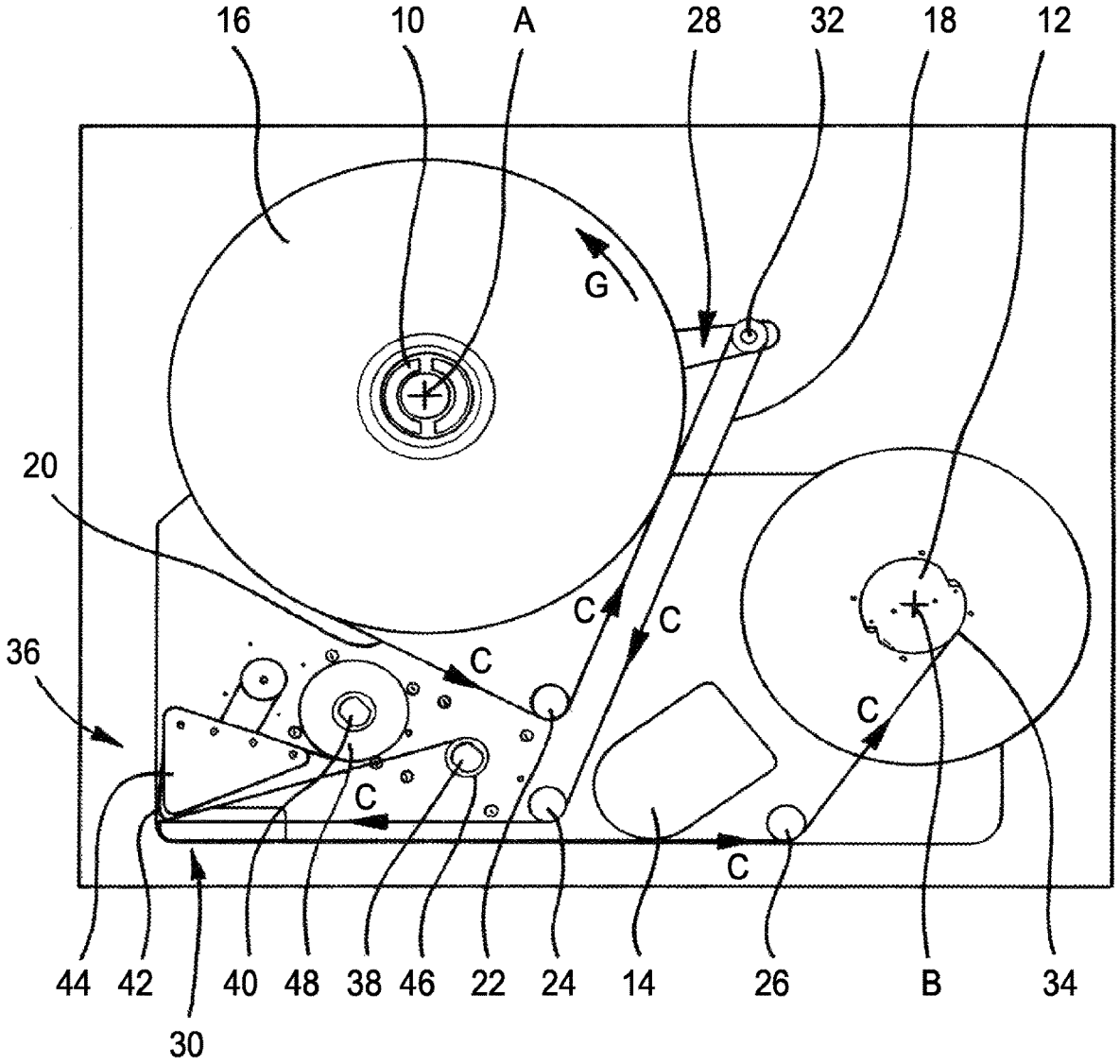
FIG. 2 shows a schematic side elevation of a portion of a labelling machine in accordance with a second embodiment of the invention.
Figure 4:
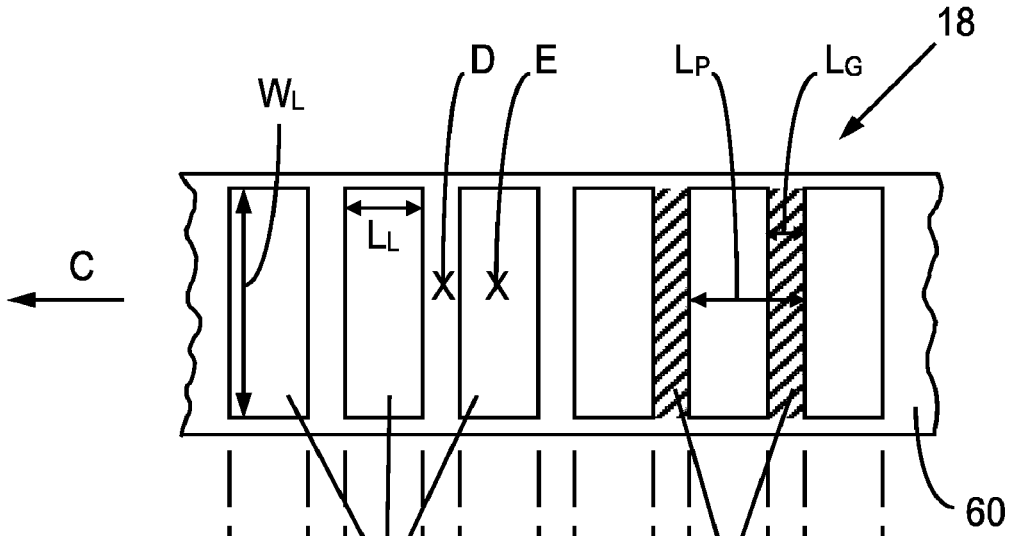
FIG. 4 shows a schematic plan view of a portion of label stock which is utilised in conjunction with a labelling machine in accordance with an embodiment of the invention.
Figure 4A:
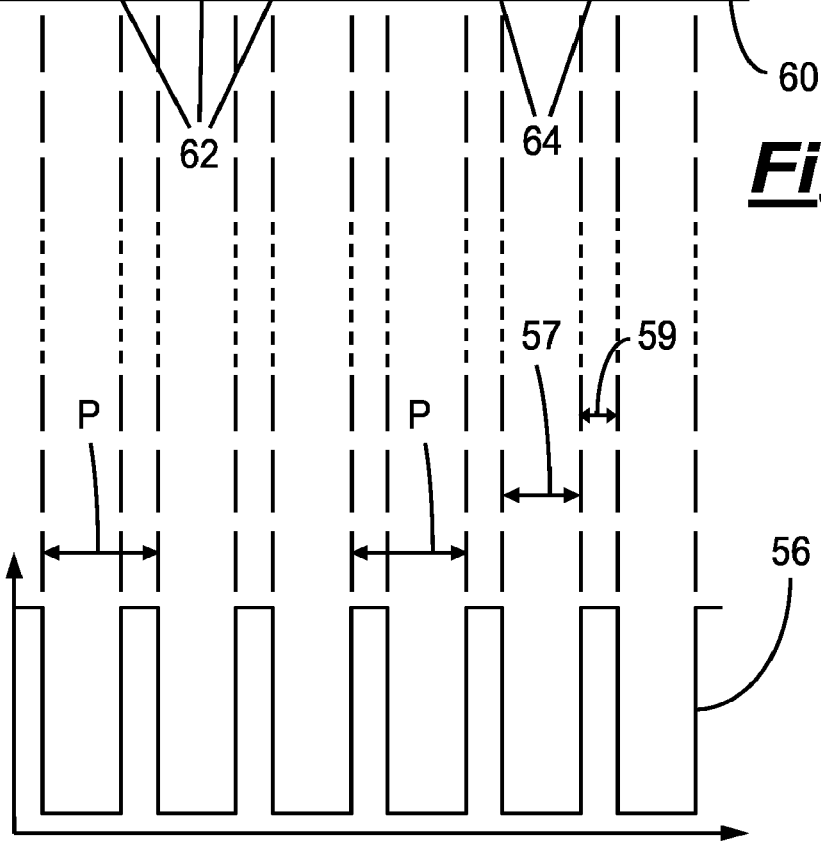
Figure 5:
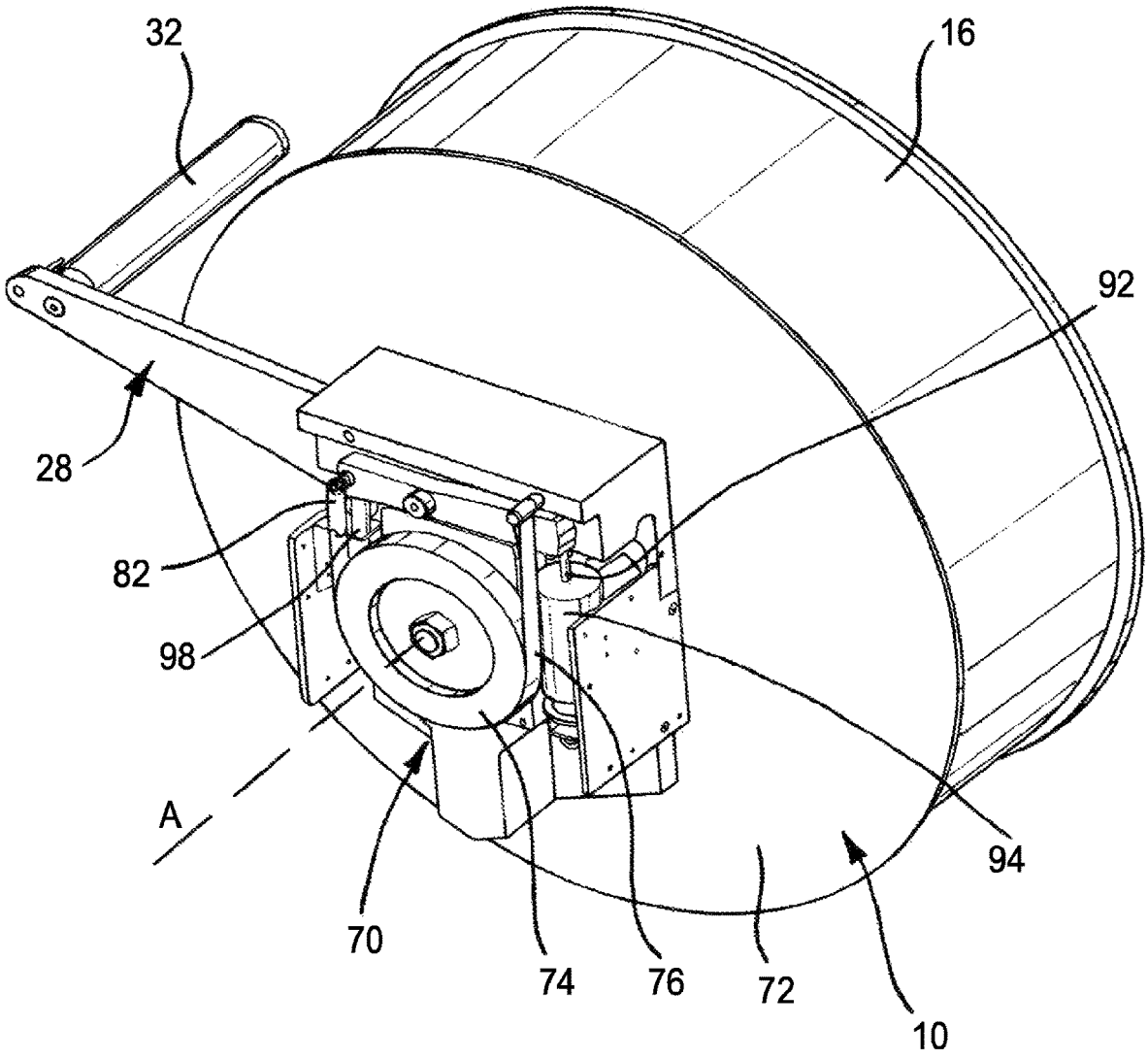
Figure 6:
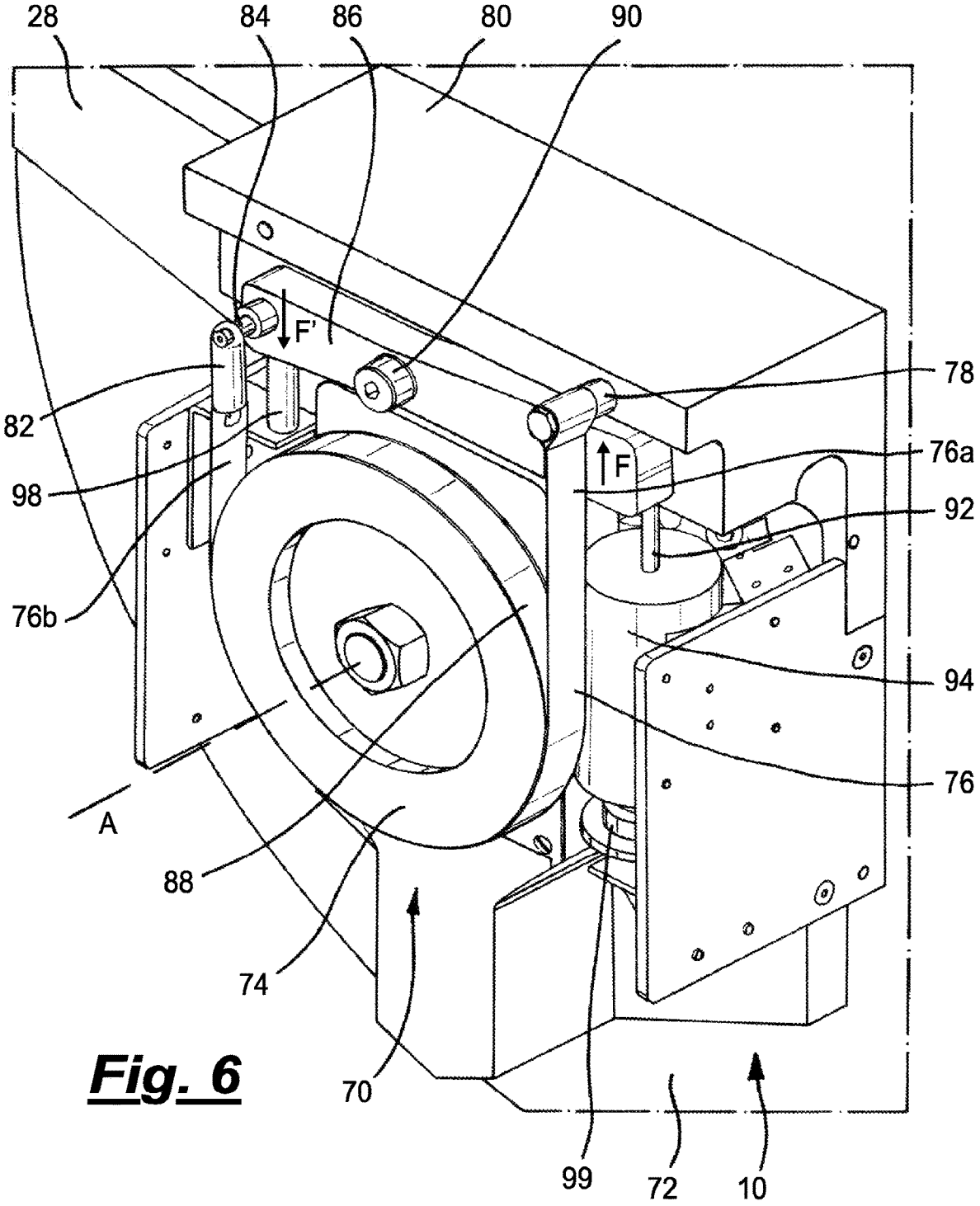
Figure 7:
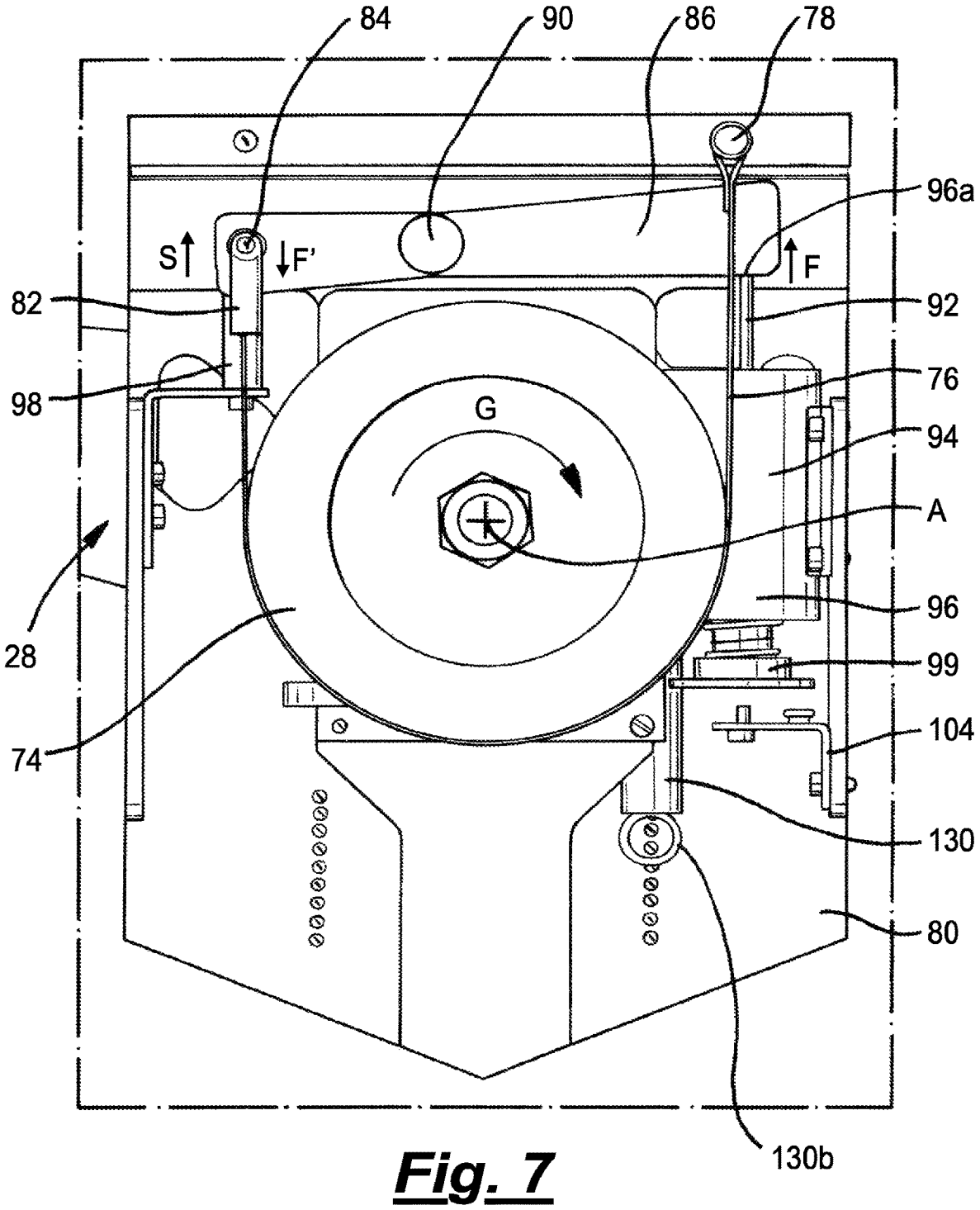
Figure 8:
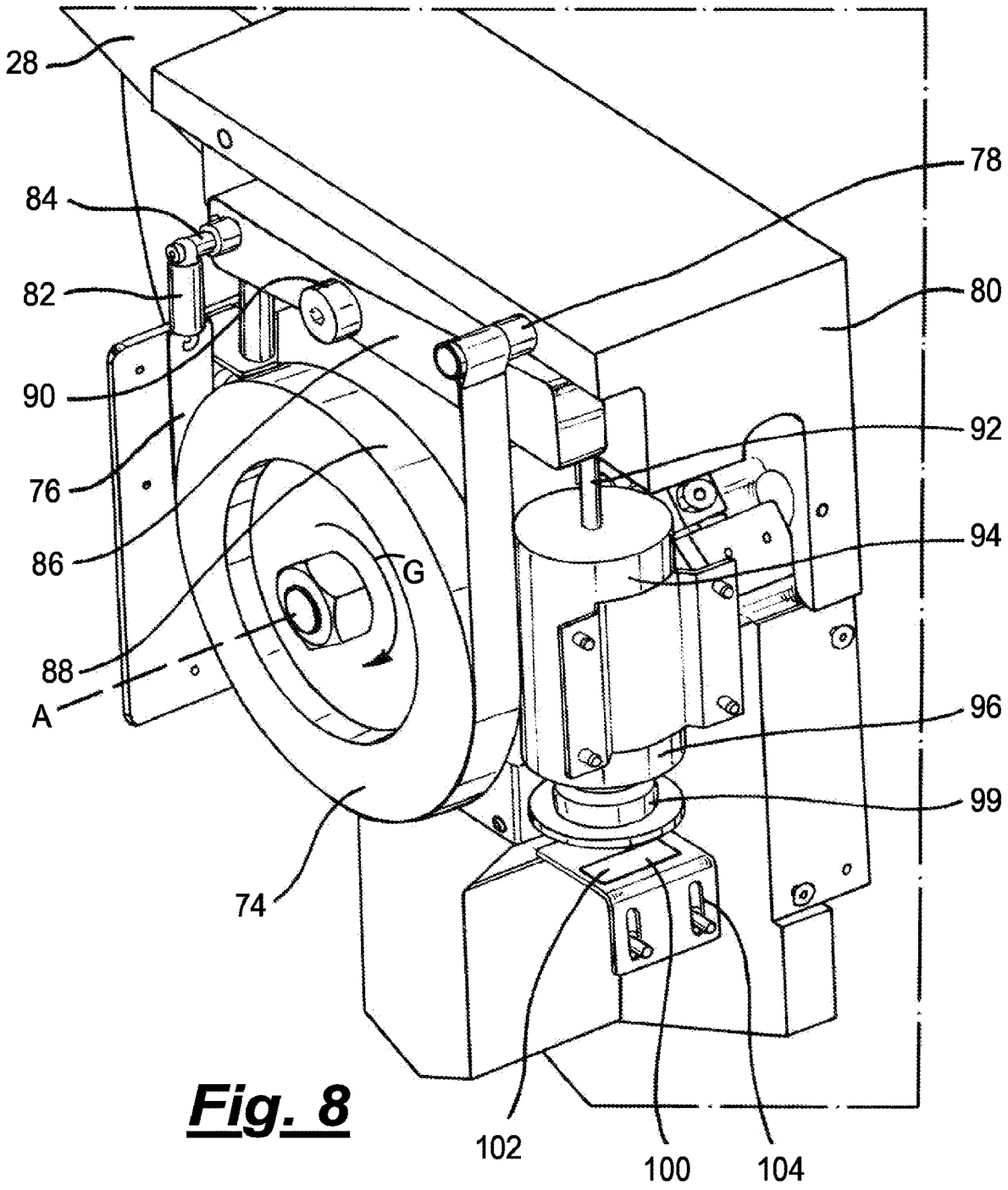
Figure 9:
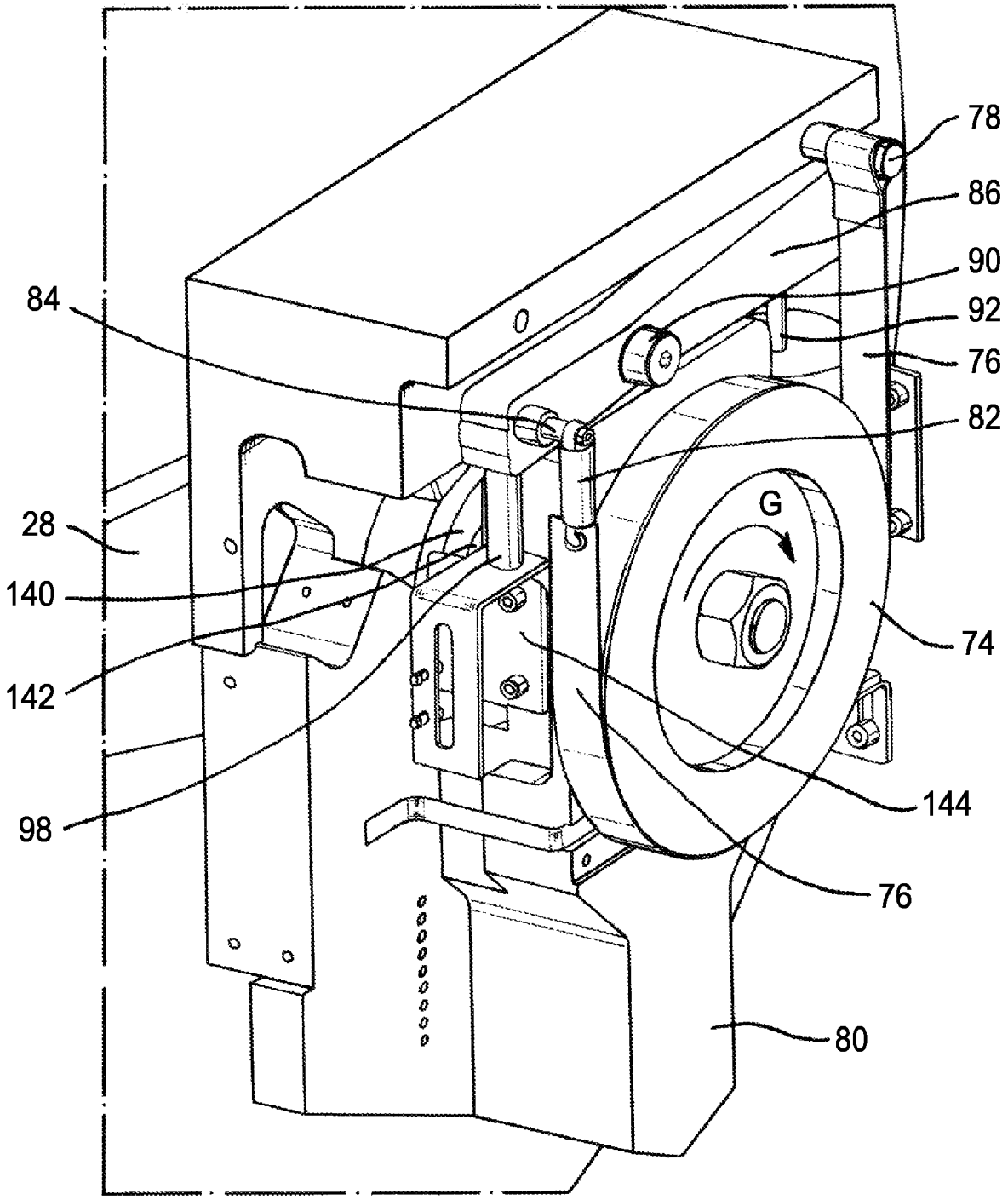
Figure 10:
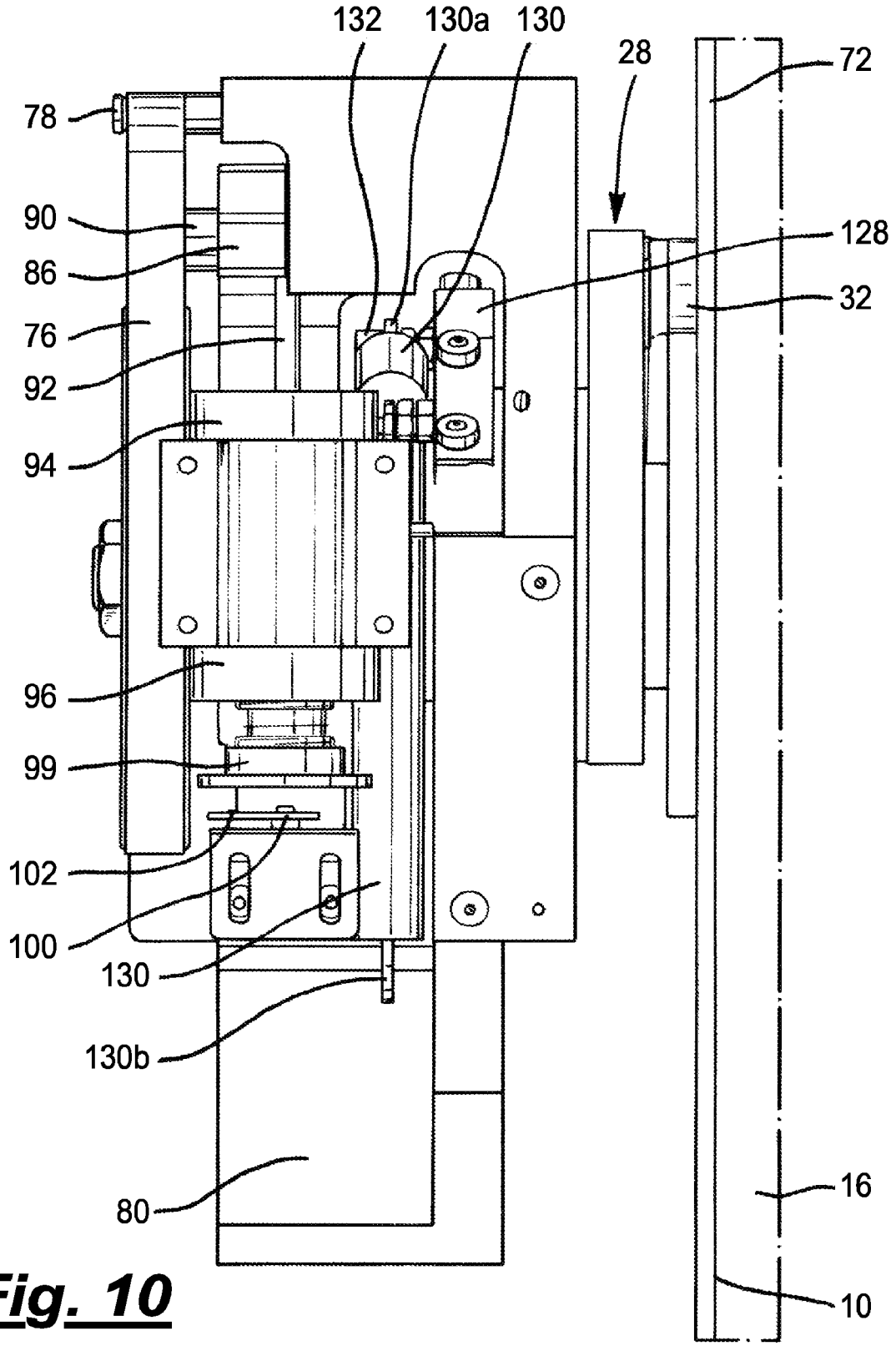
Figure 11:
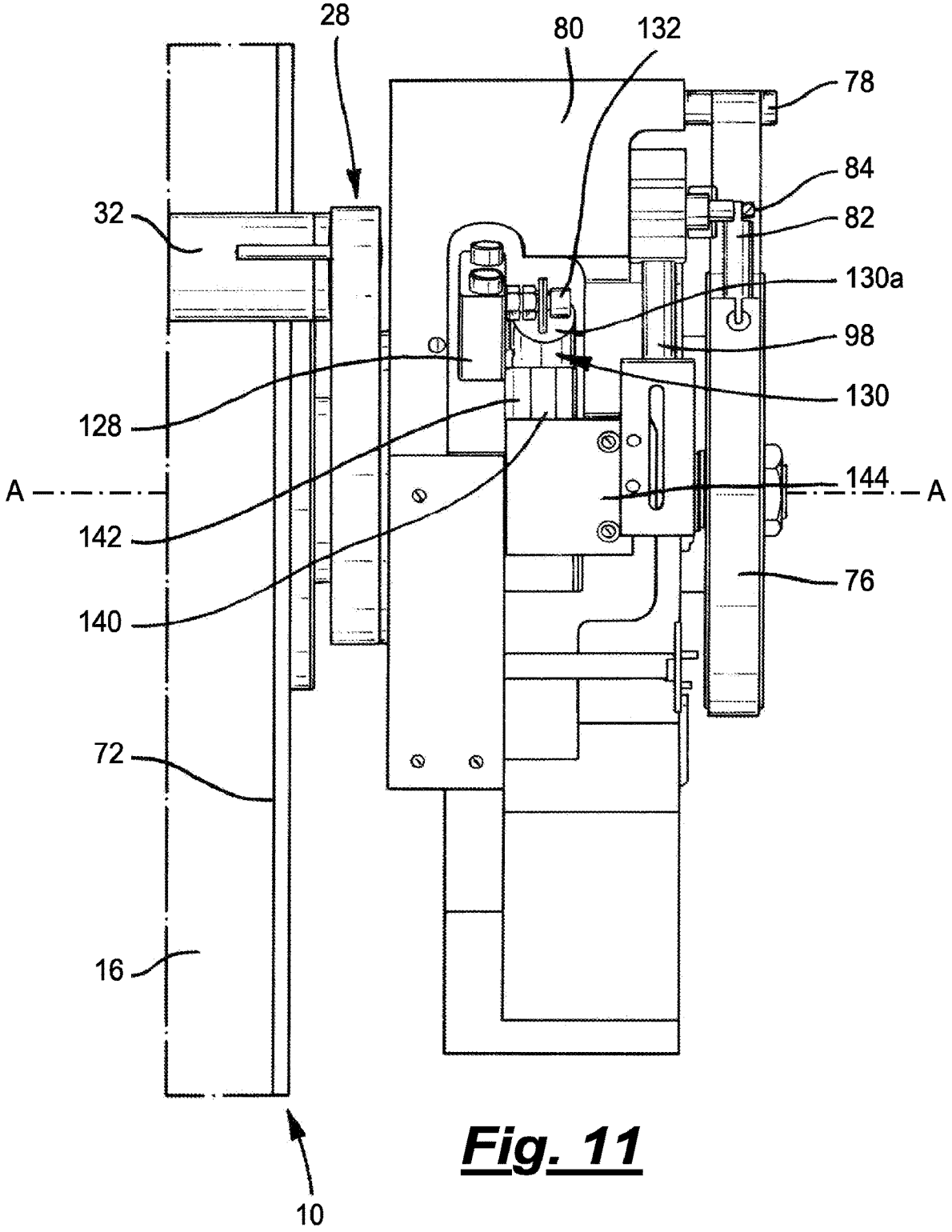
Figure 12:
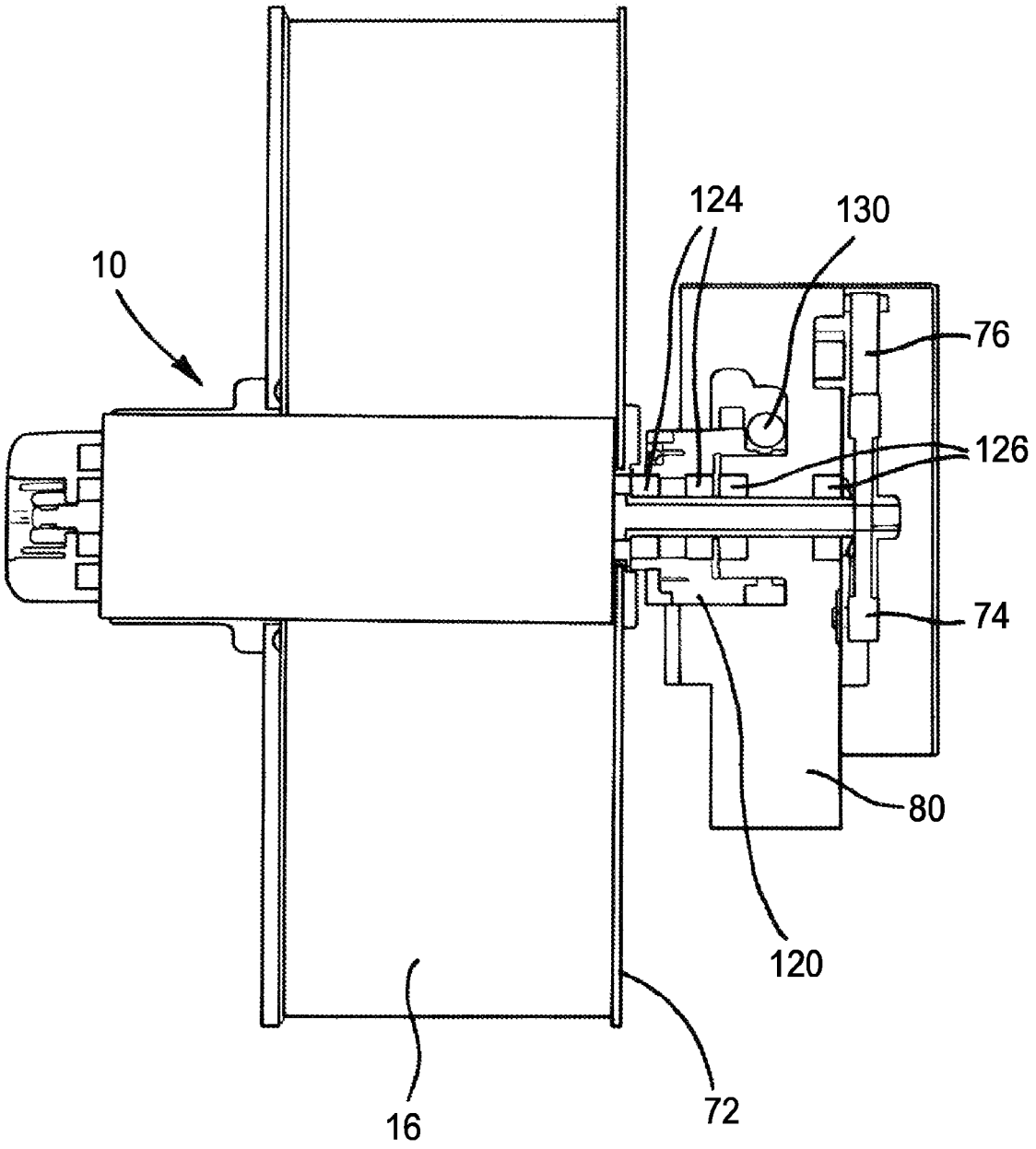
Figure 13:
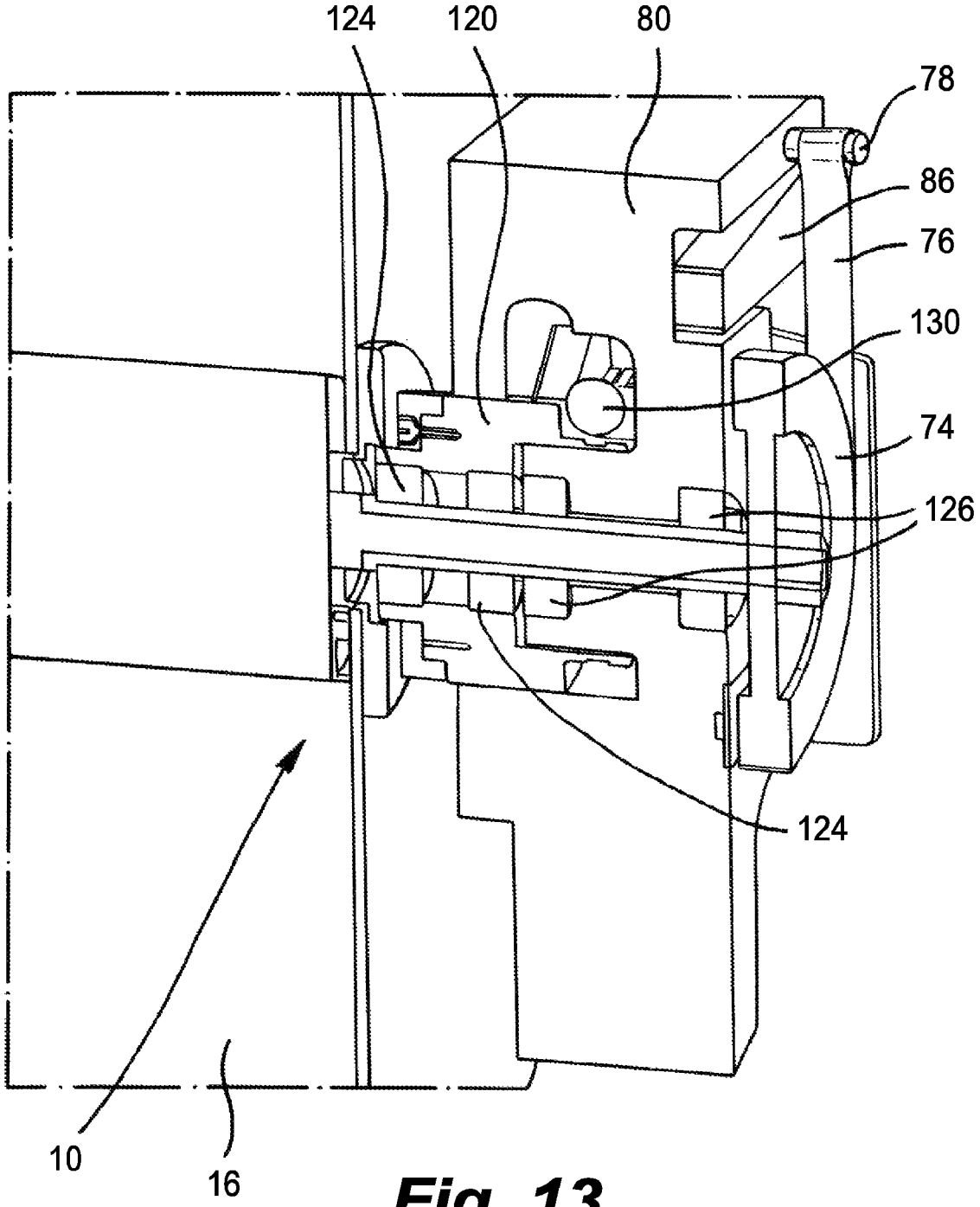
Figure 14:
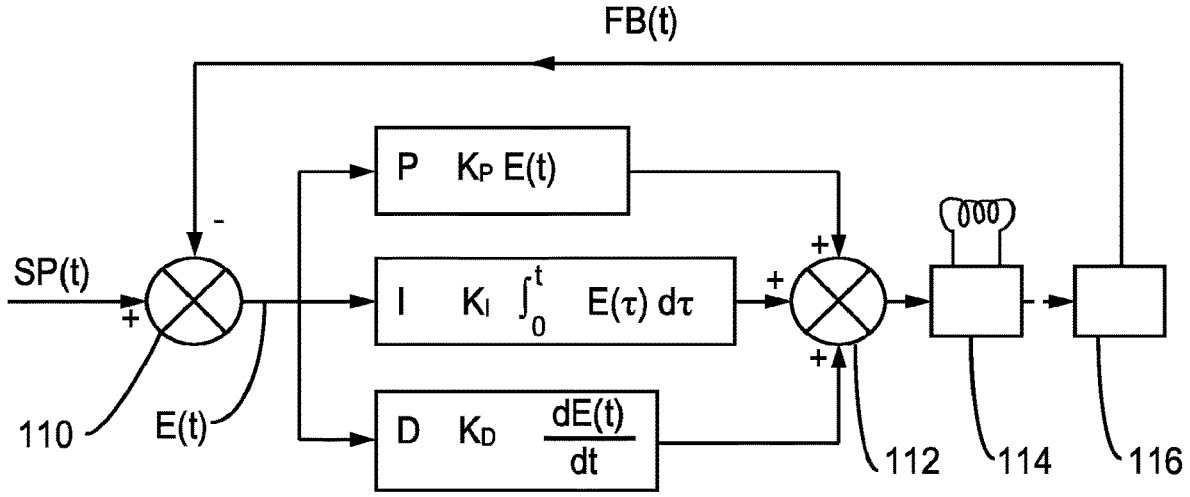
Figure 15:
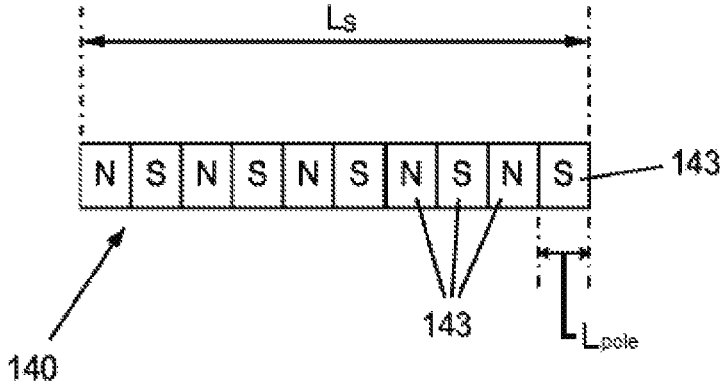
Figure 16:
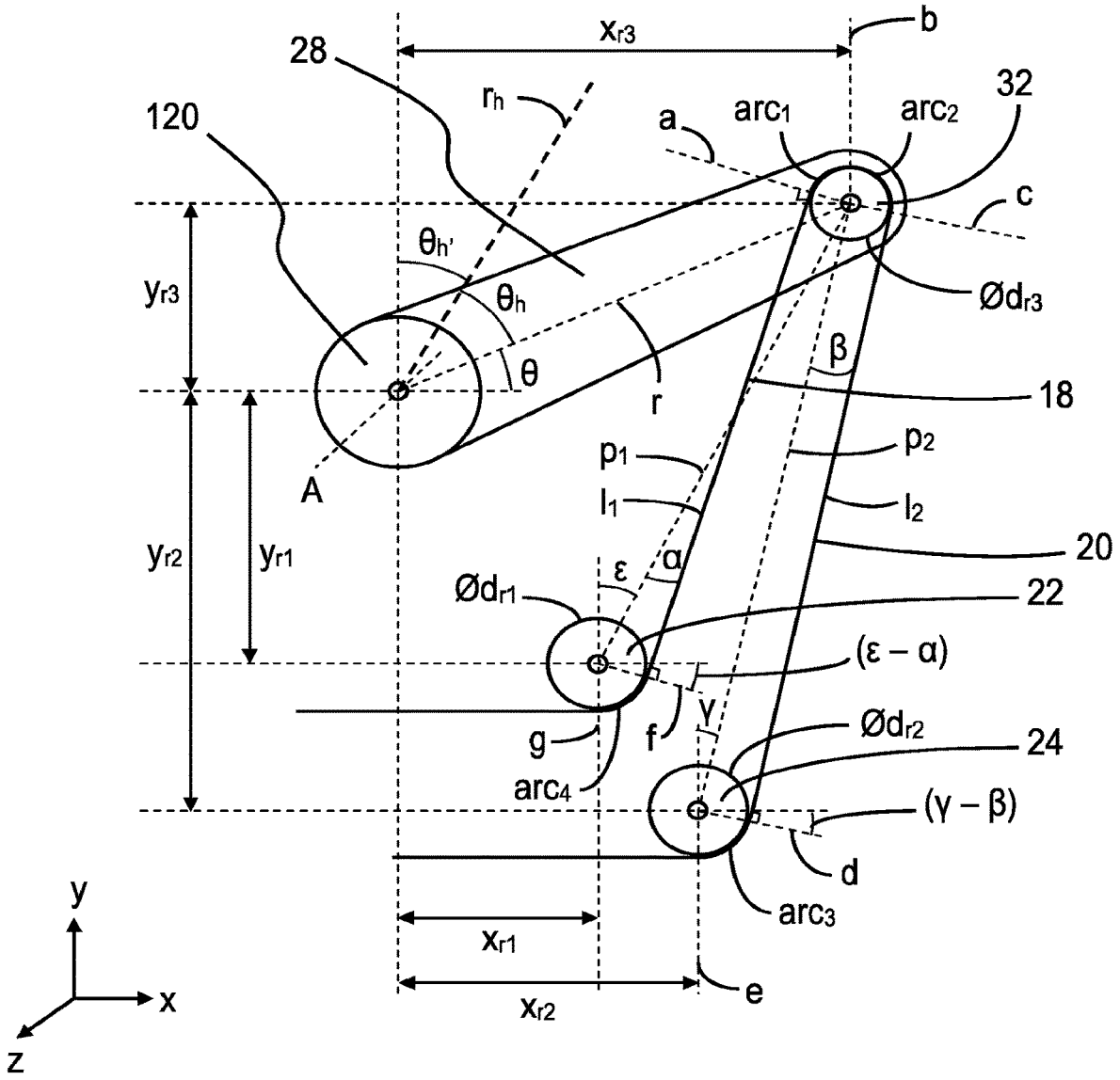
Figure 17:
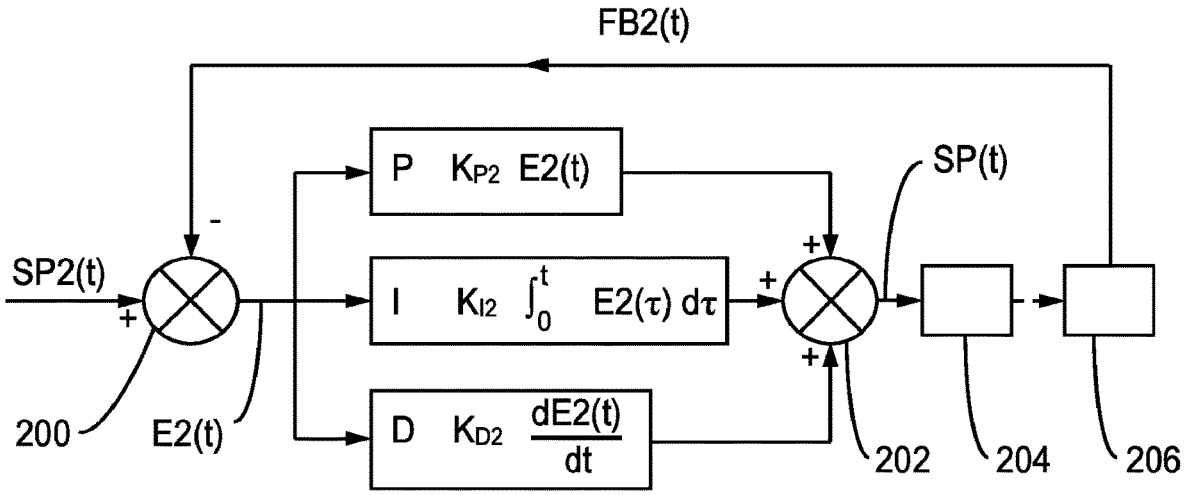
Figure 18:
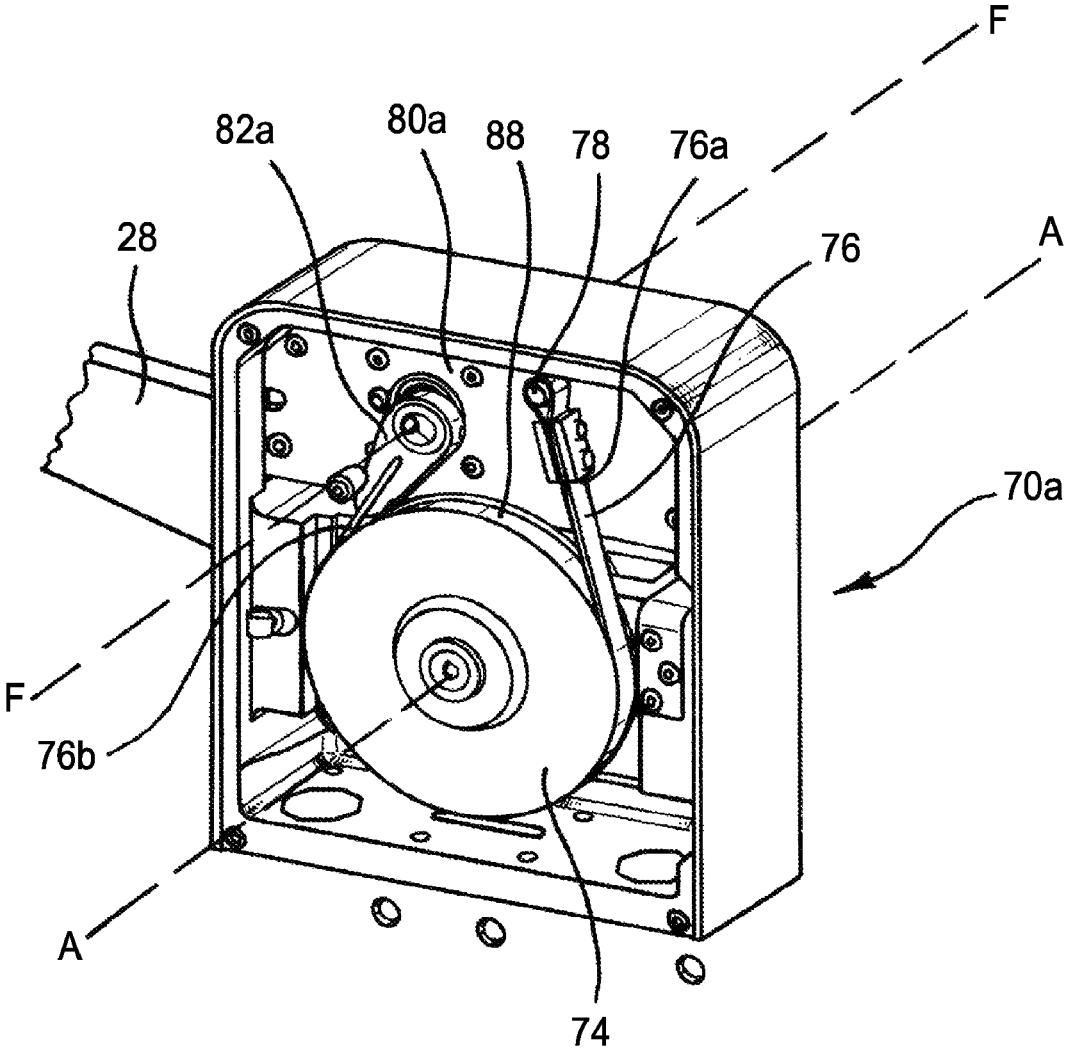
Figure 19:
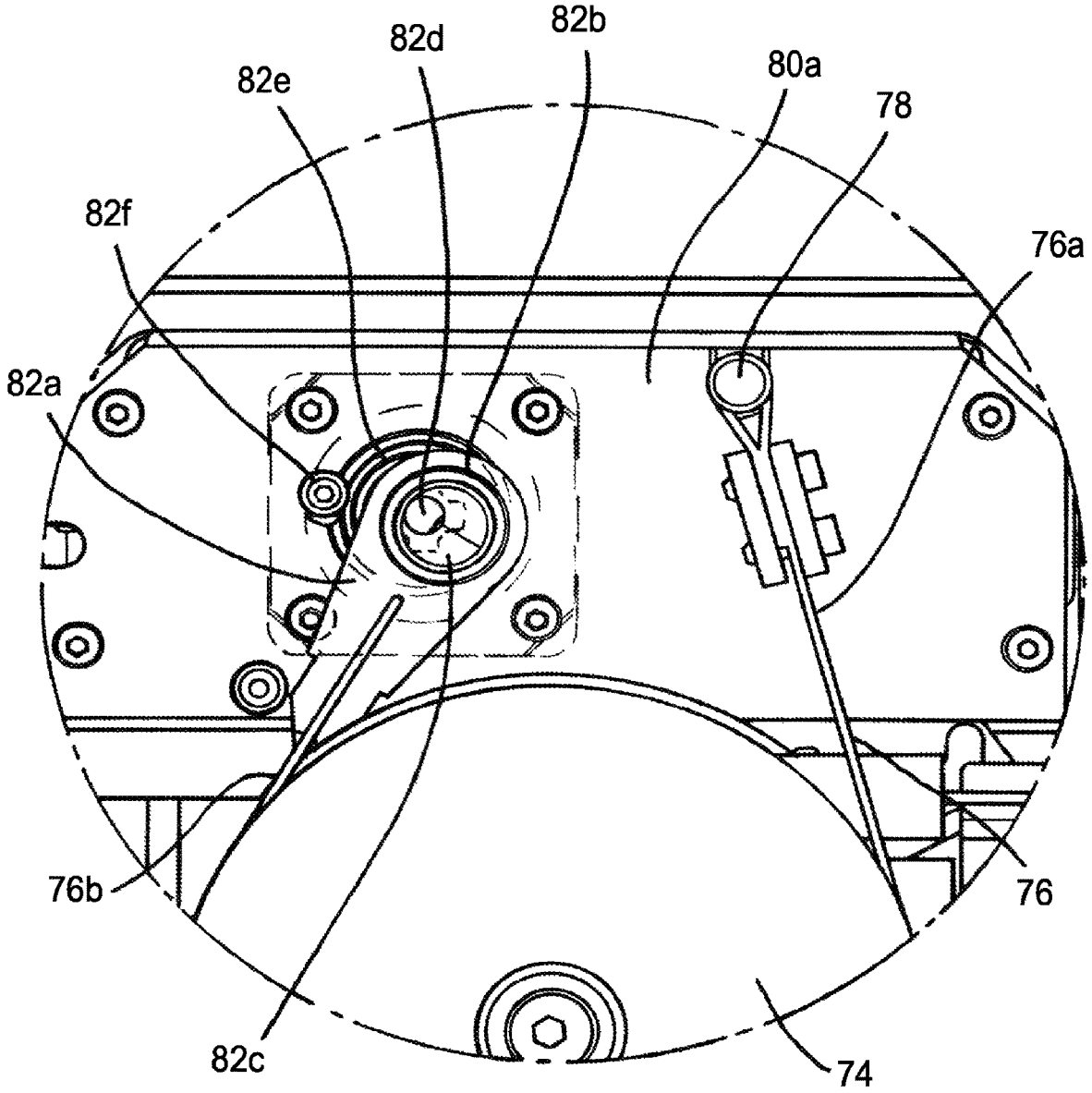
Figure 20:
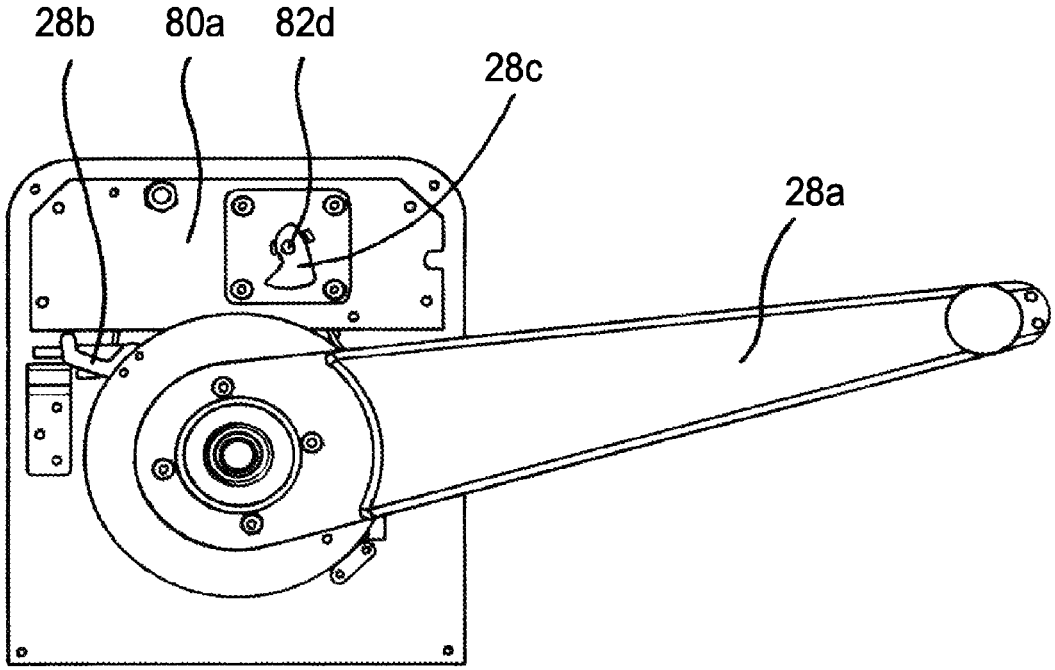
Figure 21:
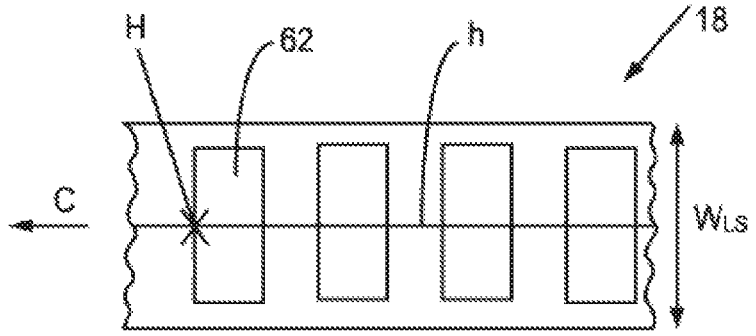
Figure 22:
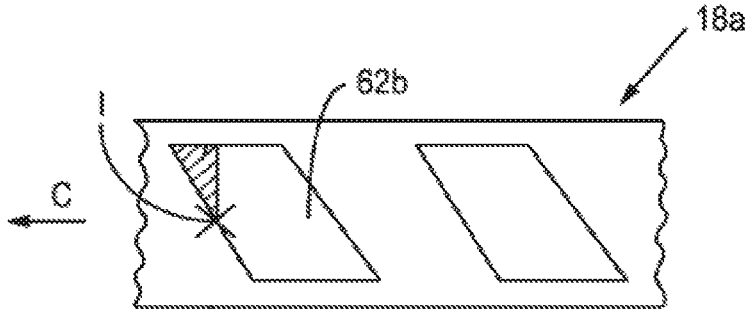
Figure 23:
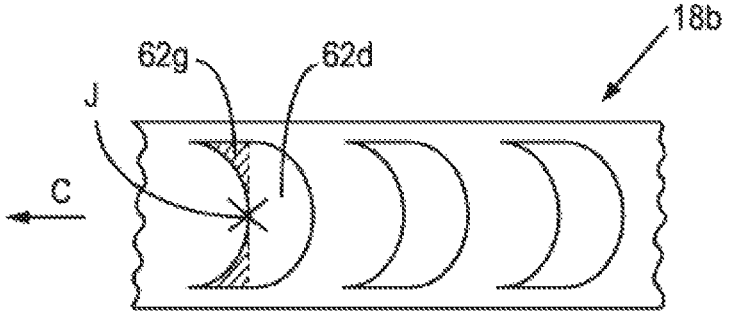
Figure 24:
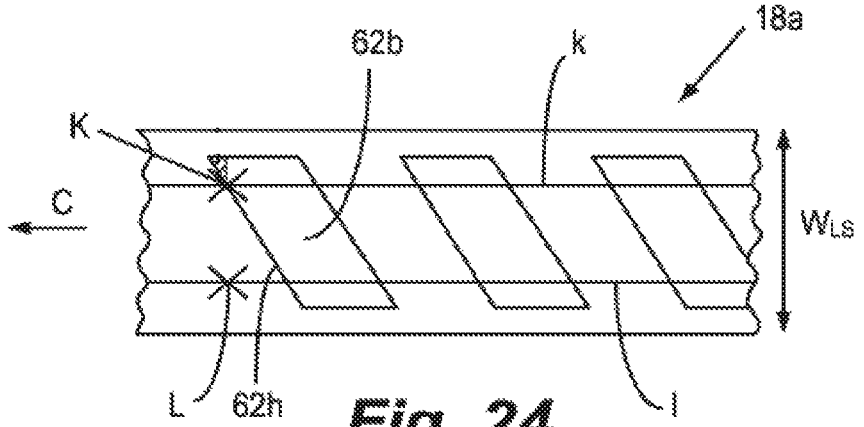
Figure 25:
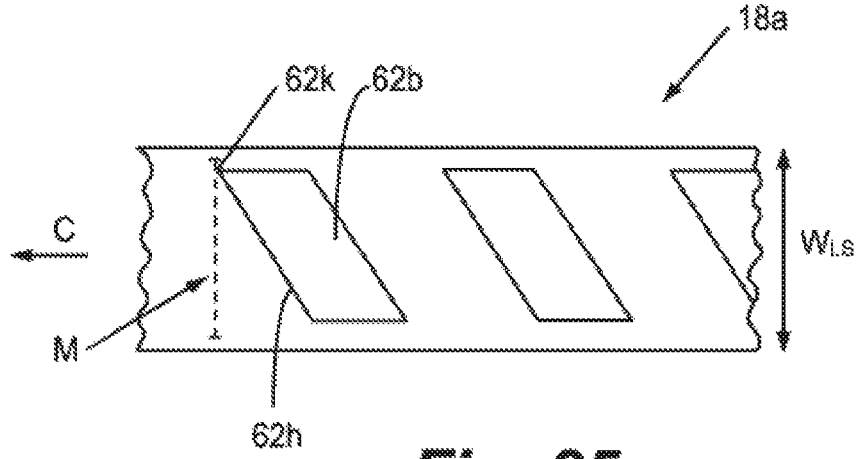
Figure 26:
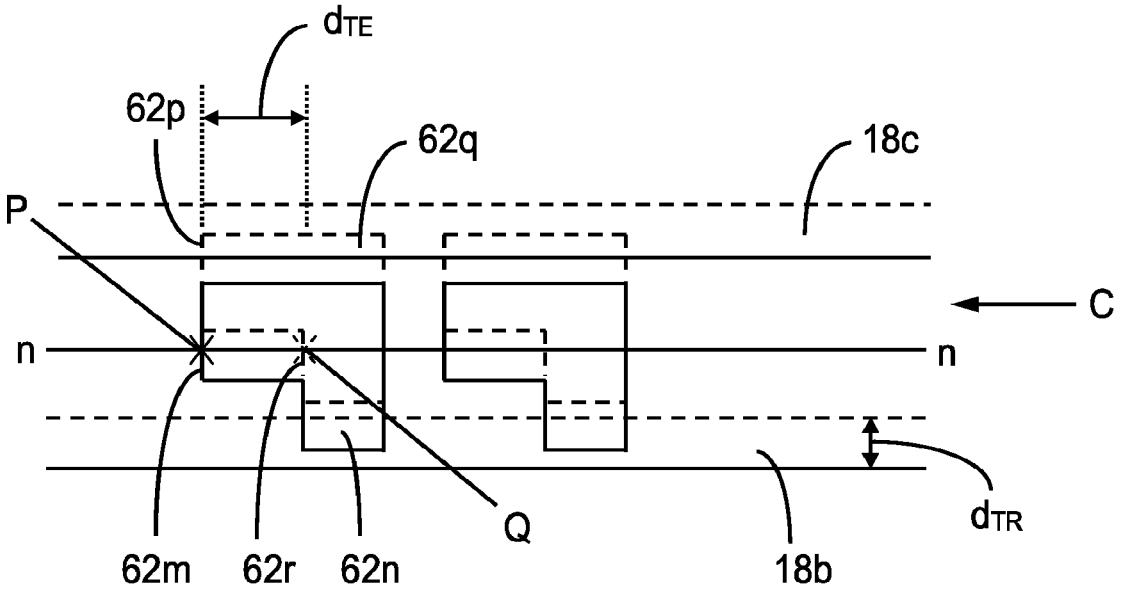
Figure 27:
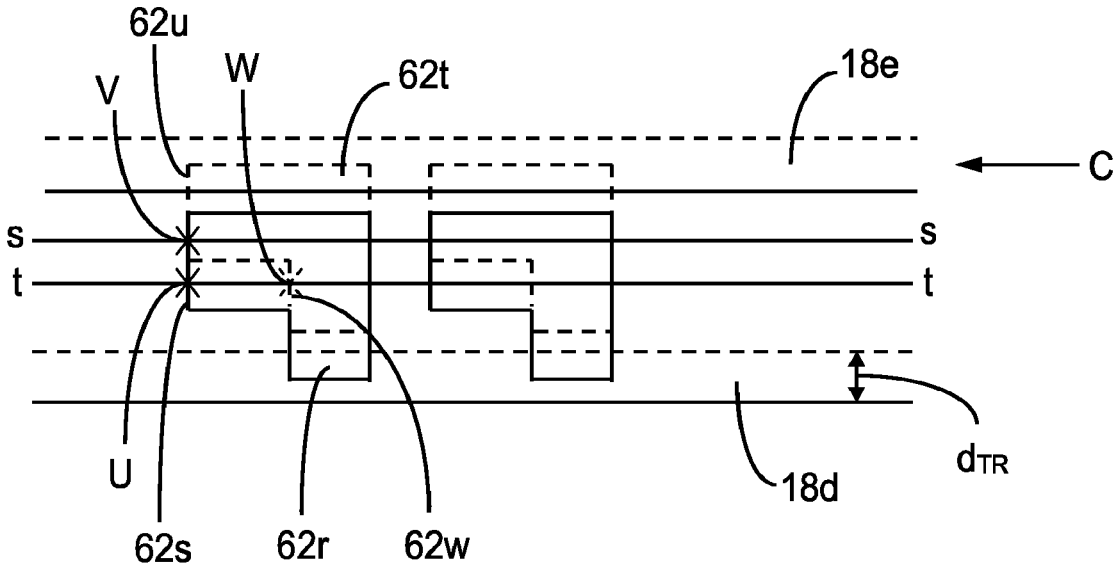
Figure 28:
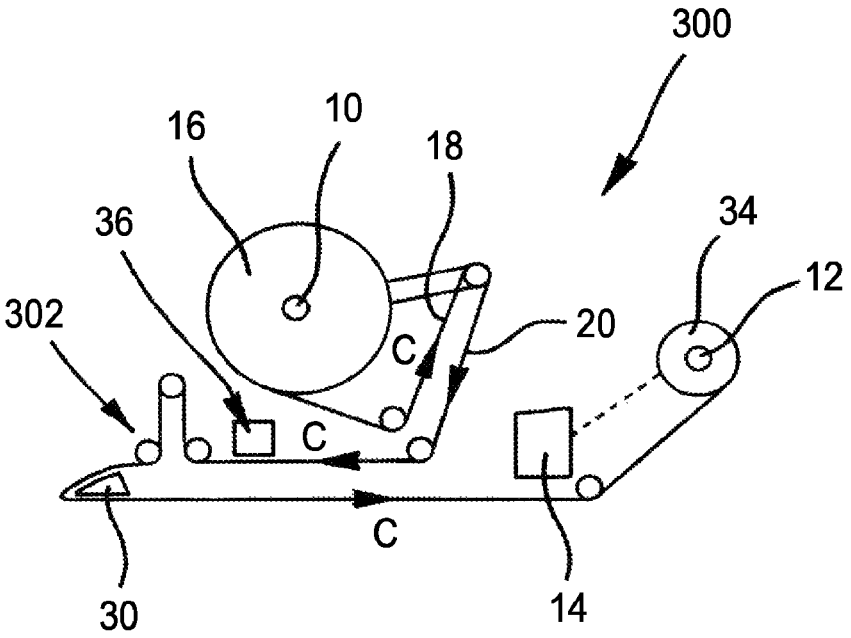
Figure 29:
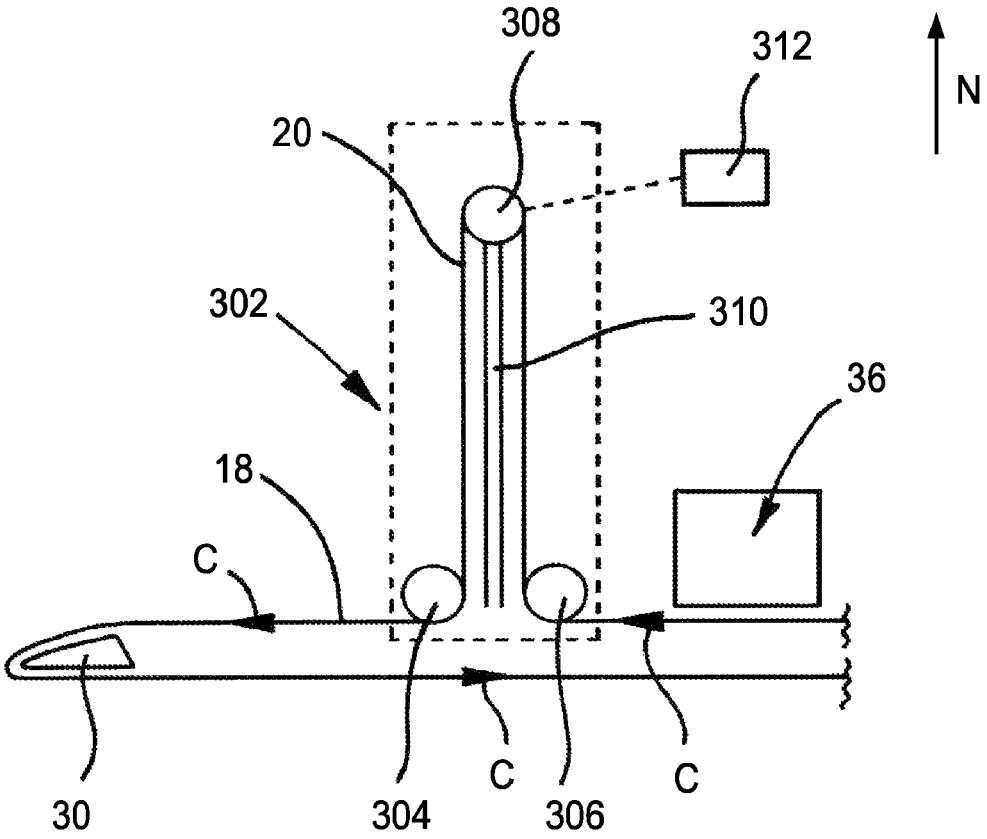
Figure 30:
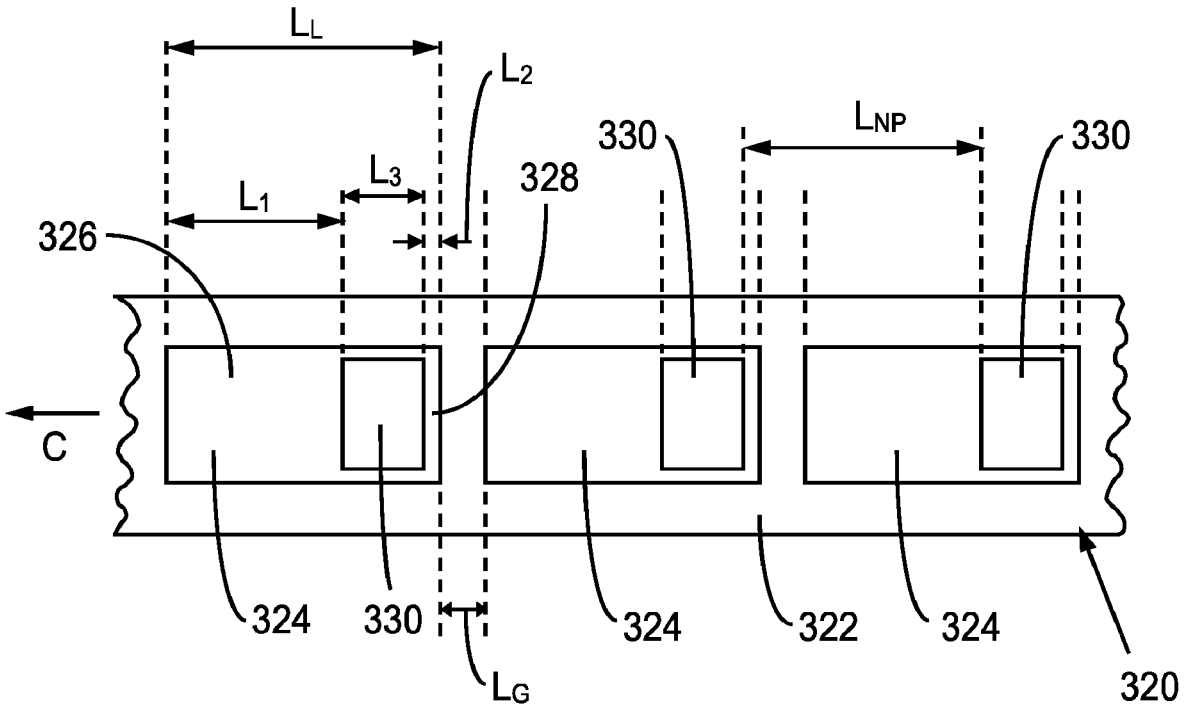
Figure 31:
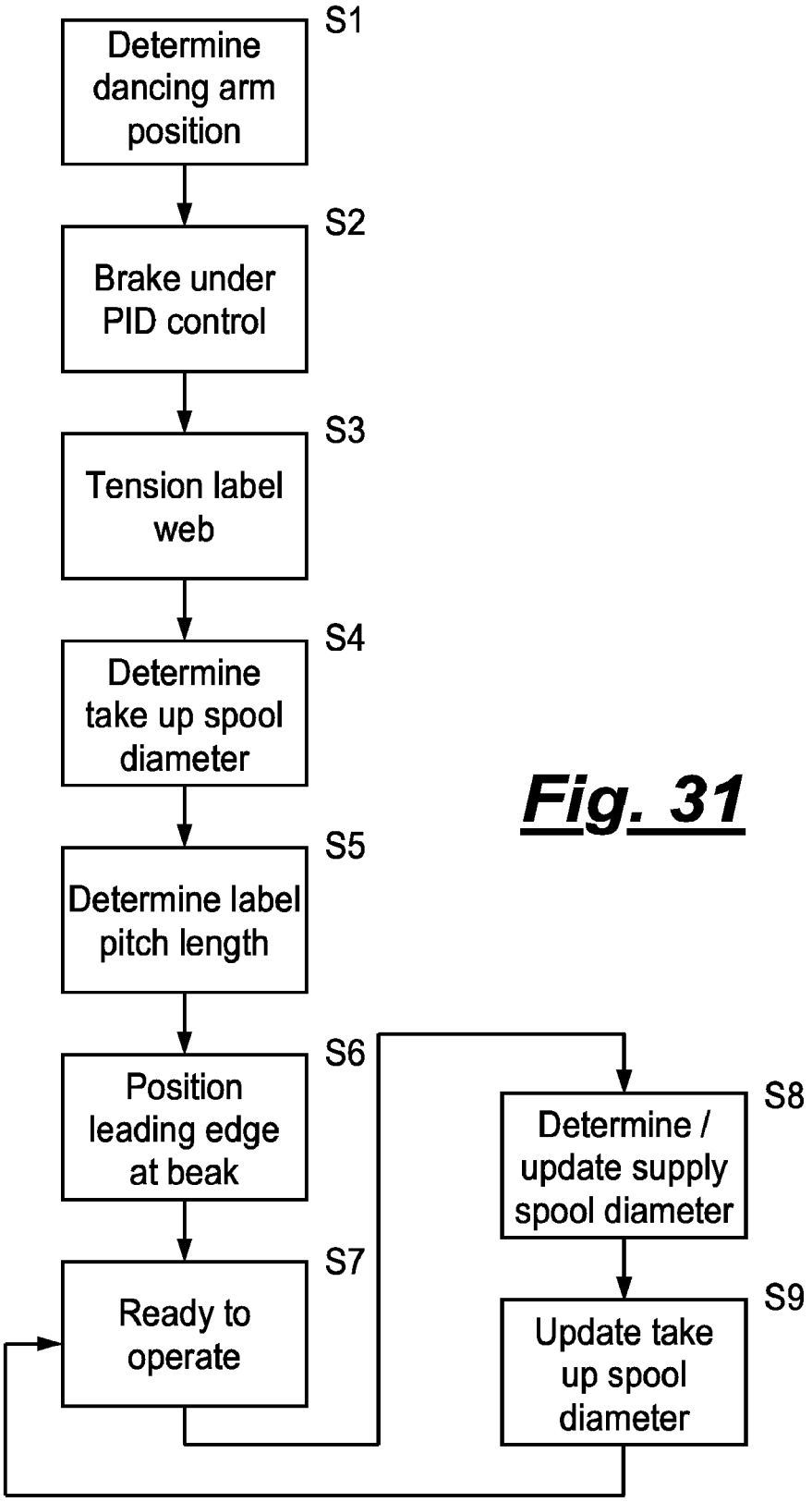
Figure 32:
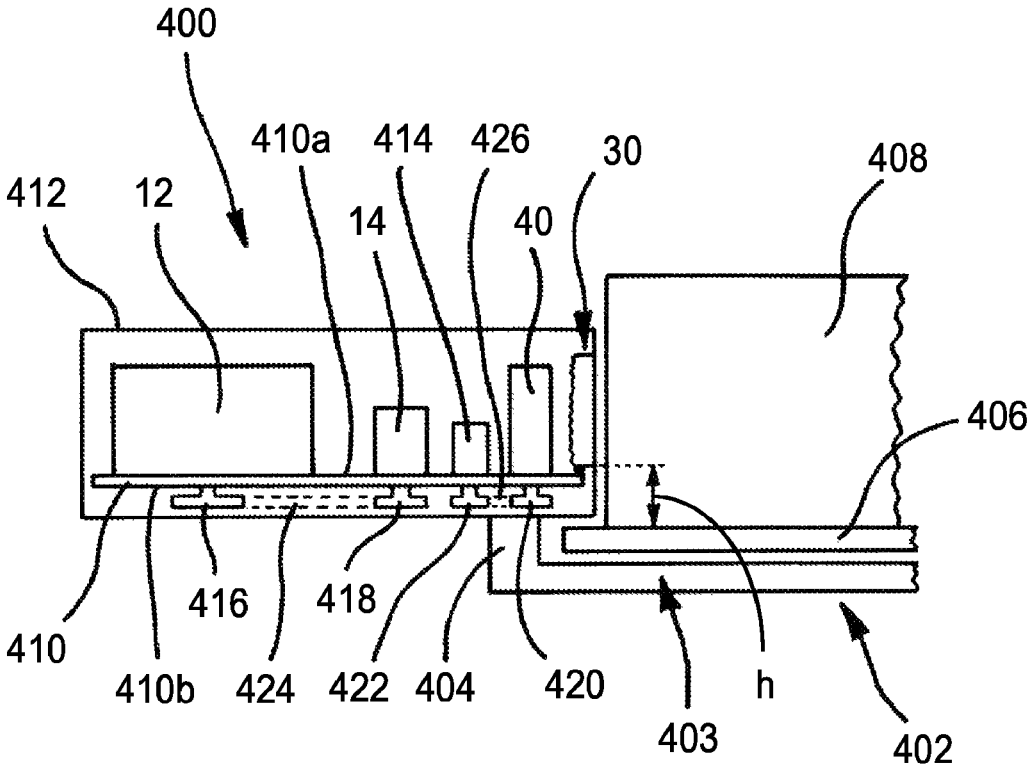
Figure 33:
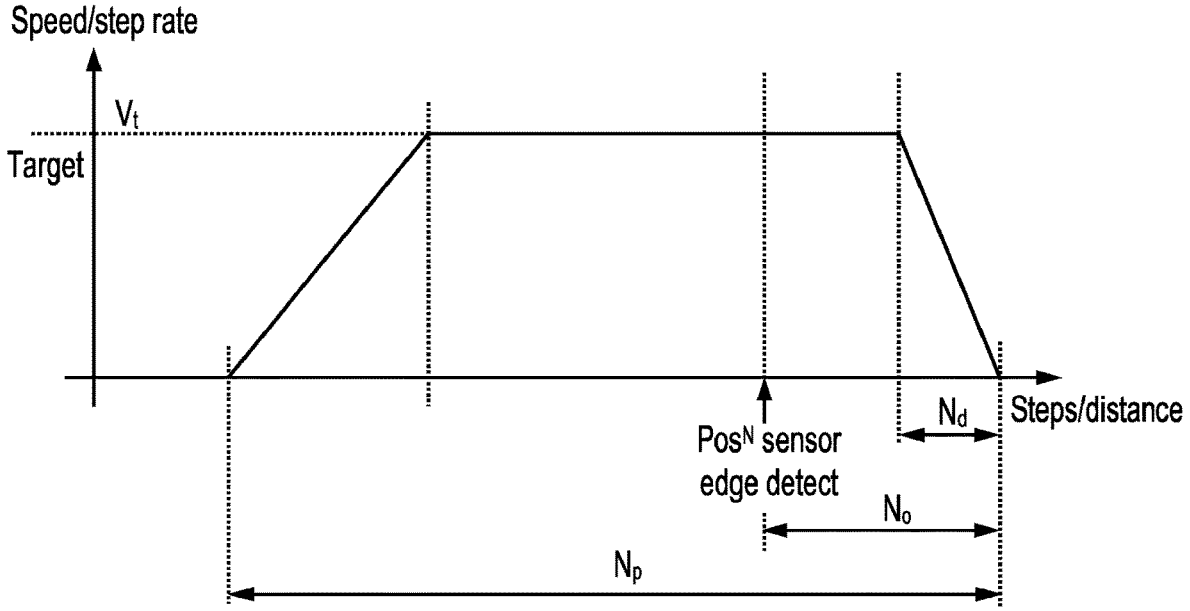

FIG. 4*a* shows a schematic graph of a sensor signal produced by a sensor which forms part of a labelling machine in accordance with an embodiment of the present invention, the sensor signal being produced when the portion of label stock shown in FIG. 4 is utilised in conjunction with the labelling machine;

FIG. 5 shows a schematic perspective view of a portion of the labelling machine shown in FIG. 2;

FIG. 6 shows a further schematic perspective view of a portion of the labelling machine shown in FIG. 2;

FIG. 7 shows a schematic side elevation of a portion of the labelling machine shown in FIG. 2;

FIG. 8 shows a further schematic perspective view of the portion of the labelling machine shown in FIG. 6, with a first mounting plate removed;

FIG. 9 shows a further schematic perspective view of a portion of the labelling machine shown in FIG. 2, with first and second mounting plates removed;

FIG. 10 shows a schematic end-on view of a portion of the labelling machine shown in FIG. 2, with the first mounting plate removed;

FIG. 11 shows a further schematic end-on view of a portion of the labelling machine shown in FIG. 2, with the second mounting plate removed;

FIG. 12 shows a schematic cross-sectional view of a portion of the labelling machine shown in FIG. 2;

FIG. 13 shows a further schematic perspective cross-sectional view of a portion of the labelling machine shown in FIG. 2;

FIG. 14 shows a schematic diagram illustrating a solenoid armature position control algorithm which is implemented by a controller which forms part of a labelling machine in accordance with an embodiment of the invention;

FIG. 15 shows a schematic view of a multipole strip magnet which forms part of a moving element position sensor which forms part of a labelling machine in accordance with an embodiment of the invention;

FIG. 16 shows a schematic view of a portion of the labelling machine shown in either of FIG. 1 or 2;

FIG. 17 shows a schematic diagram illustrating a moving element position control algorithm which is implemented by a controller which forms part of a labelling machine in accordance with an embodiment of the invention;

FIG. 18 shows a perspective view of a portion of an alternative braking assembly which in some embodiments of the present invention may take the place of the braking assembly shown in FIGS. 5 to 11;

FIG. 19 shows a further view of the alternative braking assembly shown in FIG. 18;

FIG. 20 shows a further view of a portion of a labelling machine according to an embodiment of the present invention including the alternative braking assembly shown in FIGS. 18 and 19 and further including a brake release mechanism;

FIGS. 21, 22 and 23 show schematic plan views of three separate label stocks which are utilised in conjunction with a known labelling machine;

FIGS. 24 and 25 show schematic plan views of a label stock which is utilised in conjunction with labelling machines in accordance with two separate embodiments of the invention;

FIG. 26 shows a schematic plan view of a label stock which is utilised in conjunction with a known labelling machine;

FIG. 27 shows a schematic plan view of the label stock shown in FIG. 26 utilised in conjunction with a labelling machine in accordance with an embodiment of the invention;

FIG. 28 shows a schematic side view of a labelling machine including a path length adjuster in accordance with an embodiment of the present invention;

FIG. 29 shows a further schematic side view of a portion of a labelling machine according to an embodiment of the present invention including the path length adjuster shown in FIG. 28;

FIG. 30 shows a schematic plan view of a label stock which is utilised in conjunction with a labelling machine in accordance with an embodiment of the invention;

FIG. 31 is a flow chart showing operation of a labelling machine in accordance with an embodiment of the invention, including various features described herein;

FIG. 32 is a simplified schematic cross-sectional view of a portion of a production line to which a labelling machine according to an embodiment of the present invention is mounted;

FIG. 33 is a speed/distance graph for a typical label feed operation; and

Figure 34:
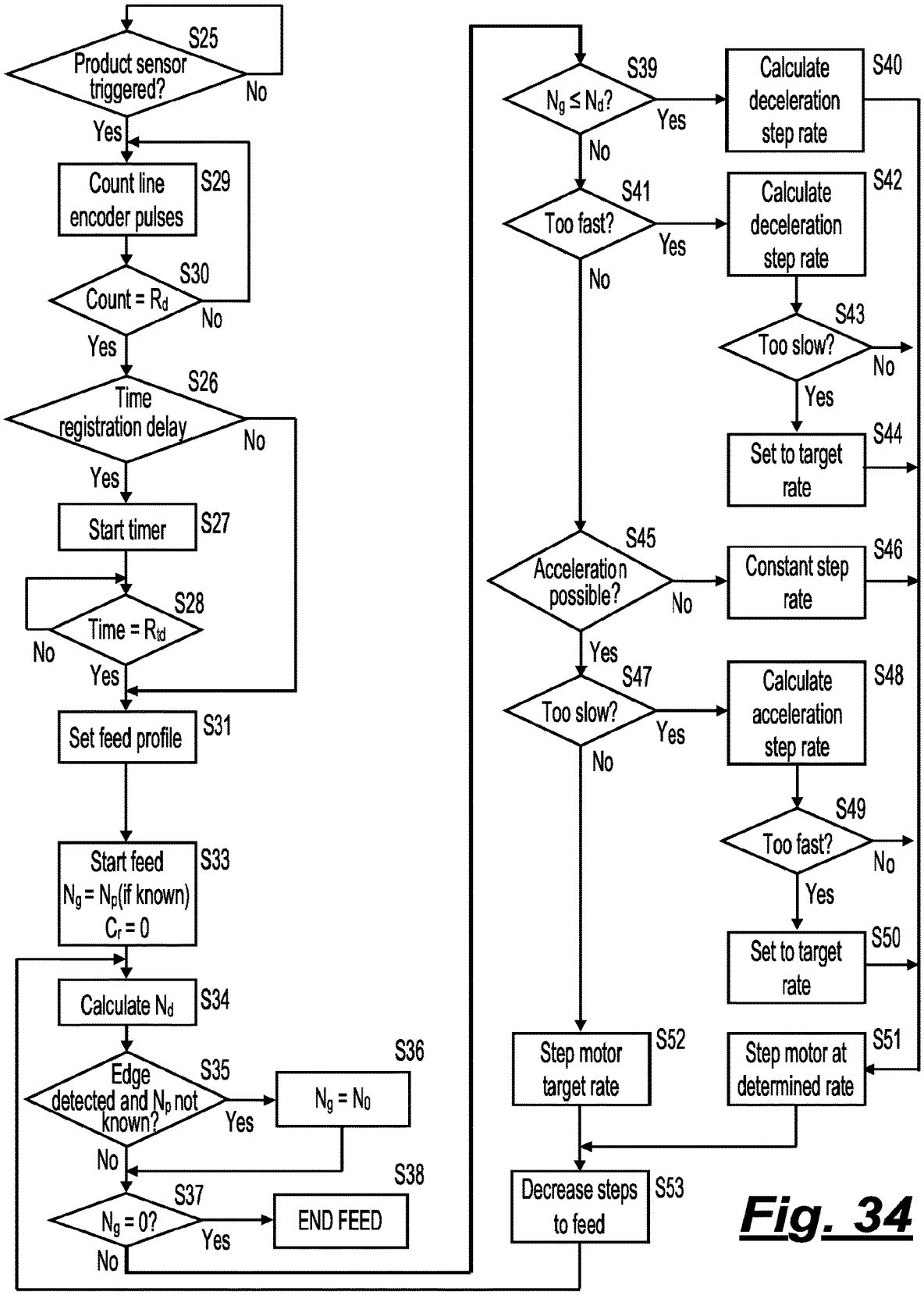
Figure 35:
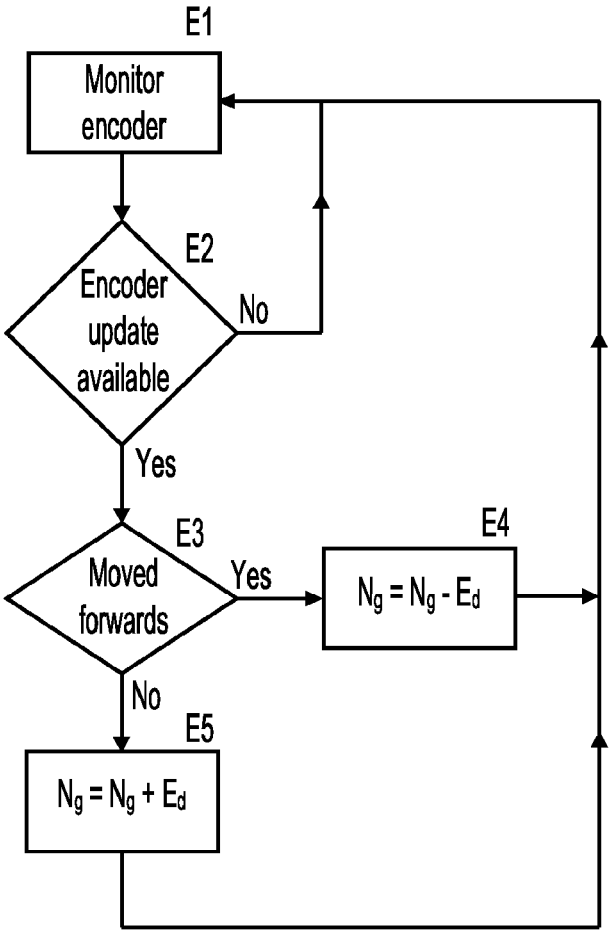

FIG. 34 is a flow chart of processing carried out during the label feed operation of FIG. 33; and FIG. 35 is a flow chart of processing carried out during an encoder increment/decrement routine which is implemented by some embodiments of the present invention whilst carrying out the processing shown in FIG. 34.

FIGS. 1 and 2 show schematic side views of portions of two different types of labelling machine in accordance with separate embodiments of the present invention. FIG. 1 shows a labelling machine with no integrated printer and FIG. 2 shows a labelling machine with an integrated printer.

The labelling machines shown in FIGS. 1 and 2 both include a supply spool support 10 and a take up spool support 12. The supply spool support 10 and take up spool support 12 are both mounted for rotation about respective axes A and B. In the labelling machines shown in FIGS. 1 and 2 the axes A and B are substantially parallel to one another; however, in some embodiments this may not be the case. The take up spool is connected to a motor 14 such that the motor 14 can be powered in order to rotate the take up spool 12 about the axis B. In the labelling machines shown in FIGS. 1 and 2, the motor 14 is connected to the take up spool support 12 via a belt (not shown).

However, it will be appreciated that in other embodiments any appropriate linkage may be used to connect the motor 14 to the take up spool support 12. For example, while in the described embodiment the belt will provide a fixed transmission ratio between rotation of the motor shaft and rotation of the take up spool support, in other embodiments a linkage providing a variable transmission ratio (such as a gearbox) may be provided. Indeed, in still alternative embodiments the take up spool support 12 may be directly driven by the motor 14. By directly driven it is meant that the spool support may be mounted co-axially with the shaft of the motor 14, that is the shaft of the motor 14 may extend along the axis B. In the case where the take up spool support 12 is directly driven by the motor 14, the take up spool support may be mounted to a motor spindle of the motor 14. This arrangement is quite different from other arrangements which may use capstan rollers to contact the outside circumference of a spool or a spool support in order to rotate the spool and/or spool support.

In the labelling machine shown in FIGS. 1 and 2 the motor 14 is a stepper motor. An example of a suitable stepper motor is a 34H318E50B stepper motor produced by Portescap, USA. An example of a suitable belt which connects the motor 14 to the take up spool support 12 is a synchroflex timing belt. In this embodiment the gearing ratio for the belt drive is 4:1 whereby the motor revolves four times for every revolution of the take up spool support. It will be appreciated that in other embodiments any appropriate gearing ratio for the belt drive may be used.

In this case the stepper motor is capable of being controlled such that it can execute 1600 substantially equal angular movements per complete rotation of the stepper motor. These substantially equal angular movements may be referred to as micro-steps. Each micro-step is equivalent to a rotation of about 0.225° or about 0.00392 radians. In this case, the stepper motor has 200 steps per revolution, but the stepper motor is controlled to produce 8 micro-steps per step, such that the number of micro-steps per revolution is 1600. Because the belt drive gearing ratio is 4 to 1, the number of micro steps of the motor per revolution of the take up spool support is 6400. Stepper motors are generally driven by a stepper motor driver. In the case of the motor and control arrangement described above, if the stepper motor driver is commanded to advance one step, the stepper motor driver will provide a signal to the stepper motor which causes the stepper motor to rotate by one micro-step (i.e. about) 0.225°. It will be appreciated that in other embodiments, the stepper motor may undertake any appropriate number of steps per complete rotation of the stepper motor, and the stepper motor may be controlled to produce any appropriate number of micro-steps per step of the stepper motor. Furthermore, the belt drive gearing ratio may be chosen such that the number of micro steps of the motor per revolution of the take up spool support is any appropriate desired number.

While the term 'step' is sometimes used to denote a physical property of a stepper motor, in the present description, the term 'step' is used to denote any desired angular movement of the stepper motor, for example a micro-step.

Stepper motors are an example of a class of motors referred to position-controlled motors. A position-controlled motor is a motor controlled by a demanded output rotary position. That is, the output position may be varied on demand, or the output rotational velocity may be varied by control of the speed at which the demanded output rotary position changes. A stepper motor is an open loop position-controlled motor. That is, a stepper motor is supplied with an input signal relating to a demanded rotation position or rotational velocity and the stepper motor is driven to achieve the demanded position or velocity.

Some position-controlled motors are provided with an encoder providing a feedback signal indicative of the actual position or velocity of the motor. The feedback signal may be used to generate an error signal by comparison with the demanded output rotary position (or velocity), the error signal being used to drive the motor to minimise the error. A stepper motor provided with an encoder in this manner may form part of a closed loop position-controlled motor.

An alternative form of closed loop position-controlled motor comprises a DC motor provided with an encoder. The output from the encoder provides a feedback signal from which an error signal can be generated when the feedback signal is compared to a demanded output rotary position (or velocity), the error signal being used to drive the motor to minimise the error. A DC motor which is not provided with an encoder is not a position-controlled motor.

It will be appreciated that in embodiments of the labelling machine other than those shown in FIGS. 1 and 2, the motor may take any convenient form. For example, the motor may be any appropriate open or closed loop position-controlled motor.

When the labelling machines shown in FIGS. 1 and 2 are in use, a supply spool of label stock may be mounted to the supply spool support such that the supply spool support 10 supports the supply spool. The label machine shown in FIG. 1 does not have a supply spool mounted to the supply spool support 10. However, the labelling machine shown in FIG. 2 does have a supply spool 16 mounted to the supply spool support 10. The supply spool 16 is mounted to the supply spool support 10 such that the supply spool 16 co-rotates with the supply spool support 10.

As can be seen best in FIG. 2, in use, label stock 18 extends between the supply spool support 10 (and in particular the supply spool 16 mounted to the supply spool support 10) and the take up spool support 12. A web path 20 is defined between the supply spool support 10 and take up spool support 12 by various components and, in use, the label stock is transported along the web path 20. In the labelling machines shown in FIGS. 1 and 2, first, second and third rollers (22, 24 and 26) define the web path 20 between the supply spool support 10 and take up spool support 12. It will be appreciated that in other embodiments of the labelling machine, components other than rollers may be used to define the web path 20. Suitable components may be those which impart only a small friction force to label stock when label stock contacts it.

The web path 20 is also defined by a dancing arm 28 and a labelling peel beak 30. The dancing arm 28 includes a dancing arm roller 32 mounted at one end of the dancing arm 28.

In use, the label stock 18 extends along the web path 20 from the supply spool support 10 (and in particular from the supply spool 16) around the first roller 22, around the dancing arm roller 32, around the second roller 24, around the labelling peel beak 30, around the third roller 26 and is wound onto the take up spool support 12 to form a take up spool 34.

It will be appreciated that in other embodiments of a labelling machine according to the invention any appropriate number of rollers (or any other appropriate components) may be used to define a desired shape/length of web path 20.

The dancing arm 28 is a movable element which is rotatable about axis A. That is to say, in the labelling machines shown in FIGS. 1 and 2, the axis of rotation of the dancing arm 38 is coaxial with the axis of rotation of the supply spool support 10 (and the supply spool 16). In other embodiments this need not be the case. For example, the dancing arm 28 may rotate about an axis which is spaced from the axis A of rotation of the supply spool support 10 (and supply spool 16 if attached).

It will also be appreciated that in the labelling machine shown in FIGS. 1 and 2, the dancing arm 28 is a movable element which defines the web path 20 and movement of the dancing arm 28 changes the length of the web path between the supply spool support 10 and take up spool support 12. It will be appreciated that in other labelling machines any other appropriate movable element may be used, providing that movement of the movable element changes the length of the web path between the supply spool support and take up spool support.

The labelling machine shown in FIG. 2 includes a printer 36 (however, as previously discussed, other embodiments of labelling machine according to the present invention need not include a printer). The printer in this case is a thermal transfer printer. However, it will be appreciated that other embodiments of labelling machine according to the present invention may include any appropriate type of printer, for example, an inkjet printer, a thermal printer or a laser marking system. The printer 36 includes a ribbon supply spool support 38, a ribbon take up spool support 40, a print head 42 and a ribbon guide member 44. In use, a spool of printer ribbon is mounted to the ribbon supply spool support 38, such that said spool of printer ribbon constitutes a supply spool 46 of printer ribbon which is supported by the ribbon supply spool support 38.

In use, print ribbon from the supply spool 46 passes along a print ribbon path past the print head 42 and is wound on to the ribbon take up spool support 40 so as to form a take up spool 48. In order for print ribbon to be transported from the ribbon supply spool support 38 to the ribbon take up spool support 40, at least the ribbon take up spool support 40 is connected to a motor such that the motor can rotate the ribbon take up spool support 40.

Because the printer 36 shown in FIG. 2 is a thermal transfer printer, the print ribbon is thermally sensitive such that, as the print ribbon passes the print head 42, at least a portion of the print head 42 can be selectively energised to heat a desired portion of the print ribbon and transfer ink from that portion of the print ribbon to an adjacent substrate. In this case the adjacent substrate is a label that forms part of the label stock 18. During operation of the printer 36, the guide block 44 comprises guide rollers which help to guide the print ribbon as it is transported from the ribbon supply spool support 38 to the ribbon take up spool support 40.

In some embodiments the printhead of the printer may be configured to press the ribbon and label web against a print roller (not shown) to effect printing. In some embodiments the print roller comprises an aluminium shaft of diameter 8 mm and is coated with a non-slip coating. In one embodiment, the non-slip coating is a silicon rubber coating having a Shore A hardness of 50-55 and a thickness of 2.75 mm Consequently, the print roller has a diameter of 13.5 mm. It is preferable that the print roller has as small a moment of inertia as possible, and it is for this reason that the shaft is made from aluminium. The primary purpose of the print roller is to provide a backing support against which the printhead presses the ribbon and label web so as to effect thermal transfer printing onto a label. As such, the print roller acts as platen roller. The provision of a non-slip coating has the effect of ensuring that there is substantially no slippage between the print roller and the label web. Consequently, the print roller rotates consistently as the label web moves along the web path. This means that the rotation of the print roller is an accurate indicator of label web movement. Rotation of the print roller may be used in processing carried out by a controller in order to determine an amount of movement of the label web along the web path in the manner described below.

In some embodiments the labelling machine may include an encoder which is configured to monitor rotation of the print roller. In one particular embodiment the encoder which measures the rotation of the print roller comprises a magnet (part number BMN-35H which is marketed by Bomatec, Höri, Switzerland) which is mounted to the end of the print roller such that it co-rotates with the print roller, and an encoder chip (part number AMS5040, marketed by ams R&D UK Ltd) which measures rotation of the magnet and hence print roller, and outputs a signal which is representative thereof. This output can be used by the controller to determine an amount of movement of the label web along the label web path.

In some embodiments the diameter of the print roller is known to the controller. Because the diameter of the print roller is known, and because the label web runs over the print roller as the label web passes through the printer, the amount of rotation of the print roller is proportional to the displacement of the label web along the label web path. Consequently, a sensor signal output by the encoder, which is indicative of the amount of rotation of the print roller, may be supplied to a controller such that the controller can determine the displacement of the label web along the label web path and, consequently, an amount of movement of the label web along the label web path.

Although the encoder in this embodiment measures a rotation of the printer roller in order to output a sensor signal which is indicative of an amount of movement of the label web along the label web path, in other embodiments this need not be the case. Any appropriate encoder which is capable of outputting a sensor signal which is indicative of an amount of movement of the label web along the label web path may be used. For example, an encoder which measures the rotation of a different roller which contacts the label web may be used.

In other embodiments a periodic property of the label stock may be used to determine an amount of movement of the label web along the label web path. In such embodiments, the encoder may measure a property of the label stock which is periodic in order to provide a sensor signal which is indicative of an amount of movement of a label web along the label web path. For example, the encoder may use a gap sensor. As previously discussed, as the label web advances along the label web path, the gap sensor will measure a periodic property of the label web (i.e. periodic electromagnetic transmission coefficient of the label web). If a pitch length of the labels (i.e. the distance between equivalent portions of adjacent labels) is known by the controller then the controller can use this information to calculate an amount of movement of the label web along the label web path based upon the periodic encoder signal.

The label stock which is used by either of the labelling machines shown in FIGS. 1 and 2 comprises a web and a plurality of labels attached to the web. The labels attached to the web are separable from the web. The labelling peel beak 30 is configured such that, during operation of either of the labelling machines shown in FIGS. 1 and 2, as the label stock 18 is transported along the web path 20 past the labelling peel beak 30, the labelling peel beak 30 separates a passing label from the web.

The separated label may then be attached to a desired article. An example of such a desired article is an item passing on a conveyor (not shown) of a production line. However, it will be appreciated that the desired article may be any appropriate article. In the case of the labelling machine shown in FIG. 2, it will be appreciated that, prior to the label being attached to a desired article, the printer 36 may print a desired image on the label. In some embodiments the printing may occur prior to the labelling peel beak 30 separating the label from the web of the label stock, and in other embodiments the printing of the image may occur after the labelling peel beak 30 separates the label from the web of the label stock.

During operation of the labelling machines shown in FIGS. 1 and 2 the motor 14 is energised to rotate the take up spool support 12 about its axis B. As this is done, the take up spool support 12 winds label stock 18 onto the take up spool support 12 to form a take up spool 34. The take up spool 34 will include the web of the label stock. Any labels separated from the web of the label stock as they pass the labelling peel beak 30 will not form part of the take up spool 34. In some embodiments the labelling peel beak 30 may be configured to selectively separate labels from the web. In this case, any labels which are not separated from the web of the label stock by the labelling peel beak 30 will be wound onto the take up spool support 12 and therefore form part of the take up spool 34.

The winding of the label stock 18 (and in particular the web of the label stock) onto the take up spool support 12 will cause the label stock 18 to move along the web path 20 in the direction indicated by arrows C (FIG. 2). The winding of the web of the label stock onto the take up spool support 12 causes label stock to be paid out from the supply spool 16 which is supported by the supply spool support 10.

This arrangement, whereby the take up spool support 12 is driven so as to transport the label stock in the direction C of label stock transport, and where the supply spool support 10 is not driven may be referred to as a pull-drag system. This is because, in use, as discussed below, the supply spool support 10 provides some resistance (or drag) to the movement of label web so as to provide tension in the label web. In this case friction within the system provides the drag. For example, the friction may include the friction between the supply spool support and the means which supports the supply spool support for rotation. Drag may also be provided by the inertia of the supply spool. In other embodiments the drag in a pull-drag system may be actively controlled. For example, in one embodiment a DC motor may be attached to the to the supply spool support and may be energised in a direction which is opposite to the direction in which the supply spool support rotates due to label stock being wound off the supply spool support and on to the take up spool support. In this case, the amount of drag that the DC motor provides to the system can be controlled by controlling the current supplied to the motor and therefore the torque applied by the motor.

In other embodiments of the labelling machine, the supply spool support 10 may be driven so that, in use, it rotates the supported supply spool 16. In some embodiments the supply spool support 10 may be driven for rotation in a direction which opposes movement of the label stock in the direction C of label stock transport (which is effected by the rotation of the take up spool support 12). This kind of arrangement is also referred to as a pull-drag system.

In other embodiments the supply spool support 10 may be driven such that it is rotated by a motor in a direction which is complementary to movement of the label stock in the direction C of label stock transport (which is effected by rotation of the take up spool support 12). This type of arrangement may be referred to as a push-pull system. It will be appreciated that in embodiments of the labelling machine which include a driven supply spool support 10, the supply spool support 10 may be driven by any appropriate motor. Examples of such motors include a DC motor or a position-controlled motor such as, for example, a stepper motor.

Figure 3:
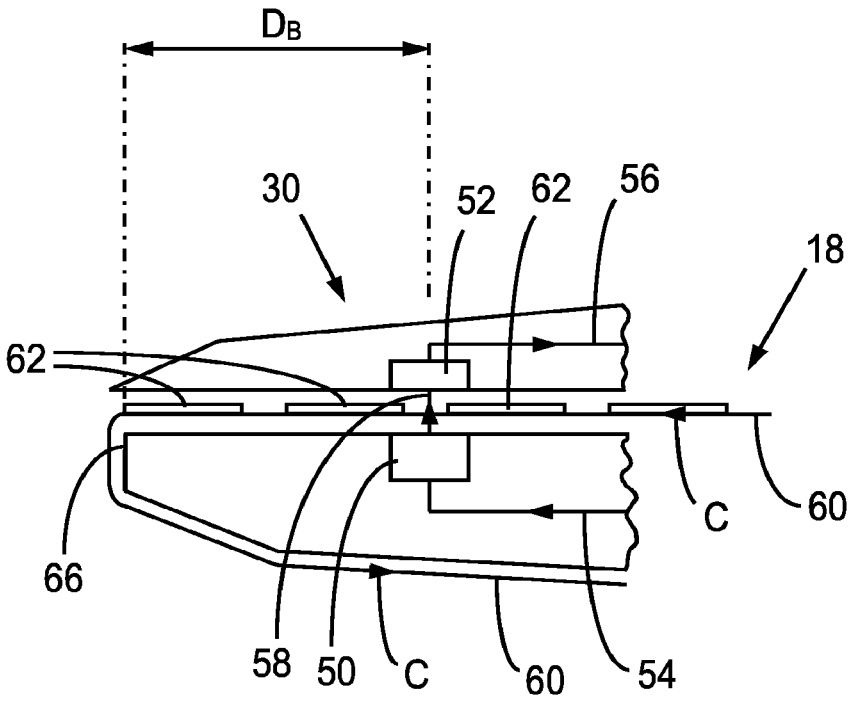
FIG. 3 shows a schematic cross section through a portion of a labelling peel beak which forms part of a labelling machine in accordance with an embodiment of the invention.

FIG. 3 shows a schematic cross-section through a labelling peel beak 30 which forms part of a labelling machine in accordance with an embodiment of the present invention. The labelling peel beak 30 includes a sensor comprising an electromagnetic radiation source 50 and an electromagnetic radiation detector 52. The electromagnetic radiation source 50 is powered by a power source via a power line 54. The sensor, and in particular the electromagnetic radiation detector 52, is configured to produce a sensor signal 56. The sensor may commonly be referred to as a gap sensor and is generally arranged to produce a sensor signal which differentiates between portions of the web which carry labels and portions of the web that do not. Although in this embodiment the labelling peel beak 30 includes the gap sensor, in other embodiments, the gap sensor may be located remote to the labelling peel beak at any appropriate position along the web path. In some embodiments it may be advantageous for the gap sensor to be located close to the labelling peel beak. Locating the gap sensor close to the labelling peel beak may reduce potential error in positioning a portion of the label stock at the labelling peel beak based upon a signal produced by the gap sensor.

In use, the electromagnetic radiation source 50 produces a beam 58 of electromagnetic radiation. Label stock 18 comprising a web 60 and a plurality of labels 62 attached to the web (and which are separable from the web) passes between the electromagnetic radiation source 50 and electromagnetic radiation detector 52 as the label stock 18 is transported in a direction C along a web path past the labelling peel beak 30. The beam 58 of electromagnetic radiation which is produced by the electromagnetic radiation source 50 passes through the label stock 18 and is incident on the electromagnetic radiation detector 52. The sensor signal 56 output by the electromagnetic radiation detector 52 is a function of an amount of electromagnetic radiation which is incident on the electromagnetic radiation detector 52. That is to say, the sensor signal 56 output by the electromagnetic radiation detector 52 is a function of the amount of electromagnetic radiation which is produced by the electromagnetic radiation source 50 and which passes through the label stock 18.

FIG. 4 shows a schematic plan view of a portion of label stock 18. The portion of label stock 18 shown in FIG. 4 has labels which are all substantially the same size and shape. Other label stock which may be used by the labelling machine may have labels which are of a different size and/or which may have different spacing therebetween. For example, some label stock which may be used by the labelling machine includes two types of label, each type having a different size and/or shape. The label stock may be such that along the length of the label stock the labels alternate between labels of a first type and labels of a second type. It can be seen from FIG. 3 that, when a portion of label stock 18 as shown in FIG. 4 passes between the electromagnetic radiation source 50 and electromagnetic radiation detector 52, the beam 58 of electromagnetic radiation will propagate in a direction which is substantially out the page in FIG. 4. The direction of propagation of the beam 58 of electromagnetic radiation may be substantially perpendicular to the plane of the substantially planar label stock 18.

The electromagnetic transmittance (i.e., what proportion of electromagnetic radiation incident on a material is transmitted through the material) of the web 60 of the label stock will commonly be different to the electromagnetic transmittance of the labels 52 of the label stock 18. Also the electromagnetic transmittance of two different thicknesses of a material will also be different (i.e., the electromagnetic transmittance through a relatively thick material will be less than the electromagnetic transmittance through a relatively thin material). Either of these two factors, or a combination of the two, will result in the electromagnetic transmittance of a portion of the label stock 18 which includes only the web 60 (for example at a position indicated by D, sometimes referred to in the art as a 'gap') will be different to (in this case greater than) the electromagnetic transmittance of a portion of the label stock 18 which includes both the web 60 and a label 62 (for example at a position indicated by E).

When the beam 58 of electromagnetic radiation produced by the electromagnetic radiation source 50 passes through a portion of the label stock with a relatively high electromagnetic transmittance (such as through the label stock 18 at position D within FIG. 4), then the amount of electromagnetic radiation which is incident on the electromagnetic radiation detector 52 will be greater than when compared to the amount of electromagnetic radiation incident on the electromagnetic radiation detector 52 when the beam 58 of electromagnetic radiation produced by the electromagnetic radiation source 50 passes through a portion of the label stock 18 which includes both the web 60 and a label 62 (for example at a position indicated by E in FIG. 4).

Consequently, the sensor signal 56 output by the electromagnetic radiation detector 52 will be different depending on whether the beam 58 of radiation produced by the electromagnetic radiation source 50 passes through a portion of the label stock 18 which has a relatively high transmittance (for example at the position D) or whether the beam 58 of electromagnetic radiation produced by the electromagnetic radiation source 50 passes through a portion of the label stock 18 which has a relatively low electromagnetic transmittance (for example at position E). For example, the sensor signal 56 produced by the electromagnetic radiation detector 52 of the sensor may be a voltage and the voltage may be greater when the beam of electromagnetic radiation 58 passes through a portion of the label stock 18 has relatively high electromagnetic transmittance compared to the voltage when the beam 58 of electromagnetic radiation passes through a portion of the label stock 18 with relatively low electromagnetic transmittance.

Because the label stock 18 will, in use, be transported along the web path in a transportation direction C, it will be appreciated that the beam 58 of radiation will alternate between passing through a portion of the label stock 18 which includes only the web 60 (e.g. as indicated at position D in FIG. 4), and a portion of the label stock 18 which includes the web 60 and a label 62 (e.g. as indicated at position E in FIG. 4). For ease of reference, a portion of label web 60 which has no label attached to it and which is between two adjacent labels 62 may be referred to as a gap. Two such gaps are indicated by shading 64 in FIG. 4.

The label stock 18 includes a plurality of labels 62 which have a label width $W_L$ which is substantially perpendicular to the transportation direction C, and a label length $L_L$ which is substantially parallel to the transportation direction C. The labels 62 are substantially similar as is the gap 64 between adjacent labels. The length of a gap is denoted $L_G$. The pitch length $L_P$ between adjacent labels is the sum of the label length $L_L$ and the gap length $L_G$ of the adjacent gap 64.

As the label stock 18 moves in the transportation direction C the electromagnetic radiation detector 52 of the sensor will produce a sensor signal 56 which is indicative of a periodic property of at least a portion of the label stock 18. In other words the sensor will produce a sensor signal 56 which is periodic given the nature of the label stock 18. In this case the electromagnetic transmittance of the label stock 18 can be said to be a periodic property of the label stock which varies along the length (in a direction generally parallel to the transportation direction C) of the label stock 18. That is to say, the sensor signal 56 will vary periodically as the beam 58 of electromagnetic radiation periodically passes through a gap 64, and then a label 62 affixed to the label web 60 in an alternating manner. The period of the periodic sensor signal 56 produced by the electromagnetic radiation detector 52 will be equal to the time taken for the label stock 18 to be transported in the transportation direction C by a distance equal to the pitch length $L_P$ (i.e., the sum of the label length $L_L$ and the gap length $L_G$.).

In general terms, where a leading label edge passes the electromagnetic radiation detector 52 the sensor signal 56 changes from having a relatively high value to a relatively low value. Similarly, where a trailing label edge passes the electromagnetic radiation detector 52 the sensor signal 56 changes from having a relatively low value to a relatively high value. The change in sensor signal 56 as the portion of label web shown in FIG. 4 passes the electromagnetic radiation detector is shown in FIG. 4*a* where the period of the signal p is marked. A transition from a gap to a leading edge of a label is represented by a signal transition from a relatively high value to a relatively low value. A transition from a trailing edge of a label to a gap is represented by a signal transition from a relatively low value to a relatively high value.

For some types of label stock the length of each label $L_L$ and the length of each gap $L_G$ will be substantially constant. Consequently, the pitch length $L_P$ for a given label stock 18 will also be substantially constant. The pitch length $L_P$, label length $L_L$ and/or gap length $L_G$ for a particular label length may be provided by the supplier of the label stock 18. Alternatively, the pitch length $L_P$, label length $L_L$ and/or gap length $L_G$ may be measured using any appropriate known way of measuring length. For example, an encoder may measure the rotation of a roller which contacts the label stock and this information may be used to determine displacement of the label stock along the label web path. By measuring the displacement of the label stock along the web path whilst the label stock passes the gap sensor, the gap sensor outputting the periodic sensor signal as discussed above, the pitch length $L_P$, label length $L_L$ and/or gap length $L_G$ can be measured.

Information relating to the pitch length $L_P$ of a particular label stock 18 may be provided to a controller of the labelling machine. Alternatively, information relating to the label length and the gap length of a particular label stock may be provided to the controller of the labelling machine such that the controller may use this information in order to calculate the pitch length of the label stock 18. In a further embodiment, the labelling machine may include a device which measures the pitch length $L_P$ (or the label length $L_L$ and gap length $L_G$ in order to calculate the pitch length $L_P$). It will be appreciated that any known measuring device may be used to measure such lengths.

In one embodiment the lengths $L_P$, $L_L$ and $L_G$ are measured as follows. The motive means which advances the label stock along the web path can be controlled by the controller such the controller can calculate the linear displacement of the label stock in any given time. Referring to FIG. 4*a*, it can be seen that the sensor signal 56 varies with position of the label stock depending on whether there is a label or a gap adjacent to the sensor. Consequently, in order to determine the length $L_L$ the controller can calculate the linear displacement of the label stock during the portion of the periodic signal 57 (which in this case has a relatively low value) measured by the sensor which is indicative of the presence of a label. Likewise, in order to determine the length $L_G$ the controller can calculate the linear displacement of the label stock during the portion of the periodic signal 59 (which in this case has a relatively high value)

measured by the sensor which is indicative of the presence of a gap. In order to determine $L_P$ the controller can either add the linear displacements measured for $L_L$ and $L_G$, or the controller can calculate the linear displacement of the label stock during a portion of the periodic signal p.

The controller can calculate the linear displacement of the label web in various ways. One example is that the controller may calculate the diameter of the spool supported by the take up spool support. An example of how the controller may calculate the diameter of the spool supported by the take up spool support is described at a later point within the description. The controller can then control a stepper motor which drives the take up spool support so that it monitors the number of steps the stepper motor is commanded to take in a given time. By multiplying the number of steps the stepper motor is commanded to take in a given time by the known angular movement of the stepper motor per step, the controller can calculate the angular movement of the stepper motor and hence the take up spool support in said given time. By multiplying the radius (half the diameter) of the spool supported by the take up spool support and the angular movement of the take up spool support in said given time, the controller can calculate the linear displacement of the label stock due to label stock being wound on to the take up spool support during said given time. Such displacement information can be used to determine $L_L$, $L_G$ and/or $L_P$.

The controller of the labelling machine is configured to calculate a displacement of the web along the web path based upon the sensor signal 56 and a length of a component of the label stock 18. In this case, the sensor signal is provided by the electromagnetic detector and the length of a component of the label stock is the pitch length $L_P$ (i.e., the sum of the label length $L_L$ and the gap length $L_G$). In use the controller monitors the sensor signal 56 and counts the number of periods of the periodic sensor signal which are provided to it. As previously discussed, this corresponds to the number of times the beam 58 of electromagnetic radiation passes through a label 62 and an adjacent gap 64. Consequently, the controller calculates the displacement of the web along the web path by multiplying the number of periods of the sensor signal provided to it by the pitch length $L_P$ of the label stock 18.

In some embodiments, the controller may also be configured to monitor the period of the periodic sensor signal 56. The controller may then calculate a speed of the web along the web path by dividing the pitch length $L_P$ (i.e., the sum of the label length $L_L$ and the gap length $L_G$) by the period of the sensor signal 56.

In some embodiments the controller may use a monitored period of the periodic sensor signal 56 in combination with a count of the number of periods of the sensor signal (which need not be an integer number) which have been supplied to the controller in order to determine the displacement of the web at times other than when an edge of a label 62 passes through the beam 58 of electromagnetic radiation. For example, if it is known that the time period since a label leading edge passed through the beam of electromagnetic radiation is half the monitored period, it can be deduced that the displacement is equal to half the pitch length $L_P$.

The displacement of the web along the web path calculated by the controller based on the sensor signal 56 may be used in several different contexts. For example, the displacement calculated by the controller may be used to provide information as to the total amount of label stock which has passed the sensor.

In another example, a desired displacement of the web may be effected to control the position of a given portion of label stock relative to a known position. For example, referring to FIG. 3, the edge 66 of the labelling peel beak 30 (at which the labels are separated from the web) and the point at which the beam 58 of electromagnetic radiation passes through the label stock are separated by a distance along the web path marked by $D_B$. The controller may be configured such that when an edge of a label 62 passes through the beam 58 of electromagnetic radiation, the controller then energises the take up motor such that the take up motor takes up a length of web which is equal to the distance $D_B$ to thereby position the edge which passed through the beam 58 of electromagnetic radiation at the edge 66 of the labelling peel beak 30.

It will be appreciated that the displacement of the web along the web path calculated by the controller based on the sensor signal 56 and the pitch length $L_P$ (i.e., the sum of the label length $L_L$ and the gap length $L_G$) may be used to both determine (i.e. in this particular context measure) and control the displacement of a portion of the label stock along the web path from any desired position and/or by any desired length.

It will be appreciated that in the described embodiment the sensor configured to produce a sensor signal 56 indicative of a periodic property of a portion of the label stock 18 is an electromagnetic radiation detector which produces a sensor signal indicative of the electromagnetic transmittance of the label stock. In other embodiments any appropriate sensor may be used in order to detect any appropriate periodic property of a portion of the label stock.

In the embodiment described, the electromagnetic radiation source may include a light emitting diode which emits electromagnetic radiation in the visible spectrum. The electromagnetic radiation detector is chosen such that it can detect electromagnetic radiation which is produced by the electromagnetic radiation source (in this case in the visible spectrum). It will also be appreciated that in other embodiments, any appropriate electromagnetic radiation source may be used, providing the electromagnetic radiation detector is sensitive to the electromagnetic radiation produced by the electromagnetic radiation source.

In other embodiments, the sensor may be configured to produce a sensor signal which is a function of a periodic property of a portion of the label stock other than its electromagnetic transmittance. Examples of such properties include, but are not limited to, the electromagnetic reflectivity of a portion of the label stock, the acoustic transmittance or reflectivity of a portion of the label stock, the electrical conductivity of a portion of the label stock, the thickness of at least a portion of the label stock, the capacitance of a region which includes a portion of the label stock and the colour of at least a portion of the label stock. It will be appreciated that, depending on the periodic property of the portion of the label stock which is to be measured by the sensor, any appropriate sensor must be used. Any known appropriate sensor may be used in this regard. For example, if it is desired to measure the acoustic transmittance of a portion of the label stock, the sensor may comprise an acoustic generator configured to direct acoustic energy through a portion of the label stock, and an acoustic detector upon which acoustic energy which passes through said portion of the label stock is incident. If it is desired to measure the capacitance of a region which includes a portion of the label stock, a capacitive sensor may be used. If it is desired to measure a thickness of a portion of the label stock, an example of a sensor which may be used in some applications is a microswitch. The microswitch may include a lever portion which contacts the label stock. The lever acts as a distance magnifier. The lever is configured to contact the label stock as the label stock passes the lever. An end of the lever which contacts the label stock moves a relatively small distance between its position when the end of the lever is contacting a label of the label stock and its position when the end of the lever contacts the web of the label stock between labels. The relatively small distance between these positions is magnified by the lever such that the other end of the lever to that which contacts the label stock moves a relatively large distance which is significant enough to cause a change in state between on and off states of the microswitch.

In the described embodiment, the portion of the label stock of which a periodic property is measured by the sensor comprises the web and the attached labels. In other embodiments, this need not be the case. For example, some embodiments may only measure a periodic property of the labels attached to the web. This may occur when the label stock includes labels which are attached to a web and which are adjacent to one another such that there is no gap between adjacent labels. In this case, the sensor may detect a periodic property of the labels attached to the web which varies periodically due to the fact that said property is different at the border between two adjacent labels compared to at another location on said label.

In another embodiment, the sensor may only measure a periodic property of the web. For example, a sensor may be configured to measure a property of the web after the labels have been detached from the web. For example, some label stock may have a web which, even once the labels have been removed, possesses some periodic feature. For example, if the labels are die-cut when the label stock is produced, then the web may include indentations resulting from said die-cutting which are present on the web even once labels have been removed. These indentations may have a property which is different to portions of the web which have not been indented. For example, the thickness of the web at the location of an indentation may be less than the thickness of the web at a position which has not been indented. Consequently, a sensor which is capable of measuring this difference in thickness of the web between indented portions and non-indented portions would be capable of producing a sensor signal indicative of a periodic property of a portion of the label stock such that the controller can calculate the displacement of the web and perform the functions set out above.

The displacement of the web along the web path calculated by the controller (based upon the sensor signal and the length of a portion of the label stock) may also be used to calculate the diameter of at least one of the take up spool or supply spool mounted on the take up spool support or supply spool support respectively. This may be done as follows.

The labelling machine may further include a rotation monitor configured to monitor the rotation of one of the spool supports (and thereby monitor the rotation of the spool attached to the spool support). An example of a suitable rotation monitor is a tachometer mounted to one of the spool supports. A further example of an appropriate rotation monitor is a trigger device which produces a signal every time the spool (and hence the spool support supporting the spool) rotates through a given portion of a complete rotation.

For example, a trigger device may include a reed sensor and at least one magnet, or a Hall effect sensor and at least one magnet. In one embodiment, a pair of magnets are attached to a spool support such that they are angularly spaced about the axis of rotation of the spool support by 180 degrees. The reed sensor is located at a portion of the labelling machine which does not rotate with the spool support and such that for every full rotation of the spool support in a given direction, both of the two magnets pass the reed switch and activate the reed switch in succession. Consequently, the reed switch will be energised twice per rotation of the spool support.

As described above, a rotation monitor (e.g., tachometer or reed switch) is configured to output a rotation signal indicative of a rotation of one of the spool supports. The rotation signal is supplied to the controller and the controller is configured to calculate the diameter of the spool supported by the spool support based upon the calculated displacement of the web along the web path and the rotation signal. In particular, the controller may calculate the displacement of the web along the web path for a given time and for the same given time monitor the rotation signal so as to determine the amount of rotation of the spool support (and hence spool) during said given time. The controller may calculate the diameter of the spool $D_S$ supported by the spool support as follows:

$$D_S = \frac{L_{WP}}{n\pi} \tag{1}$$

where $L_{WP}$ is the displacement of the web along the web path (determined, for example, by monitoring of the periodic signal 56 output from the electromagnetic radiation sensor 52) and n is the number of rotations of the spool support.

In one embodiment including a rotation monitor comprising a reed switch and two magnets as described above, the controller may calculate the diameter of the spool supported by the spool support according to the above formula in the following manner. When a magnet attached to the spool support passes the reed switch the controller is triggered to start counting the number of steps that the motor driving the other spool support is commanded to undertake. The controller also monitors the signal supplied to the controller by the reed switch and counts the number of times a magnet has passed the reed switch after the controller was triggered to start counting the number of steps that the motor driving the other spool support is commanded to undertake.

When the controller counts that the number of times a magnet has passed the reed switch is equal to a predetermined number then the count of the number of steps that the motor driving the other spool support is commanded to undertake is stopped. The predetermined number may be any number corresponding to any desired rotation amount of the spool support. In this example the predetermined number is two, which corresponds to a single rotation of the spool support. The counted number of steps that the motor driving the other spool support is commanded to undertake is used to determine the displacement of the web along the web path by multiplying the counted number of steps by the angular rotation per step, and by the radius of the spool supported by the other spool support. The radius of the spool supported by the other spool support may have previously been determined either by measuring the change in web path length between the spool supports for a given rotation of the other spool support, or by measuring the amount of rotation of the other spool support for a given displacement of the web along the web path (for example, for the displacement of the web along the web path by the pitch length of the label stock). Both of these methods are discussed within this description. Any other appropriate method may be used for determining the radius of the spool supported by the other spool support.

It will be appreciated that this method of calculating spool diameter may be used to determine the diameter of either or both of the spools.

It will also be appreciated that although various sensors have been described as part of a rotation monitor which is configured to monitor rotation of the spool, any appropriate method may be used in order to determine the amount of rotation of the spool. For example, the rotation monitor may, if utilized to measure the amount of rotation of a spool which is driven by a position-controlled motor (such as a stepper motor), include a monitoring device which monitors the control signal provided to the position-controlled motor in order to monitor the amount of rotation the position-controlled motor has been commanded to undertake and use this as a measure of the amount of rotation that the motor and hence spool support has undertaken. For example, in the case of a stepper motor, the rotation monitor may include a counting device which counts the number of steps that the stepper motor has been commanded to advance. Where a rotation of the stepper motor comprises a predefined number of steps (as is usual) it is a straightforward matter to determine a number of rotations (or parts of rotations) which correspond to a particular number of steps through which the motor has moved.

Known labeling machines may provide an operator with information as to the number of labels remaining on the label stock before all of the labels have been used up.

Providing the operator of the labeling machine with an indication as to the number of labels remaining on the label stock before there are no remaining labels on the label stock has been found to be not particularly helpful. This is because the operator of the labeling machine has no useful indication as to when the label stock will require replacement, but only how many labels will be dispensed from the label stock before the label stock requires replacement.

A labeling machine according to the present invention may include a controller which is configured to calculate a time indicative of when the label stock (or more specifically the supply spool of label stock) will require replacement in order for the labeling machine to be able to carry out further labeling operations. That is to say, the controller is configured to calculate a time indicative of when the supply spool is empty (i.e., the labeling machine has used all of the available labels on the label stock).

In order to calculate a time indicative of when the supply spool requires replacement, the controller is provided with a signal which enables it to determine the amount of label stock on the supply spool and also with a signal which enables the controller to determine the rate at which label stock is being paid out from the supply spool.

One example of a signal which may be provided to the controller in order for it to determine how much label stock there is in the supply spool is to provide the controller with a signal indicative of the diameter of the supply spool. Any appropriate method may be used in order to provide the signal indicative of the diameter of the supply spool. For example, the method of determining the diameter of a spool discussed previously within this description may be used. Alternatively, optical measuring apparatus may be used to measure the diameter of the spool. Such an optical measuring apparatus is described in the international patent application published under the Patent Cooperation Treaty (PCT) with the publication number WO 02/22371 A2. Although the measuring apparatus described therein is for measurement of spools of inked ribbon used in a thermal transfer printer, the inventors have realised that such an apparatus can also be used to determine spool diameter in a labelling machine where the spools carry label stock.

Furthermore, a lever which contacts the outside of the spool and which is connected to a position sensor which has an output that is dependent upon the rotational position of the lever may also be used to determine the diameter of the supply spool.

In an alternative embodiment, the signal indicative of the amount of label stock on the supply spool may be a count of the number of labels which have passed a particular point in the web path. If the initial number of labels on the supply spool is known, then by counting the number of labels which have passed a particular point in the web path will enable the remaining number of labels on the supply spool to be calculated.

While various examples of ways of determining a remaining quantity of labels have been set out above, it will be appreciated that any appropriate method may be used for determining the amount of label stock remaining on the supply spool at any given time.

One example of how to determine the rate at which label stock is being paid out from the supply spool is to provide a signal to the controller which is indicative of the linear speed of a portion of the label stock along the web path. In one example the controller may calculate the time at which the supply spool requires replacement by using a signal indicative of the diameter of the supply spool in order to work out the length of label stock remaining on the supply spool and then dividing the length of label stock in the supply spool by the linear speed of the label stock along the web path. Again, it will be appreciated that any appropriate method may be used for determining the rate at which label stock is being paid out from the supply spool. In some embodiments the rate at which label stock is being paid out is determined by monitoring the period of the periodic signal 56 output from the electromagnetic radiation detector 52 as described above.

In any case, the controller will perform a calculation whereby the amount of label stock remaining on the supply spool is divided by the rate at which label stock is paid out by the supply spool in order to determine the time it will take for the supply spool to be used up.

Another example of how determination of a time at which further label stock will be required may be carried out is by using a sensor to count the number of labels that have passed a particular point in the web path and also use the sensor to measure the rate at which the labels are passing a particular point in the web path (which can be determined using a sensor of the type described above by monitoring the period of the periodic signal 56 output by the electromagnetic radiation detector 52). Then, given knowledge of the initial number of labels on the supply spool, the remaining labels on the supply spool can be determined by the controller. The remaining number of labels on the supply spool can then be divided by the rate at which labels are passing the particular point in the web path (and hence the rate at which labels are being paid out by the supply spool) in order to calculate a time indicative of when the supply spool will be used up (and hence require replacement).

It will be appreciated that other methods of measuring the remaining label stock on the supply spool and the rate of label stock being paid out from the supply spool may be used. For example, if the label pitch of the label stock is either known or determined, the displacement of the label stock along the web path may be used (given knowledge of the initial number of labels on the label stock) to determine the number of labels remaining on the supply spool. This may be done by calculating the number of labels that have been used and subtracting this from the initial number of labels. In order to calculate the number of labels used, a measured linear displacement of the label stock along the web path may be divided by the pitch length of the label stock. Measuring the linear speed of a portion of the label stock along the web path may also be used in order to determine the rate at which labels are paid out from the supply spool. This can be done by dividing the linear speed of a portion of the label stock along the web path by the pitch length of the label stock.

Another way to calculate the remaining number of labels is to measure the number of labels per unit cross-sectional area of label stock on the supply spool. In this case the cross-sectional area is measured perpendicular to the axis about which the supply spool rotates. Then, at any point in time, given the diameter of the supply spool—which may be measured using methods described previously—and also the diameter of the core holding the label stock on the supply (which may be measured or previously determined), cross-sectional area of label stock remaining on the supply spool may be calculated. This is done by subtracting the cross-sectional area of the core from the total cross-sectional area of the supply spool (i.e. including the core) which is determined using the outer diameter of the supply spool measured in the manner discussed above. By multiplying the cross-sectional area of the supply spool by the number of labels per unit cross-sectional area of label stock on the supply spool, the number of labels remaining can be calculated.

The number of labels per unit area may be calculated as follows. A first measurement of the spool diameter is made using any of the methods discussed above. A corresponding first cross-sectional area of the spool is calculated. Subsequently, after a known or measured number of labels have been dispensed, a second measurement of the spool diameter is made, and a corresponding second cross-sectional area of the spool is calculated. The number of labels per unit area may be calculated by dividing the known or measured number of dispensed labels by the difference between the first and second cross-sectional areas of the spool.

As previously discussed, information about the number of labels remaining on the supply spool and information about the rate at which labels are being utilised (e.g. dispensed) may be used to calculate a measure of the time it will take for the supply spool to be used up (i.e. a time remaining before the supply spool requires replacement).

In some embodiments of the invention, once the controller has calculated a time remaining before the supply spool requires replacement, the controller may be configured to use this information in combination with the time of the day in order to calculate the time of the day and/or date at which the supply spool will require replacement. For example, the controller may calculate that the supply spool will require replacement at 4.45 pm or at 9.15 am on $19^{th}$ February. The controller may provide a signal indicative of the time of day and/or date at which the supply spool will require replacement to a suitable display. Calculating the time of the day and/or date at which the supply spool will require replacement may be useful because it will enable an operator of the labelling machine to determine at what time of the day he or she will need to be present in order to replace the label stock supply spool. Alternatively, or in addition, if the labelling machine is operated by operators which are employed in a shift pattern, the information provided by the labelling machine may enable the operator of the labelling machine to see on which operator shift the supply spool will require replacement.

FIG. 5 shows a perspective view of a portion of an embodiment of a labelling machine of the type shown in FIG. 1 or FIG. 2. FIG. 5 shows the supply spool support 10, the dancing arm 28 and a brake assembly 70. The supply spool support 10 includes a support disc 72 and a supply spool 16 of label stock supported by the supply spool support 10.

As previously discussed in relation to FIGS. 1 and 2, the labelling machine of which the supply spool 16 forms part also includes a take up spool support adapted to take up a portion of the web of the label stock. A web path is defined between the supply spool and the take up spool. The dancing arm 28 is a moveable element which, in use, defines a portion of the web path. In fact, in use, the label stock passes from the supply spool 16 and runs over the roller 32 which is mounted on the dancing arm 28. In FIG. 5, neither the take up spool, nor the web of the label stock running along the web path, are shown so as to aid clarity of the figure.

As previously discussed, the dancing arm 28 and supply spool support 10 are both mounted for individual rotation about a common axis A. In other embodiments, the supply spool support 10 and dancing arm 28 may rotate about their own respective axes.

FIGS. 6 to 11 show further different views of the brake assembly 70 which is configured to apply a variable braking force to the supply spool support 10, the braking force resisting rotation of the supply spool support 10. The brake assembly 70 includes a brake disc 74 which is attached to the supply spool support 10 such that it co-rotates with the supply spool support 10 (and consequently any supply spool which is supported by the supply spool support 10).

The brake assembly also includes a brake belt 76 which extends around part of the outer circumference 88 of the brake disc 74. The brake belt is fixed at a first end **76*a* to an attachment pin 78 which is part of a mounting block 80 which is fixed so that it does not rotate with the supply spool support 10. The brake belt 76 is attached at second end 76*b* via a spring 82 to a pin 84 of a lever arm 86. The spring may be any appropriate resilient biasing member. In one embodiment the spring 82** is tension spring number 523 having a rate of 4.48 N/mm produced by Kato-Entex Ltd, UK.

In the embodiment shown, the brake belt 76 has a generally rectangular cross-section and it contacts a portion of the outer circumference 88 of the brake disc 74 which has a substantially flat surface parallel to the axis A. That is to say, the substantially flat circumferential surface 88 of the brake disc 74 corresponds to the substantially flat surface of the belt 76 which engages the outer circumference 88 of the brake disc 74. It will be appreciated that in other embodiments of the labelling machine, the outer circumferential surface of the brake disc and the brake belt may have any appropriate corresponding profile. For example, the outer circumferential surface of the brake disc may include a v-shaped groove which cooperates with generally circular cross-section brake belt.

The brake belt 76 may be made from any appropriate material for example the brake belt may be made out of a combination of fabric and polymeric material or of polyurethane. In one embodiment the brake belt is 10 mm wide, 280 mm long and formed from a material referred to as Habasit TG04. In this embodiment the brake disc (which may be of any appropriate size in other embodiments) has a diameter of 100 mm.

The lever arm 86 is pivotally mounted to the mounting block 80 by a pivot pin 90. A first end of the lever arm 86 includes the pin 84. A second end of the lever arm 86 engages an armature 92 of a solenoid 94. An example of a suitable solenoid is an MCSMT-3257S12STD solenoid supplied by Premier Farnell UK Limited.

As can be seen best in FIG. 7, the distance between the pivot pin 90 and the point 96*a* on the pivot arm 86 at which the armature 92 of the solenoid 94 engages the pivot arm 86 is greater that the distance between the pivot pin 90 and the pin 84 to which the brake belt 76 is attached. In this way, the lever arm 86 provides a mechanical advantage such that any force applied by the armature 92 of the solenoid 94 to the lever arm 86 is magnified when it is applied to the brake belt 76 via the pin 84.

In use a resilient biasing member 98 (which in this embodiment is a spring different to the spring 82, but may be any other appropriate resilient biasing member) biases the lever arm 86 in a direction such that the spring 98 causes the brake belt 76 to contact the outer circumference 88 of the brake disc 74 so as to apply a braking force to the brake disc 74 and therefore resist rotation of the brake disc 74 and attached supply spool support 10. In one embodiment the spring 98 is compression spring number 940 having a rate of 0.94 N/mm produced by Kato-Entex Ltd, UK. The direction of the force applied by the spring 98 to the second end 76*b* of the brake belt 76 is denoted S in FIG. 7. This ensures that, when no power is supplied to the solenoid 94 (for example when the labelling machine is powered down), the spring 98 causes a braking force to be applied to the brake disc 74 and hence the supply spool support 10.

Extension of the armature 92 of the solenoid 94 in the direction towards the lever arm 86 and as indicated by arrow F will cause the pin 84 to move in a direction of arrow F' which is substantially opposite to that of the arrow F. Consequently, if the solenoid 94 is energised such that the armature 92 moves towards the lever arm 86 in the direction F, this will cause the lever arm 86 to overcome the biasing force exerted on it by the spring 98 such that the pin 84 moves in the direction F'. This will cause the amount of braking force exerted by the brake belt 76 on the brake disc 74 to decrease. It follows that by controlling the position of the solenoid armature 92 (and hence controlling the position of the pin 84 via the lever arm 86) that the amount of braking force applied to the supply spool support 10 via the brake disc 74 can be varied.

The surface of the brake belt 76 which contacts the outer circumferential surface 88 of the brake disc 74 may be referred to as a first braking surface. The outer circumferential surface 88 of the brake disc 74 which is contacted by the first braking surface may be referred as a second braking surface. In a braking mode the controller controls the current supplied to the coil of the solenoid so as to urge the first braking surface against the second braking surface. As previously discussed, this is done by moving the armature 92 of the solenoid in a direction which is substantially opposite to the direction F (shown by arrow F'), thereby allowing the spring 98 to bias the end of the lever arm 86 which includes the pin 84 in a direction which is substantially parallel to the direction F (i.e. substantially in direction S). Due to the fact that the second end 76*b* of the brake belt 76 is connected to the pin 84 and due to the fact that the first end 76*a* of the brake belt 76 is attached to a fixed pin 78, movement of the pin 84 in a direction which is substantially parallel to the direction F causes the first braking surface to be urged against the second braking surface, thereby applying a braking force to the brake disc 74. The second braking surface 88 is part of the brake disc 74 which is attached to the supply spool support 10. Consequently the supply spool support 10 is associated with the second braking surface 88.

As seen best in FIGS. 7, 8 and 10, the solenoid 94 includes a coil (not shown) housed within a solenoid housing 96 and the armature 92 which is a linearly moveable relative to the coil. One end of the armature 92 engages the lever arm 86. Attached to the other end of the armature 92 is a reflective element 99 which forms part of an armature position sensor. In one embodiment the reflective element 99 is a generally annular machined part made from white acetal material.

The armature position sensor further includes a transmitter 100 configured to transmit electromagnetic radiation and a receiver 102 which is configured such that electromagnetic radiation transmitted by the transmitter 100 and reflected by the reflective element 99 is incident on the receiver 102. The transmitter 100 and receiver 102 can be seen most clearly in FIG. 8. In this embodiment the transmitter 100 is a light emitting diode and the receiver 102 is a photodiode. Both the transmitter 100 and the receiver 102 are supported by a sensor support 104 which is in a fixed positional relationship with regard to the body 96 of the solenoid 94 (and hence the coil of the solenoid contained within the body 96). In one embodiment the transmitter 100 and receiver 102 are a single part, HDSL-9100-021 proximity sensor, produced by Avago Technologies, U.S. Inc.

In use, the transmitter 100 (in this case an LED) transmits electromagnetic radiation in a direction such that it is incident on the reflective element 99. The reflective element 99 reflects at least a portion of the electromagnetic radiation which is incident on it. Some of the electromagnetic radiation which is reflected by the reflective element 99 is incident on the receiver 102. As previously discussed, in this case, the receiver 102 is a photodiode. Consequently the voltage and/or current of a signal output by the photodiode is indicative of the amount of electromagnetic radiation which is reflected by the reflective element 99 and incident on the receiver 102.

When the armature 92 of the solenoid 94 is moved the position of the reflective element 99 relative to the transmitter 100 and receiver 102 will change. The further the reflective element 99 is away from the transmitter 100 and receiver 102 (i.e. the further the armature 92 of the solenoid 94 is moved in the direction F) the less electromagnetic radiation produced by the transmitter 100 and reflected by the reflective element 99 will be incident on the receiver 102. Consequently, in this case where the receiver is a photodiode, the less the magnitude of the voltage and/or current signal produced by the receiver 102. It follows that the receiver 102 of the armature position sensor outputs a signal (which may be referred to as an armature position signal) which is indicative of the position of the armature 92 relative to the coil of the solenoid 94. It will be appreciated that the armature position signal is also indicative of the position of a lever arm 86 and hence of the braking force which is being applied by the brake belt 76 (which is attached to pin 84 of the lever arm 86) to the brake disc 74 and hence to the supply spool support 10.

In a standard solenoid of the type used in FIG. 7, the extent of relative movement between the armature and the coil is dependent on the current supplied to the coil. The armature of the solenoid is biased relative to the coil by a resilient biasing member (not shown) towards a first end position. Hence, when no current is supplied to the coil, the solenoid is biased towards the first end position. When current of a particular magnitude is applied to the coil of the solenoid the armature overcomes the biasing force which urges it into the first end position such that the armature moves towards a second end position. Removing the current provided to the coil will result in the armature being urged by the resilient biasing member back to the first end position. Consequently, solenoids tend to be bi-stable, i.e. depending on the operating state of the solenoid, the armature tends to be located relative to the coil at the first end position or the second end position. The armature cannot be reliably located relative to the coil at a position between the first end position and the second end position.

A labelling machine described herein includes a solenoid control system which includes a solenoid controller and is configured to control the current supplied to the coil of the solenoid based upon the armature position signal output by the armature position sensor so as to urge the armature towards a desired rest position relative to the coil which is intermediate the first and second end positions of the solenoid discussed above. The solenoid controller implements a conventional PID (proportional, integral and derivative) algorithm as part of a closed loop system in order to control the current supplied to the coil of the solenoid.

FIG. 14 shows a diagrammatic representation of the PID control algorithm implemented by the solenoid controller. At any given time a set point value SP(t) is provided to the control algorithm. The set point value SP(t) is indicative of the desired position of the armature of the solenoid relative to the coil. The set point signal SP(t) is provided to one input of a subtractor 110. A feedback signal FB(t) which is indicative of the actual position of the armature relative to the coil of the solenoid is supplied to a second input of the subtractor 110. The subtractor 110 subtracts the feedback signal FB(t) from the set point signal SP(t) and outputs an error signal E(t).

The error signal E(t) is supplied to three portions of the PID algorithm. These are the proportional component P, the integral component I, and the derivative component D. As can be seen from the figure, the proportional component P outputs a signal which is given by a constant $K_P$ multiplied by the error signal E(t). The integral component I outputs a signal which is given by a constant $K_I$ multiplied by the integral of the error signal E(t). The derivative component D of the algorithm outputs a signal which is given by a constant $K_D$ multiplied by a derivative of the error signal E(t) with respect to time.

An adder 112 combines the signals output by the proportional P, integral I and derivative D components of the algorithm. The output from the adder 112 is provided to a coil driver 114. The coil driver 114 is connected across the coil of the solenoid so that it can apply a voltage across the coil. The coil driver 114 supplies a pulse width modulated voltage signal across the coil of the solenoid. The coil driver 114 controls the duty cycle of the pulse width modulated voltage signal applied across the coil as a function of the signal output to it by the adder 112 of the PID control algorithm.

By varying the duty cycle of the pulse width modulated voltage applied across the coil of the solenoid, the current supplied to the coil, and hence the position of the armature of the solenoid relative to the coil, can be changed. An armature position sensor 116 outputs an armature position signal which is indicative of the position of the armature relative to the coil of the solenoid. The armature position signal may also be referred to as the feedback signal FB(t). In the previously described embodiment shown in FIGS. 5 to 13, the armature position sensor 116 includes the transmitter 100, the reflective element 99 and the receiver 102. As previously discussed, it is the receiver 102 which outputs the armature position signal. Details of the operation of the armature position sensor can be found in the description above. However, it will be appreciated that any appropriate armature position sensor (which is capable of producing an armature position signal which indicative of the position of the armature relative to the coil) may be used.

A conventional PID controller is configured such that an increase in the signal output by the adder which combines the proportional, integral and derivative components (e.g. 112 in FIG. 14) causes an increase in the feedback signal. However in the case of the embodiment previously described with reference to FIG. 14 the opposite occurs. An increase in the signal output by the adder 112 results in an increase in the current in the coil provided by the coil driver 114, which causes a decrease in the feedback signal FB(t) produced by the armature position sensor 116. This may be compensated for in a number of ways. For instance, the range of the feedback signal may be inverted such that a small signal is generated when the reflector is close to the transmitter, and a larger signal generated when the reflector is further away from the transmitter. Alternatively, the connections of the signals to the subtractor 110 may be swapped.

A suitable frequency for the pulse width modulated voltage is approximately 10 kHz. That is to say, during each 1/10,000 of a second the voltage applied is taken high, and then low again. Within each 1/10,000 of a second the duration for which the signal is high and the duration for which the signal is low are varied, however in each case the sum of the duration for which the signal is high and the duration for which the signal is low is always equal to 1/10,000 of a second. Of course, any appropriate frequency of pulse width modulated voltage may be used.

The armature position sensor is calibrated as follows. The solenoid is caused to enter a de-energised state by the controller. In this state, substantially no current is provided to the coil of the solenoid. The armature is urged to the limit of its movement in the direction F' by the biasing force of the spring 98 (an also by any resilient biasing member within the solenoid). At this point the controller records the value of the signal output by the armature position sensor. This value may be referred to as the maximum braking value because it corresponds to the configuration of the brake assembly (in this case the position of the armature) in which the maximum braking force is applied to the spool support by the brake assembly.

The solenoid is then caused to enter a fully energised state by the controller. In this state, enough current is provided to the coil of the solenoid such that the armature is urged against the biasing force of the spring 98 to the limit of its movement in the direction F. At this point the controller records the value of the signal output by the armature position sensor. This value may be referred to as the minimum braking value because it corresponds to the configuration of the brake assembly (in this case the position of the armature) in which the minimum braking force is applied to the spool support by the brake assembly.

In this embodiment the exact relationship between armature position and braking force applied by the brake assembly to the spool support is unknown. What is known is that when the armature position sensor outputs a signal to the controller which has a value equal to the maximum braking value, then the braking force applied by the brake assembly to the spool support is a maximum. Likewise, when the armature position sensor outputs a signal to the controller which has a value equal to the minimum braking value, then the braking force applied by the brake assembly to the spool support is a minimum. When the armature position sensor outputs a signal to the controller which has a value between the minimum braking value and the maximum braking value, then the braking force applied by the brake assembly to the spool support is between the minimum and maximum braking force. The closer the value of the signal output by the armature position sensor to the maximum braking value, the closer the braking force applied by the brake assembly to the spool support is to the maximum braking force. Likewise, the closer the value of the signal output by the armature position sensor to the minimum braking value, the closer the braking force applied by the brake assembly to the spool support is to the minimum braking force. In other embodiments the armature position sensor may be calibrated such that the relationship between armature position and braking force applied by the brake assembly to the spool support is known.

In order to avoid the armature colliding with a portion of the coil or an end-stop (if present) during operation, a limited range of the full movement of the armature may be used. That is to say, the solenoid controller and/or PID algorithm may be configured such that the coil driver provides a maximum current to the coil which is less than the current required for the solenoid to enter its fully energised state; and such that the coil driver provides a minimum current to the coil which is greater than the current required for the solenoid to enter its de-energised state.

Extension of the armature 92 of the solenoid 94 in the direction towards the lever arm 86 and as indicated by arrow F will cause the pin 84 to move in a direction of arrow F' which is substantially opposite to that of the arrow F. Consequently, if the solenoid 94 is energised such that the armature 92 moves towards the lever arm 86 in the direction F, this will cause the lever arm 86 to overcome the biasing force exerted on it by the spring 98 such that the pin 84 moves in the direction F'. This will cause the amount of braking force exerted by the brake belt 76 on the brake disc 74 to decrease. It will be appreciated that in other embodiments the brake assembly may be configured such that energising the solenoid increases the braking force applied to the spool support and de-energising the solenoid decreases the braking force applied to the spool support. In other embodiments any suitable braking arrangement may be used, for example brake disc and brake pad, brake drum and brake shoe or appropriate motor as discussed in more detail below.

Any appropriate gain constants $K_P$, $K_I$ and $K_D$ may be used. In some embodiments, at least one of these constants may be equal to zero. However, in a preferred embodiment, all of these constants are non-zero.

In some embodiments, an offset may be applied to ensure that with zero error between the set point signal and the feedback signal, a control signal is generated which is in the centre of the range of valid control signals.

In some embodiments, the PID control algorithm may incorporate a dead band. In such embodiments, the error signal E(t) is set to zero if the feedback signal FB(t) is within a given range of the set point signal SP(t). For example, the dead band may operate such that if the difference between the set point signal SP(t) and the feedback signal FB(t) is less than ±1% of the set point signal SP(t) then the error signal E(t) is set to zero. Alternatively, if the difference between the set point signal SP(t) and the feedback signal FB(t) is less than ±1% of a maximum possible set point signal (i.e. the set point signal which is equivalent to a desired fully energised state of the coil of the solenoid, or a desired de-energised state of the solenoid) then the error signal E(t) is set to zero. If, in either of these cases, the feedback signal FB(t) falls outside of this range then the error signal E(t) is calculated in the manner already described by the subtractor 110.

Other embodiments incorporating a dead band may function in a slightly different manner. These embodiments operate in the same manner as the dead band previously described except that if the feedback signal FB(t) falls outside of the dead band then the error signal E(t) is calculated by calculating the difference between the feedback signal FB(t) and the edge of the dead band which is closest to the feedback signal FB(t). For example, if the dead band is ±1% of the set point signal SP(t), and the feedback signal FB(t) has a value of the set point signal SP(t) plus 1% of the set point signal SP(t) plus μ, then the value of the error signal is −μ. Likewise, if the dead band is ±1% of the set point signal SP(t), and the feedback signal FB(t) has a value of the set point signal SP(t) minus 1% of the set point signal SP(t) and minus μ, then the value of the error signal is μ. In an alternative example, if the dead band is ±1% of the maximum possible set point signal (i.e. the set point signal which is equivalent to a desired fully energised state of the coil of the solenoid, or a desired de-energised state of the solenoid), and the feedback signal FB(t) has a value of the set point signal SP(t) plus 1% of the maximum possible set point signal, plus μ, then the value of the error signal is −μ. Likewise, if the dead band is ±1% of the maximum possible set point signal, and the feedback signal FB(t) has a value of the set point signal SP(t) minus 1% of the maximum possible set point signal SP(t) and minus μ, then the value of the error signal is μ.

Where a non-zero value is used for $K_D$, some form of low pass filtering (a concept which is well known in the art) may be used to reduce the noise present in the feedback signal. That is to say low pass filtering may be used either to reduce the amount of relatively high frequency noise from the derivative component D of the PID algorithm (compared to the relatively low frequency desired portion of the derivative component D of the PID algorithm) or to reduce the amount of relatively high frequency noise from the feedback signal (compared to the relatively low frequency desired portion of the feedback signal). It will be appreciated that if a low pass filter is used as a form of low pass filtering, then the cut-off frequency of the low pass filter would be chosen (in a manner well known in the art) such that relatively high frequency noise from the derivative component D of the PID algorithm or feedback signal is attenuated but the relatively low frequency desired portion of the derivative component D of the PID algorithm or feedback signal is allowed to pass.

The reason a form of low pass filtering may be used to remove noise if a non-zero value of $K_D$ is used is because the derivative term acts to amplify the rate of change of the feedback signal and is thus particularly sensitive to high frequency content as this has a greater rate of change than low frequency content (assuming equal amplitude). The noise may be caused by various factors. For example, the noise may be intrinsic to the emitter/detector arrangement, it may be electronic circuit noise, it may be electromagnetically-induced interference or it may be any other noise source. In the case where the armature position sensor comprises a radiation detector, noise may be caused by the presence of unintended radiation. One example of a form of low pass filtering includes a simple averaging algorithm. The averaging algorithm may take a number of samples of the feedback signal FB(t) or the derivative component D of the PID algorithm and then output the mean value of those samples. However, any appropriate form of low pass filtering or any appropriate known method of reducing noise may be used.

It is possible that a braking assembly included in a labelling machine (as described above or otherwise) may include at least one component that is subject to wear over time. Once said at least one component of the braking assembly has worn to the extent that performance of the labelling machine is unacceptably adversely affected then said at least one component of the braking assembly may require replacement. In order to replace said at least one component it may require that the labelling machine is shut down at an inconvenient time which results in down time of a production line of which the labelling machine forms part.

One embodiment which obviates or mitigates this problem is discussed below. The controller may include a memory. The controller may be configured so as to monitor a parameter which is indicative of the state of the braking assembly and to maintain (store and update) a value in the memory which is indicative of the accumulated use of the braking assembly. For example, the controller may be configured to monitor the set point signal and/or feedback signal of a control algorithm which controls the braking assembly. In one example incorporating the braking assembly above, the output of the armature position sensor (or feedback signal FB(t)) is monitored by the controller and the controller maintains the value in the memory as a function of the output of the armature position sensor (or feedback signal FB(t)) over time.

For example, the armature position sensor may output a signal (e.g. a voltage) which increases in magnitude as the braking force applied by the solenoid increases. The controller may monitor the output of the armature position sensor and periodically (i.e. after every time a fixed period of time passes) add the output of the armature position sensor at that time to the value currently stored in the memory. In this way, the greater the magnitude of the value stored in the memory, the greater the amount of braking force (over time) that has been applied by the braking assembly. The controller may monitor the magnitude of the value. It is thought that the total braking force applied over time is proportional to the accumulated value stored in the memory and to the wear of components of the braking assembly.

Consequently, if the controller detects that the magnitude of the value exceeds a predetermined value which has been chosen to indicate a potential level of wear of a component of the braking assembly which may be unacceptable (but some time before the component fails), then the controller may be configured to output a signal indicating that the braking assembly requires maintenance. The controller may be configured to output a signal indicating that the braking assembly requires maintenance if the value stored in the memory falls within any appropriate predetermined range.

The signal which indicates the braking assembly requires maintenance may be supplied to a suitable indicator (e.g. an audible and/or visual indicator) which is configured to indicate that the braking assembly requires maintenance to an operator of the labelling machine. The braking assembly may then be maintained at the next convenient opportunity—for example when the production line of which the labelling machine forms part is powered down or when the production line is experiencing downtime for another reason. In this way inconvenient downtime of the production line caused by servicing/maintenance of the braking assembly is avoided.

Within the braking assembly described above, examples of components which may be subject to wear and hence require maintenance/replacement include the brake belt 76, the brake disc 74 or the solenoid 94. It will be appreciated that in other embodiments the components of the braking assembly which may be subject to wear may be any appropriate components.

In the embodiment discussed above the output of the armature position sensor (or feedback signal FB(t)) is monitored by the controller and the controller maintains the value in the memory as a function of the output of armature position sensor (or feedback signal FB(t)) over time. If, over time, the controller detects that the magnitude of the value exceeds a predetermined value which has been chosen to indicate a potentially unacceptable level of wear of a component of the braking assembly, then the controller outputs a signal indicating that the braking assembly requires maintenance. Any appropriate method of monitoring a parameter which is indicative of the state of the braking assembly so as to detect a potential wear condition of the braking assembly may be used.

In another example, incorporating the braking assembly described above, the output of the armature position sensor (or feedback signal FB(t)) is monitored by the controller and the controller records a value in the memory which is indicative of the output of the armature position sensor (or of the feedback signal FB(t)) during the first use of the labelling machine (or the first use of the labelling machine after the braking assembly has been maintained. For example, the controller may determine and record a value in the memory which is indicative of the average output of the armature position sensor (or the average of the feedback signal FB(t)) whilst the labelling machine transfers the first reel of label stock from the supply spool support to the take up spool support (or whilst the labelling machine transfers the first reel of label stock after maintenance of the braking assembly from the supply spool support to the take up spool support). The controller is configured to subsequently monitor the output of the armature position sensor (or feedback signal FB(t)) and, in a similar manner to that done in relation to the first reel of label stock, calculate a value indicative of the average output of the armature position sensor (or the average of the feedback signal FB(t)) whilst the labelling machine transfers each subsequent reel of label stock from the supply spool support to the take up spool support. The controller may be configured to output a signal indicating that the braking assembly requires maintenance if the value indicative of the average output of the armature position sensor (or the average of the feedback signal FB(t)) whilst the labelling machine transfers a subsequent reel of label stock from the supply spool support to the take up spool support differs by more than a predetermined amount from the value stored in the memory indicative of the average output of the armature position sensor (or the average of the feedback signal FB(t)) whilst the labelling machine transfers the first reel of label stock from the supply spool support to the take up spool support. For example, the controller may be configured to output a signal indicating that the braking assembly requires maintenance if the value indicative of the average output of the armature position sensor (or the average of the feedback signal FB(t)) whilst the labelling machine transfers a subsequent reel of label stock from the supply spool support to the take up spool support differs by more than approximately 20% from the value stored in the memory indicative of the average output of the armature position sensor (or the average of the feedback signal FB(t)) whilst the labelling machine transfers the first reel of label stock from the supply spool support to the take up spool support.

In the embodiment discussed above each valve indicative of the average output of the armature position sensor (or the average of the feedback signal FB(t)) whilst the labelling machine transfers a reel of label stock from the supply spool support to the take up spool support may be determined by the controller as follows. As the labelling machine transfers a reel of label stock from the supply spool support to the take up spool support, the controller may periodically take a number of readings of the output of the armature position sensor (or the average of the feedback signal FB(t)). In order to determine the average, the controller then sums the readings and divides the summed readings by the number of readings.

It will be appreciated that although the braking arrangement described is configured so as to enable a braking force to be applied to the supply spool support, in other embodiments, the same brake assembly may be used in conjunction with the take up spool support, so as to apply a braking force to the take up spool support.

It will also be appreciated that, although a particular brake assembly is described above which utilises a brake belt, brake disc and actuating solenoid, in other embodiments, any appropriate brake assembly may be used providing the brake assembly is capable of selectively applying a braking force to the relevant spool support.

For example, the brake assembly may include a motor that is mechanically linked to the relevant spool support (e.g. the supply spool support) such that the motor rotates with the spool support. In one example the motor may be a DC motor. As is well known, by controlling the amount of current provided to the DC motor, the amount of torque exerted by the DC motor can be controlled. Consequently, by driving the DC motor in a direction such that it opposes the direction of rotation of the spool support, and by controlling the amount of current provided to the DC motor, it is possible to control the amount of torque the DC motor applies to the relevant spool support in order to oppose (or resist) the rotation of the relevant spool support. The torque applied by the motor to oppose the rotation of the relevant spool support may be referred to as a braking torque.

In another example the motor may be a stepper motor. An un-powered stepper motor has a holdback torque, which is a torque of the stepper motor which opposes rotation of the stepper motor. The amount of holdback torque can be changed by changing an electrical resistance that is connected across each of the windings of the stepper motor. For example, such a technique is described in U.S. Pat. No. 5,366,303. The greater the electrical resistance connected across each winding the greater the holdback torque of the stepper motor. Consequently, by controlling the electrical resistance connected across each winding of the stepper motor, it is possible to control the braking torque of the stepper motor.

As previously discussed in relation to FIGS. 2 and 5, the labelling machine includes a moveable element in the form of a dancing arm 28 having a roller 32.

Considering FIGS. 11, 12 and 13 together, the dancing arm 28 also includes a generally annular portion 120 which is mounted for rotation about the axis A and about shaft 122 by bearings 124. The shaft 122 connects the supply spool support 10 to the brake disc 74 such that the supply spool support 10 and the brake disc 74 co-rotate. The supply spool support 10, brake disc 74 and connecting shaft 122 are mounted for rotation relative to the mounting block 80 about axis A by a second set of bearings 126.

As seen best in FIG. 11, an arm 128 projects from the annular portion 120 of the dancing arm 28. A first end 130*a* of a resilient biasing member 130 (which in this case is a tension spring, but may, in other embodiments, be any appropriate resilient biasing member) is attached to the arm 128 via a pin 132. In one embodiment the spring 130 is tension spring number 2137 having a rate of 1.05 N/mm produced by Kato-Entex Ltd, UK. As can be seen best in FIG. 7, a second end 130*b* of the resilient biasing member 130 is fixed via a pin to the mounting block 80. In FIG. 7, the pin used to secure the second end 130*b* of the resilient biasing member 130 to the mounting block 80 has been omitted for clarity. The resilient biasing member 130 biases the dancing arm 28 in the clockwise direction as shown in FIG. 7. This direction is indicated by arrow G.

The labelling machine includes a sensor configured to produce a sensor signal indicative of the position of the moveable element (in this case dancing arm 28). The sensor is configured to produce a sensor signal indicative of the position of the moveable element. In this case the sensor produces a sensor signal indicative of the rotational position of the moveable element. As best seen in FIG. 11 the sensor includes a multipole strip magnet 140 which is attached to a circumferential surface 142 of the annular portion 120 of the dancing arm 28.

FIG. 15 shows a schematic plan view of a portion of the multipole strip magnet 140 which has been removed from the annular portion 120 of the dancing arm 28 and has been laid flat in the plane of the paper. The multipole strip magnet 140 is such that along its length LS there are alternating regularly spaced north N and south S magnetic pole regions 143. The length of each pole region 143 is Lpole. In some embodiments the pole length Lpole may be 1 mm or 2 mm. The multipole strip magnet 140 may be attached to the circumferential surface 142 of the annular portion 120 using any appropriate method, for example, using adhesive.

The sensor configured to produce a sensor signal indicative of the position of the moveable element also includes a magnetic sensor (not shown) which is mounted to sensor support 144. The magnetic sensor is mounted with sufficient proximity to the multipole strip magnet 140 such that the magnetic sensor can readily sense the magnetic field produced by the multipole magnetic strip 140. The magnetic sensor may be of any appropriate type. For example it has been found that a magnetic sensor which comprises a plurality of Hall Effect sensors (also referred to as Hall elements) is capable of providing approximately 1000 sensor pulses for a full sweep of the dancing arm 28 when using a multipole magnet strip which has a pole length Lpole of 2 mm. In this example, the magnetic sensor which comprises a plurality of Hall elements is an AS5304 integrated Hall IC and the magnetic strip is an AS5000-MS20-50 multipole magnetic strip, both produced by ams AG, Austria. A full sweep of the dancing arm 28 is an angular displacement of the dancing arm between the extents of the dancing arm's angular movement.

It will be appreciated that, given the knowledge of the pole length Lpole of the multipole strip magnet 140 and also knowing the diameter of the circumferential surface 142 to which the multipole magnetic strip 140 is attached, it is possible to count signal pulses provided by the magnetic sensor as the dancing arm 28 rotates in order to determine angular displacement of the dancing arm 28. Furthermore, if it is known that for a full sweep of the dancing arm 28 a particular number of pulses are generated by the magnetic sensor and further known that a full sweep of the dancing arm 28 represents motion of the dancing arm through an arc of a particular angle (which can be measured based upon physical restrictions on dancing arm movement) it is a straightforward matter to determine the angular displacement from a 'home' position (described below) based upon a number of pulses generated by the magnetic sensor since the dancing arm 28 was in that home position.

FIG. 16 shows a schematic representation of a portion of a labelling machine as shown in the previous figures. It is explained with reference to FIG. 16 how an angular displacement of the dancing arm 28 can be used to calculate a change in the length of the web path 20 between the supply spool support 10 and take up spool support 12.

A portion of the web path 20 is formed by the loop extending between the rollers 22 and 24 via the roller 32. The length L of the portion of the web path 20 extending between the rollers 22 and 24 via the roller 32 can be calculated as a function of the position of the dancing arm 28 (and hence roller 32).

With reference to FIG. 16, the dancing arm 28 has a length r and defines an arc through which roller 32 travels. The length r is the linear distance between the axis of rotation A of the dancing arm 28 and the centre of the roller 32. The dancing arm 28 has a home position, which may be defined as the position in which the line r is coincident with a line $r_h$. During operation it can be determined whether the dancing arm 28 is in the home position by the triggering of a home position sensor (not shown), such as a micro-switch or any other appropriate position sensor.

Once the home position sensor has been triggered, an angular displacement of the dancer arm 28 from the home position can be measured by the sensor (in this case the magnetic sensor), which outputs a sensor signal indicative of the position of the moveable element. This position signal takes the form of a series of pulses indicating an angular displacement of the dancer arm 28 from the home position as described above.

For ease of reference, an angle θ representing the angular displacement of the dancer arm 28 is measured from a horizontal (x) axis, shown in FIG. 16. It can be seen from FIG. 16 that the angle θ can be calculated from an angle $\theta_h$ indicating angular displacement of the dancer arm from the home position, and an angle $\theta_{h'}$ of the home position from a vertical (y) axis by the equation:

$$\theta = \frac{\pi}{2} - \theta_h - \theta_{h'} \tag{2}$$

The axis A of rotation of the dancer arm 28 is used as a reference point for relative measurements, with horizontal (x-axis) and vertical (y-axis) displacements referring to the horizontal and vertical distance from that point.

It will be appreciated that the relative positions of roller 22 and roller 24 to the axis of rotation A of the dancer arm 28 are fixed and as such are known. The position of the roller 22 is defined by coordinates ($x_{r1}$, $y_{r1}$). Similarly, the position of the roller 24 is described by coordinates ($x_{r2}$, $y_{r2}$).

The position of the roller 32 is defined by coordinates ($x_{r3}$, $y_{r3}$), although it will be appreciated that as the roller 32 moves (as the dancing arm 28 moves) the values of these coordinates will not be fixed, and as such, both $x_{r3}$ and $y_{r3}$ are functions of the angle θ and length r and can be calculated as follows:

$$y_{r3} = r \sin \theta \tag{3}$$

$$x_{r3} = \sqrt{r^2 - y_{r3}^2} \tag{4}$$

The distance $p_1$ between the centre of roller 22 and the centre of roller 32, and the distance $p_2$ between the centre of roller 24 and the centre of roller 32, is given by Pythagoras' Theorem from the known positions of each of the rollers according to the following equations:

$$p_1 = \sqrt{(x_{r3} - x_{r1})^2 + (y_{r3} + y_{r1})^2} \tag{5}$$

$$p_2 = \sqrt{(x_{r3} - x_{r2})^2 + (y_{r3} + y_{r2})^2} \tag{6}$$

The line between the centres of rollers 22 and 32 has an angle c from the y-axis, which can be calculated according to following equation:

$$\varepsilon = \tan^{-1}\left(\frac{x_{r3} - x_{r1}}{y_{r3} + y_{r1}}\right) \tag{7}$$

The line between the centres of rollers 24 and 32 has an angle γ from the y-axis, which can be calculated according to the following equation:

$$\gamma = \tan^{-1}\left(\frac{x_{r3} - x_{r2}}{y_{r3} + y_{r2}}\right) \tag{8}$$

The web path 20 will follow a substantially straight line between each of the rollers 22, 24, 32 it contacts. At the point of contact between the web path 20 and each of the rollers 22, 24, 32 (and in particular an outer circumferential surface of each of the rollers 22, 24, 32) the web path 20 is tangential to the respective roller. The angle between the web path 20 (between rollers 22 and 32) and the line $p_1$ between the centres of the rollers 22 and 32 is a which can be calculated according to the equation:

$$\alpha = \sin^{-1}\left(\frac{\frac{d_{r1}}{2} + \frac{d_{r3}}{2}}{p_1}\right) \tag{9}$$

where $d_{r1}$ is the diameter of roller 22, and $d_{r3}$ is the diameter of roller 32.

The angle between the web path 20 (between rollers 24 and 32) and the line $p_2$ between the centres of the rollers 24 and 32 is β, which can be calculated according to the equation:

$$\beta = \sin^{-1}\left(\frac{\frac{d_{r2}}{2} - \frac{d_{r3}}{2}}{p_2}\right) \tag{10}$$

where $d_{r2}$ is the diameter of roller 24.

The length of the web path 20 between each of the rollers 22, 24 and 32 can now be calculated. The length $l_1$ of the web path 20 between the rollers 22 and 32 can be calculated according to the following equation:

$$l_1 = \sqrt{p_1^2 - \left(\frac{d_{r1}}{2} + \frac{d_{r3}}{2}\right)^2} \tag{11}$$

The length $l_2$ of web path 20 between the rollers 24 and 32 can be calculated according to the following equation:

$$l_2 = \sqrt{p_2^2 - \left(\frac{d_{r2}}{2} - \frac{d_{r3}}{2}\right)^2} \tag{12}$$

In order to calculate the total length L of the web path 20 between the location at which the web path 20 contacts roller 22 and the location at which the web path 20 contacts roller 24, the lengths of the arcs which are made by the web path 20 at the circumference of each of the rollers 22, 24 and 32 where the web path 20 contacts the rollers must be calculated.

As discussed above, at the point of contact with each roller, the web path 20 is tangential to the respective roller. Therefore, because the x-axis and y-axis are orthogonal, an angle between a normal to each respective roller at the point of contact of the web path to the respective roller and the x-axis is the same as the angle between the web path 20 and the y-axis.

The angle between the y-axis and the web path 20 between rollers 22 and 32 is given by $\varepsilon-\alpha$. The angle between the y-axis and the web path 20 between rollers 24 and 32 is given by $\gamma-\beta$.

The length of each arc can be calculated as the product of the radius of the respective roller and the angle subtended by the arc, with each of the arcs calculated as follows:

$$\text{arc}_1 = \left(\frac{\pi}{2} + \alpha - \varepsilon\right) \cdot \frac{d_{r3}}{2} \tag{13}$$

where $\text{arc}_1$ is a length of an arc between a point at which the web makes contact with roller 32 on the left-hand side (with respect to FIG. 16) and the uppermost point on the circumference of roller 32 (again with respect to FIG. 16). $\text{arc}_1$ is illustrated in FIG. 16 by the portion of the circumference of the roller 32 between the dotted line 'a' and the dotted line 'b'.

The angle subtended by the arc in equation (13) is derived as follows. Angles at the rotational axis of roller 32 are considered. The angle subtended between the y-axis and the line $p_1$ between the centres of rollers 22 and 32 is $\varepsilon$. The line $p_1$, web path 20 and dotted line 'a' form a right angled triangle. Within this right angled triangle, the angle subtended between line $p_1$ and the web path 20 is $\alpha$. Consequently, the angle subtended by the line $p_1$ and dotted line 'a' is $\pi/2-\alpha$. Because the angle subtended by the arc in equation (13) is the angle subtended between the y-axis and dotted line 'a', it is given by the sum of $\varepsilon$ and $\pi/2-a$, subtracted from $\pi$. This is equal to $\pi/2+\alpha-\varepsilon$ as included in equation (13).

$$\text{arc}_2 = \left(\frac{\pi}{2} + \gamma - \beta\right) \cdot \frac{d_{r3}}{2} \tag{14}$$

where $\text{arc}_2$ is the length of the arc between the uppermost point on the circumference of roller 32 (with respect to FIG. 16) and the point at which the web makes contact with roller 32 on the right-hand side of roller 32 (again with respect to FIG. 16). $\text{arc}_2$ is illustrated in FIG. 16 by the portion of the circumference of the roller 32 between the dotted line 'b' and the dotted line 'c'. The angle between the horizontal (having regard to the orientation of the figure) and dotted line 'c' is $\gamma$-$\beta$. Consequently, the angle between dotted line 'b' (i.e. the vertical) and dotted line 'c' is $$\frac{\pi}{2} + \gamma - \beta.$$

$$\text{arc}_3 = \left(\frac{\pi}{2} - \gamma + \beta\right) \cdot \frac{d_{r2}}{2} \tag{15}$$

where $\text{arc}_3$ is the length of the arc between point at which the web makes contact with roller 24 on the right-hand side (with respect to FIG. 16) and the lowermost point on the circumference of roller 24 (again with respect to FIG. 16). $\text{arc}_3$ is illustrated in FIG. 16 by the portion of the circumference of the roller 24 between the dotted line 'd' and the dotted line 'e'. The angle between the horizontal (having regard to the orientation of the figure) and dotted line 'd' is $\gamma$-$\beta$. Consequently, the angle between dotted line 'e' (i.e. the vertical) and dotted line 'd' is $$\frac{\pi}{2} - \gamma + \beta.$$

$$\text{arc}_4 = \left(\frac{\pi}{2} + \alpha - \varepsilon\right) \cdot \frac{d_{r1}}{2} \tag{16}$$

where $\text{arc}_4$ is the length of the arc between the point at which the web makes contact with roller 22 on the right-hand side (with respect to FIG. 16) and the lowermost point on the circumference of roller 22. $\text{arc}_4$ is illustrated in FIG. 16 by the portion of the circumference of the roller 22 between the dotted line 'f' and the dotted line 'g'. The angle subtended by the arc in equation (16) is derived as follows. Angles at the rotational axis of roller 22 are considered. The angle subtended between the y-axis and the line $p_1$ between the centres of rollers 22 and 32 is $\varepsilon$. The line $p_1$, web path 20 and dotted line 'f' form a right angled triangle. Within this right angled triangle, the angle subtended between line $p_1$ and the web path 20 is $\alpha$. Consequently, the angle subtended by the line $p_1$ and dotted line 'f' is $\pi/2-\alpha$. Because the angle subtended by the arc in equation (16) is the angle subtended between the y-axis and dotted line 'f', it is given by the sum of $\varepsilon$ and $\pi/2-\alpha$, subtracted from $\pi$. This is equal to $n/2+\alpha-\varepsilon$.

The total length L of web path 20 between where the web path 20 contacts roller 22 and where the web path 20 contacts roller 24 is calculated as follows:

$$L = l_1 + l_2 + \text{arc}_1 + \text{arc}_2 + \text{arc}_3 + \text{arc}_4 \tag{17}$$

It will be appreciated that while the length L has been calculated between the lowermost point on the circumference of roller 22 (being the point at which the normal to the web path 20 is parallel with the y-axis) and the lowermost point on the circumference of roller 24 (again being the point at which the normal to the web path 20 is parallel with the y-axis), the portion of the web path 20 considered could in fact be any portion which includes the portion of the web path 20 which has a length that varies as a function of the position of the movable element (in this case dancing arm 28) and in such a case it would be apparent to the skilled person, from the foregoing description, how the length of the portion of the web path 20 of interest should be calculated.

Furthermore, in use, the absolute length L may be used as an intermediate value to allow the measurement of a differential length ΔL which represents the difference in web path length between the dancer arm 28 being in a first position, having web path length $L_{pos1}$ (determined using equation (17) above) and the dancer arm 28 being in a second position, having web path length $L_{pos2}$ (also determined using equation (17) above. The differential length ΔL can be calculated according to the equation:

$$\Delta L = L_{pos1} - L_{pos2} \tag{18}$$

It will be appreciated that the differential tape path length ΔL can be calculated for a plurality of further dancer arm positions, and that one of the positions may be the home position.

It will be appreciated from the foregoing description that given knowledge of various fixed dimensions (e.g. roller diameters, angular location of the home position relative to the y axis, distances between roller centres etc.) the length of the web path between the roller and roller 24 can the calculated in the manner described.

It will be appreciated that although one particular method of calculating a change in web path length has been described, any appropriate method of calculating a change in web path length may be utilised. For example, in one embodiment, the web path may extend from a first, fixed roller to a second, movable roller and then to a third, fixed roller adjacent to the first roller. The second, movable roller moves in a linear manner relative to the first and third rollers. In this embodiment, movement of the second roller by a distance d along its linear path results in a change in web path length of 2d. Furthermore, although in the described embodiment the sensor which produces a signal indicative of the position of the moveable element (in this case dancing arm 28) is an angular position sensor, any appropriate sensor may be used. For example, at least one ultrasonic or laser distance measurer may be used to measure the position of the moving element.

The controller may be configured to calculate a displacement of the web of the label stock along the web path based upon the sensor signal produced by the sensor which is indicative of the position of the moveable element.

For example, if the supply spool is paying out label stock at a known linear speed along the web path (determined, for example, using one of the techniques described above) for a known time, and during this time the sensor produces a signal which is indicative of a change in position of the moveable element, then the controller may calculate the change in the length of the web path between the take up spool support and supply spool support which has occurred during said time. Consequently, the controller may calculate the displacement of the web along the web path during said time by adding the displacement of the web along the web path due to the supply spool paying out the label stock and the displacement of the web along the web path due to a change in the length of the web path between the take up spool support and the supply spool support.

Similarly, if the take up spool is taking up label stock at a known linear speed along the web path for a known time, and during this time the sensor produces a signal which is indicative of a change in position of the moveable element, then the controller may calculate the change in the length of the web path between the take up spool support and supply spool support which has occurred during said time. Consequently, the controller may calculate the displacement of the web along the web path during said time by adding the displacement of the web along the web path due to the take up spool taking up the label stock and the displacement of the web along the web path due to a change in the length of the web path between the take up spool support and the supply spool support. For any given period of time the sum of the displacement of the web along the web path due to the take up spool taking up the label stock and the displacement of the web along the web path due to a change in the length of the web path between the take up spool support and the supply spool support is equivalent to the length of label stock removed from supply spool in said given period of time.

As previously discussed, if the displacement of the web along the web path on to a take up spool or off a supply spool is known in combination with the amount of rotation of the take up spool or supply spool whilst said known displacement of the web has occurred, then it is possible to calculate the diameter of said take up spool or supply spool in accordance with equation (1) above.

The controller may be configured to calculate the diameter of one of the spools in this manner based upon calculated displacement of the web along the web path (which is in turn based upon the sensor signal which is indicative of the position of the moveable element) and a rotation signal produced by a rotation monitor. The operation of a specific rotation monitor and its alternatives have been previously discussed and are therefore not referred to again so as to avoid repetition. Suffice to say, the rotation monitor may include a sensor which produces pulses indicative of a given degree of rotation which can be counted, or, alternatively, the rotation monitor may count step pulses which are provided to a position controlled motor, such as a stepper motor.

A labelling machine of the type described herein may include a brake assembly (for example, but not limited to, that previously described). In this embodiment the controller is configured to calculate the diameter of the spool mounted to one of the spool supports based upon the sensor signal indicative of the position of the moveable element and the rotation signal indicative of the rotation of the spool the diameter of which is to be measured. In addition, in this embodiment, the brake assembly is configured to apply a braking force to the other one of said spool supports (i.e. the spool support other than that supporting the spool whose diameter it is desired to calculate).

In this embodiment, the controller is configured to calculate the diameter of said spool supported by said one of said spool supports based upon the sensor signal which indicates movement of the dancing arm 28 when the brake assembly applies a braking force to the other of said spool supports which is sufficient to substantially prevent rotation of the other of said spool supports. This is now described in more detail.

Referring back to FIG. 2 for ease of reference, in this embodiment, the brake assembly (not shown in FIG. 2) applies a braking force to the supply spool support 10 which is sufficient to substantially prevent rotation of the supply spool support 10 and supported supply spool 16. Whilst the brake assembly substantially prevents rotation of the supply spool support 10 and supported spool 16, the controller controls the motor 14, which in this case is a stepper motor, so as to rotate the motor 14 a predetermined number of steps. Rotating the motor 14 a predetermined number of steps is equivalent to rotating the take up spool support 12 and supported spool 34 by a predetermined angle. This is due to the fact that, as noted above, the motor 14 rotates a known number of steps for a single complete rotation and also due to the fact that the nature of any gearing between the motor 14 and the take up spool support 12 is known.

In this case, the take up spool support 12 is rotated in a direction such as to wrap web of the label stock 18 on to the take up spool support 12 such that the web of the label stock travels along the web path in the direction C. It will be appreciated that, in other embodiments, the motor 14 and hence take up spool support 12 may be rotated in the opposite direction.

Rotation of the take up spool support 12 such that the web of the label stock 18 travels along the web path 20 in the direction C whilst a supply spool support 10 (and hence supported supply spool 16) are substantially prevented from rotating will cause tension in the web to increase. The increase in tension in the web will cause the dancing arm to move against the biasing force provided by the spring 130 (not shown in FIG. 2, but shown in FIG. 7, which biases the dancing arm in an anti-clockwise direction) in a clockwise direction so as to reduce the length of the web path 20 between the supply spool support 10 and take up spool support 12.

The clockwise movement of the dancing arm 28 whilst the motor 14 is driven a predetermined number of steps will be sensed by the sensor configured to produce a sensor signal indicative of the position of the moveable element (in this case the magnetic sensor). In accordance with the equations set out above, the controller calculates the change in the length (equation (18)) of the web path 20 between the supply spool support 10 and take up spool support 12 during the time the motor 14 is driven based upon the change of position of the dancing arm 28.

Due to the fact that the supply spool support (and hence supported supply spool 16) is prevented from rotating during this procedure, any change in the length of the web path 20 between the supply spool support 10 and take up spool support 12 will have been caused by that amount of web being wound on to the take up spool 34 supported by the take up spool support 12.

The controller can calculate the number of rotations of the take up spool support 12 (and hence supported take up spool 34) which have occurred due to the controller rotating the motor 14 a predetermined number of steps. The controller can also calculate the change in the length of the web path 20 between the supply spool support 10 and take up spool support 12 based upon the change in position of the dancing arm 28. Finally, the controller can calculate the diameter of the take up spool 34 supported by the take up spool support 12 in accordance with equation (1) above.

The apparatus and method used to calculate the diameter of one of the spools above may be utilised when the machine is started up (to thereby provide an initial measurement of spool diameter) and/or may be used periodically as the labelling machine is operating so as to periodically measure and update the diameter of the relevant spool. For example, the brake may be applied whilst the take up spool support is being rotated during labelling, the rotation of the take up spool causing movement of the dancing arm and thereby allowing determination of the take up spool diameter during labelling.

In one embodiment of the method described above, before carrying out the processing set out above, the controller is arranged to release the brake completely such that the dancing arm 28 assumes its home position (given action of the spring 130). This provides a known starting point for measurement of the angular displacement of the dancing arm 28 using the methods described above.

It will be appreciated that the sensor configured to produce a sensor signal indicative of the position of the moveable element of the labelling machine previously described is a sensor which measures relative displacement (in this case angular displacement) and uses this in combination with a known position (in this case the home position) in order to determine an absolute position (in this case angular position). In some embodiments the sensor configured to produce a sensor signal indicative of the position of the moveable element may be any appropriate sensor which measures relative displacement and uses this in combination with a known position in order to determine absolute position. In other embodiments the sensor configured to produce a sensor signal indicative of the position of the moveable element may only measure relative displacement. In further embodiments the sensor configured to produce a sensor signal indicative of the position of the moveable element may measure absolute position directly.

Some known labelling machines include a dancing arm which is mechanically linked to a brake assembly. In one example of these known labelling machines, if the tension within the label stock is too great then the tension in the label stock will cause the dancing arm to move so that a brake which forms part of the brake assembly and which is mechanically linked to the dancing arm is released to thereby reduce braking force acting on the supply spool support and thereby reduce the tension in the label stock. Conversely, if the tension in the label stock is too little, the tension in the label stock will cause the dancing arm to move such that the brake applies an increased braking force to the supply spool support to thereby increase tension in the label stock.

These known labelling machines suffer from several problems. First, the system can oscillate such that the dancing arm oscillates between two positions whilst trying to maintain tension in the label stock. This can be problematic due to the fact that the oscillating nature of the system may cause the label stock to become misaligned on the rollers which define the web path and hence become misaligned when it reaches the labelling peel beak. This may lead to incorrect positioning of labels on to a product or may lead to the labelling machine becoming jammed Secondly, the oscillating nature of the dancing arm means that the movement of the dancing arm is not entirely predictable. As such, there is the possibility that the dancing arm will collide with other parts of the labelling machine or may present a hazard to a user operating the labelling machine. The labelling machine according to some of the embodiments described herein provides a way of obviating or mitigating at least one of these problems.

The dancing arm position is indicative of the tension within the label stock due to the fact that the dancing arm is mounted for rotation about axis A and is biased in the direction G by the spring 130. It will be appreciated that direction G in FIG. 2 is opposite to direction G in FIG. 7 because FIGS. 2 and 7 show opposite sides of the labelling machine, and in particular of the supply spool support and attached brake disc. Due to the fact that the spring 130 is a variable force spring (i.e. a spring which generally obeys Hooke's Law), the force exerted by the spring will vary with the position of the dancing arm 28 (and hence the amount of extension of the spring). In particular, the greater the extension of the spring i.e. the further the dancing arm 28 is rotated about axis A in the direction opposite to that indicated by G the greater the force exerted by the spring (in order to urge the dancing arm 28 in the direction G) will be. A component of the force applied by a spring 130 to the dancing arm will, in use, be applied to the label stock 20, thereby providing a tension within the label stock 20. Consequently, some embodiments described herein allow the dancing arm 28 to be maintained in a substantially constant position to thereby maintain tension in the label stock 18 substantially constant. For example, in some embodiments, the dancing arm may be maintained in a position such that if the labelling machine is orientated as shown in FIG. 2 the dancing arm 28 is substantially horizontal.

In order to control the position of the dancing arm 28, an embodiment of the present invention is provided with a sensor configured to produce a sensor signal indicative of the position of the dancing arm 28. In this case the sensor is the magnetic sensor previously discussed which measures the change in magnetic field caused by the movement of the multipole strip magnet which is affixed to a portion of the dancing arm 28.

It will be appreciated that, although the moving element of this embodiment is a dancing arm, it is within the scope of the invention for the moveable element to be any appropriate moveable element which can define a portion of the web path. Furthermore, it will also be appreciated that although the sensor of this embodiment is the magnetic sensor as described, any appropriate sensor which is configured to produce a sensor signal indicative of the position of the moveable element may be used.

The present embodiment of the invention also includes a brake assembly configured to apply a variable braking force to one of said spool supports (in this case the supply spool support, however, in other embodiments, it may be the take up spool). The brake assembly may apply the variable braking force based upon the sensor signal indicative of the position of the moveable element. It will be apparent that the braking force applied to the supply spool support will resist rotation of the supply spool support (and hence of the supply spool supported by the supply spool support).

This arrangement has the advantage that, unlike the known labelling machines in which the dancing arm is mechanically linked to a brake of a brake assembly, the position of the dancing arm 28 is mechanically decoupled from the braking force which is applied to the supply spool by the brake assembly. By mechanically decoupling the brake assembly from the dancing arm it is possible for processing to be performed on the sensor signal indicating dancing arm position so as to calculate what braking force should be applied to the supply spool support by the brake assembly.

In one embodiment, the brake assembly previously discussed which utilises a controlled solenoid to provide a variable braking force via a brake belt acting on a brake disc may be used. In this situation, the braking force applied to the supply spool support 10 via the brake belt 76 and brake disc 74 depends upon the position of the armature 92 of the solenoid 94.

The control scheme used in order to control the current supplied to the coil of the solenoid in order to position the armature of the solenoid at a desired location relative to the coil has already been discussed and so will not be repeated here. However, that control scheme requires that the control algorithm as shown schematically in FIG. 14 is provided with a set point signal SP(t). The set point signal SP(t) is determined by a second control algorithm which will be referred to as the dancing arm position control algorithm.

The dancing arm position control algorithm is implemented by a controller (which may or may not be the same controller as previously discussed controllers). A schematic view of the dancing arm position control system which includes the dancing arm position control algorithm implemented by the controller is shown schematically in FIG. 17.

The controller is provided with a dancing arm position set point signal SP2(*t*) which is indicative of the desired position of the dancing arm (and hence the desired tension within the label stock) at any given time. For example, in some embodiments the dancing arm position set point signal SP2(*t*) may correspond to a position of the dancing arm such that if the labelling machine is the same as that in FIG. 2, the dancing arm may be substantially horizontal. Of course, in other embodiments the dancing arm position set point signal SP2(*t*) may correspond to any desired dancing arm position. The dancing arm position set point signal SP2(*t*) is provided to one input of a subtractor 200. Another input of the subtractor 200 is supplied with a feedback signal FB2(*t*) (described below) and the subtractor 200 outputs an error signal E2(*t*) which is the difference between the dancing arm position set point signal SP2(*t*) and the feedback signal FB2(*t*).

The error signal E2(*t*) is supplied to three portions of the PID algorithm. These are the proportional component P, the integral component I, and the derivative component D. As can be seen from the figure, the proportional component P outputs a signal which is given by a constant $K_{P2}$ multiplied by the error signal E2(*t*). The integral component I outputs a signal which is a constant $K_{I2}$ multiplied by the integral of the error signal E2(*t*). The derivative component D of the algorithm outputs a signal which is given by a constant $K_{D2}$ multiplied by a derivative of the error signal E2(*t*) with respect to time.

An adder 202 combines the signals output by the proportional P, integral I and derivative D components of the algorithm. The output of the adder 202 is a signal which is indicative of the desired position of the solenoid armature relative to the coil in order to produce a desired braking force which acts on the supply spool support. Consequently, the output of the adder 202 may be referred to as the set point signal SP(t) which forms part of the solenoid armature position control scheme described earlier. Consequently, the signal SP(t) output by the adder 202 is provided to a solenoid armature position control scheme 204 which was described above with reference to FIG. 14.

By controlling the braking force which is applied by the brake assembly to the supply spool support, as previously discussed, this will affect the tension within the label stock and consequently affect the position of the dancing arm 28.

The position of the dancing arm 28 is measured by the magnetic sensor 206 which has previously been described. The magnetic sensor 206 outputs a sensor signal indicative of the position of the dancing arm. This signal constitutes the feedback signal FB2(*t*) which is provided to the first subtractor 200. It is preferred that the value of the signal FB2(*t*) should increase as output of the adder 202 (i.e. the control signal to the brake assembly via the solenoid armature position control scheme) is increased. If this is not the case then the same functionality may be achieved by swapping over the inputs to the subtractor 200.

Any appropriate gain constants $K_{P2}$, $K_{I2}$ and $K_{D2}$ may be used. In some embodiments, at least one of these constants may be equal to zero. However, in a preferred embodiment, all of these constants are non-zero.

As is common in the art, the gain constants $K_{P2}$, $K_{I2}$ and $K_{D2}$ of the dancing arm position control algorithm and the gain constants $K_P$, $K_I$ and $K_D$ of the solenoid armature position control algorithm may be determined empirically or by using commercially available PID tuning software. In either case, it is desirable that the value of the gain constants $K_{P2}$, $K_{I2}$ and $K_{D2}$ of the dancing arm position control algorithm are chosen such that the signal SP(t) output by the dancing arm position control algorithm to the solenoid armature position control algorithm has values which are substantially between the minimum braking value and the maximum braking value.

In some embodiments, the PID control algorithm may incorporate a dead band. In such embodiments, the error signal E2(*t*) is set to zero if the feedback signal FB2(*t*) is within a given range of the set point signal SP2(*t*). For example, the dead band may operate such that if the difference between the set point signal SP2(*t*) and the feedback signal FB2(*t*) is less than ±5% of the set point signal SP2(*t*) (or of the maximum possible value of the set point signal, which corresponds to a desired maximum braking value or a desired minimum braking value of the set point signal) then the error signal E2(*t*) is set to zero. If the feedback signal FB2(*t*) falls outside of this range then the error signal E2(*t*) is calculated in the manner already described by the subtractor 200.

As previously discussed, other embodiments incorporating a dead band may function in a slightly different manner. These embodiments operate in the same manner as the dead band previously described except that if the feedback signal FB2(*t*) falls outside of dead band then the error signal E2(*t*) is calculated by calculating the difference between the feedback signal FB2(*t*) and the edge of the dead band which is closest to the feedback signal FB2(*t*). For example, if the dead band is ±5% of the set point signal SP2(*t*), and the feedback signal FB2(*t*) has a value of the set point signal SP2(*t*) plus 5% of the set point signal SP2(*t*) plus μ, then the value of the error signal is −μ. Likewise, if the dead band is ±5% of the set point signal SP2(*t*), and the feedback signal FB2(*t*) has a value of the set point signal SP2(*t*) minus 5% of the set point signal SP2(*t*) and minus then the value of the error signal is μ. In another embodiment, if the dead band is ±5% of the maximum possible set point (which corresponds to a desired maximum braking value or a desired minimum braking value of the set point signal), and the feedback signal FB2(*t*) has a value of the set point signal SP2(*t*) plus 5% of the set point signal SP2(*t*) plus μ, then the value of the error signal is −μ. Likewise, if the dead band is ±5% of the maximum possible set point signal SP2(*t*), and the feedback signal FB2(*t*) has a value of the set point signal SP2(*t*) minus 5% of the set point signal SP2(*t*) and minus then the value of the error signal is μ.

In some embodiments, the derivative term D within the PID algorithm may be calculated not as a function of the derivative of the error signal E2(*t*), but rather by multiplying a speed of the dancing arm by a constant $K_{s2}$. The speed of the dancing arm may be calculated based upon the rate of change of the magnetic field detected by the magnetic sensor as the multipole magnetic strip attached to a portion of the dancing arm moves past the magnetic sensor. Alternatively, the speed of the dancing arm may be calculated based upon the rate of change of the signal output by the magnetic sensor.

In some embodiments, the dancing arm position control algorithm may be implemented such that if the measured dancing arm position differs from the desired dancing arm position set point in a direction such that the brake must be applied in order to bring the dancing arm position towards the set point, the algorithm may provide an output to the braking assembly which causes the braking assembly to apply the maximum braking force, the braking assembly only applying less than the maximum braking force when the measured dancing arm position differs from the desired dancing arm position set point in a direction opposite to that in which the brake must be applied in order to bring the dancing arm position towards the set point. When the measured dancing arm position differs from the desired dancing arm position set point in a direction opposite to that in which the brake must be applied in order to bring the dancing arm position towards the set point a PID algorithm as discussed above may be implemented in the usual way—in other words, a non-symmetric PID algorithm may be used.

In some embodiments, the integral term of the PID algorithm may have a relatively small constant $K_{I2}$ or the set point for the integral term may be different to the set point for the proportional and differential terms. This may be useful in control systems which include an integral term because the integral portion of the PID algorithm 'remembers' previous positions of the dancing arm and hence attempts to apply an incorrect correction to that which is required. For example, the correction determined by the integral term may be greater than required, less than required or in the wrong direction. This problem may occur when a labelling machine is in a first steady state (for example, continual dispensing of labels at a first rate) and then changes to a second steady state (for example, continual dispensing of labels at a second rate). It may take time for the integral term to change its output from the ideal value for the first state, to the ideal value for the second state. In such a situation the integral term may be incorrect for a period of time after the operation of the labelling machine changes to the second state.

In order to mitigate the problem described above, in some embodiments, the set point for the integral component of the PID algorithm may be equivalent to a dancing arm position which, if the labelling machine is orientated as shown in FIG. 2, is about 5 degrees clockwise from the set point position for the proportional and differential terms. Furthermore, in some embodiments, a limit to the degree of effect which the integral term may contribute to the overall amount of correction may be applied. For example, the contribution of the integral term to the applied braking may be limited. In one example, if the braking force is provided by a braking assembly including a stepper motor as shown in FIGS. 18 to 20, the contribution of the integral term of the PID sum may be limited to an equivalent of 50 microsteps of the stepper motor.

In the above described embodiment the controller implements the dancing arm position control algorithm such that the controller evaluates and applies the PID algorithm 1000 times per second. In other embodiments the controller may evaluate and control the dancing arm position at any appropriate rate.

It will be appreciated that although within the presently described embodiment the dancing arm position control scheme includes a PID algorithm, other embodiments of the invention may use any appropriate control scheme so as to control the position of the dancing arm (or other suitable moving element).

Some embodiments the labelling machine may include a motive means which is configured to propel the web along the web path from the supply spool towards the take up spool. For example, the motive means may include a single motor which drives the take up spool support, motors which drive each of the take up spool support and supply spool support, or a motor driving a platen roller in combination with a motor driving at least one of the take up spool support and supply spool support. The controller may be configured to control both the motive means and the brake assembly based upon the sensor signal (in this case the signal output by the magnetic sensor) so as to urge the dancing arm towards a desired position. Urging the dancing arm towards a desired position is equivalent to attempting to obtain a desired tension in the label stock, for the reasons previously discussed. Consequently, the controller enables control of the motive means and the brake assembly based upon the sensor signal so as to obtain a desired tension in the label stock and maintain said tension in the label stock between predetermined limits.

The brake assembly 70 within the described embodiments is said to be capable of applying a variable braking force. This is because, the position of the armature of the solenoid determines the extension of the spring 82 and therefore the braking force applied to the spool support. The armature is controlled so that it can take any position between the extents of movement of the armature.

In other embodiments, the brake assembly need not be capable of applying a variable braking force. For example, in some embodiments the brake assembly may only have two states: a braked state and an un-braked state. In the braked state the brake assembly applies a greater braking force to the spool support than in the un-braked state. In one embodiment, the brake assembly may be controlled by the controller as a function of the sensor signal indicative of the position of the movable member (e.g. dancing arm) such that when the controller determines that the sensor signal indicative of the position of the movable member indicates that more braking force applied to the spool support is required, then the controller commands the brake assembly to enter its braked state. Conversely, the brake assembly may be controlled by the controller as a function of the sensor signal indicative of the position of the movable member (e.g. dancing arm) such that when the controller determines that the sensor signal indicative of the position of the movable member indicates that less braking force applied to the spool support is required, then the controller commands the brake assembly to enter its un-braked state.

In another embodiment in which the brake assembly has only braked and un-braked states, the brake assembly (in particular, in this case, the coil of the solenoid of the brake assembly) may be provided with a pulse width modulated signal (in this case a voltage signal across the coil of the solenoid). A coil driver which is controlled by the controller may control the duty cycle of the pulse width modulated voltage signal applied across the coil as a function of the sensor signal provided to the controller which is indicative of the position of the movable member.

By varying the duty cycle of the pulse width modulated voltage applied across the coil of the solenoid, the current supplied to the coil can be changed. This results in a change in the position of the armature of the solenoid relative to the coil and hence a change in the braking force applied by the brake assembly to the spool.

Although the above described embodiment discusses urging the moveable element (e.g. dancing arm) towards a desired position (for example, by setting a desired dancing arm position set point within the dancing arm position control algorithm) in order to control the tension of the label stock. In other embodiments the movable element may be urged towards a desired position for any other appropriate purpose.

For example, in some embodiments the movable element may be biased by a constant force spring (i.e. such that the spring does not obey Hooke's Law). In such embodiments, because the force applied to the movable element by the spring is substantially constant regardless of the position of the movable element, the tension of the label stock will be substantially constant regardless of the position of the movable element. It follows that, in such embodiments, moving the movable element will not change the tension in the label stock and hence urging the movable element towards a desired position cannot be used to set tension in the label stock.

Regardless of what type of biasing means biases the movable element, because the movable element defines a portion of the web path, movement of the movable element will cause the path length of the web path between the supply and take-up spools to change. Changing the path length of the web path between the supply spool and take-up spool may allow differences between the speed at which the take up spool is taking up label stock and the speed at which the supply spool is paying out label stock to be accommodated. For example, if the take up spool support is driven to advance label stock along the web path and the take up spool support is accelerated, the take up spool may accelerate more quickly than the supply spool. This may be because the supply spool has a relatively large moment of inertia. This difference in acceleration between the take up spool and supply spool may be compensated for by the dancing arm moving so as to reduce the path length of the web path between the supply spool and take-up spool. Conversely, if the take up spool support is driven to advance label stock along the web path and the take up spool support is decelerated, the take up spool may decelerate more quickly than the supply spool. Again, this may be because the supply spool has a relatively large moment of inertia. This difference in deceleration between the take up spool and supply spool may be compensated for by the dancing arm moving so as to increase the path length of the web path between the supply spool and take-up spool.

If the movable element has a limited extent of movement, between a first extent at which the path length of the web path between the supply and take up spools is a maximum, and a second extent at which the path length of the web path between the supply and take up spools is a minimum, it may be desirable to urge the movable element towards a position which minimises the likelihood that the movable element will reach the limits of its extent of movement in trying to compensate for differences between the speed at which the take up spool is taking up label stock and the speed at which the supply spool is paying out label stock during operation of the labelling machine. If the movable element reaches a limit of its extent of movement then it will be unable to compensate for any further difference between the speed at which the take up spool is taking up label stock and the speed at which the supply spool is paying out label stock. The inability to compensate for any further difference between the speed at which the take up spool is taking up label stock and the speed at which the supply spool is paying out label stock may result in excess tension in the label stock (which may result in breakage of the label stock) or may result in too little tension in the label stock (which may result in the label stock becoming slack).

In some embodiments the position which minimises the likelihood that the movable element will reach the limits of its extent of movement may be a position which is substantially equidistant between the limits of its extent of movement. In other embodiments, the characteristics of the labelling machine may be such that the position which minimises the likelihood that the movable element will reach the limits of its extent of movement may be a position which is closer to one of the limits of its extent of movement than the other.

For example, in a labelling machine in which the take up spool support is driven to advance label stock along the web path and in which the supply spool can be braked, the position which minimises the likelihood that the movable element will reach the limits of its extent of movement may be closer to the limit of the extent of the movement of the movable element which corresponds to the maximum path length of the web path between the supply and take-up spools. The reason for this is that a brake on the supply spool support makes it a lot less likely that there will be a difference between the speed at which the take up spool is taking up label stock and the speed at which the supply spool is paying out label stock when the take-up and supply spools are decelerating. As such, the movable element is less likely to have to move in a direction towards the limit of the extent of movement of the movable element which corresponds to the maximum path length of the web path between the take-up and supply spools. It follows that the position which minimises the likelihood that the movable element will reach the limits of its extent of movement may be closer to the extent of the movement of the movable element which corresponds to the maximum path length of the web path between the supply and take-up spools.

FIGS. 18 and 19 show a perspective view of a portion of a further embodiment of labelling machine of the type shown in FIG. 1 or FIG. 2. FIG. 18 shows the dancing arm 28 and an alternative brake assembly 70*a*. The brake assembly 70*a* may be substituted for the brake assembly 70 shown in FIGS. 5 to 11.

As before, the dancing arm 28 and supply spool support (not shown within FIG. 18) are both mounted for individual rotation about a common axis A. In other embodiments, the supply spool support and dancing arm 28 may rotate about their own respective axes.

The brake assembly 70*a* is configured to apply a variable braking force to the supply spool support, the braking force resisting rotation of the supply spool support. Although the brake assembly 70*a* is configured to apply braking force to the supply spool support, in other embodiments the brake assembly 70*a* may be used to apply a braking force to the take-up spool support.

The brake assembly 70*a* includes a brake disc 74 which is attached to the supply spool support such that it co-rotates with the supply spool support (and consequently any supply spool which is supported by the supply spool support).

The brake assembly also includes a brake belt 76 which extends around part of the outer circumference 88 of the brake disc 74. The brake belt 76 is fixed at a first end 76*a* to an attachment pin 78 which is mounted to a mounting block 80*a* which is fixed so that it does not rotate with the supply spool support. The brake belt 76 is attached at a second end 76*b* to an end piece 82*a*. The end piece 82*a* includes a socket 82*b*.

In the embodiment shown, the brake belt 76 has a generally rectangular cross-section and it contacts a portion of the outer circumference 88 of the brake disc 74 which has a substantially flat surface parallel to the axis A. That is to say, the substantially flat circumferential surface 88 of the brake disc 74 corresponds to the substantially flat surface of the belt 76 which engages the outer circumference 88 of the brake disc 74. It will be appreciated that in other embodiments of the labelling machine, the outer circumferential surface of the brake disc and the brake belt may have any appropriate corresponding profile. For example the outer circumferential surface of the brake disc may include a v-shaped groove which cooperates with generally circular cross-section brake belt.

The brake belt 76 may be made from any appropriate material. For example, the brake belt may be made of a combination of fabric and polymeric material, a combination of metal and polymeric material or of a polymeric material on its own. In one embodiment the brake belt is made out of steel reinforced polyurethane. In one embodiment the brake belt may be 10 mm wide, 280 mm long and formed from material referred to as Habasit TG04. In another embodiment the brake belt is a T2.5 synchroflex timing belt which has a width of 10 mm and a length of 280 mm. In this case the belt is formed from steel reinforced polyurethane and has teeth having a standard T profile according to DIN7721. Such belts are available from Beltingonline, Fareham, UK. Because this belt has teeth it is mounted such that the flat surface of the belt (i.e. the opposite surface to that which has the teeth) is the surface which contacts the brake disc. In other embodiments the belt may be mounted such that the toothed side of the belt contacts the brake disc. In the above described embodiments the brake disc (which may be of any appropriate size in other embodiments) has a diameter of 100 mm.

A generally disc-shaped cam 82*c* (also referred to as cam piece) is mounted on the end of a shaft 82*d* which is supported for rotation relative to the mounting block 80*a* about an axis F via a bearing which supported by the mounting block 80*a*. The cam piece is 82*c* is mounted to the shaft 82*d* such that the cam piece 82*c* is eccentric with respect to axis F of rotation of the shaft 82*d*. The cam piece 82*c* is mounted to the shaft 82*d* such that the cam piece 82*c* rotates with the shaft 82*d* when the shaft 82*d* rotates about axis F. Furthermore, the cam piece 82 is received by the socket 82*b* of the end piece 82*a* such that the end piece 82*a* may freely rotate relative to the cam piece 82*c*. For example, a bearing may be located between cam piece 82*c* and end piece 82*a* to enable relative rotation therebetween.

The shaft 82*d* and attached cam piece 82*c* may be driven for rotation about axis F by any appropriate drive means. In some embodiments the drive means includes a position controlled motor which drives the shaft 82*d*. The position controlled motor may be any appropriate position controlled motor, for example a servo controlled motor or a stepper motor. In the present embodiment the shaft 82*d* is the shaft of the position controlled motor, the position controlled motor (indicated schematically by broken lines in FIG. 19) being mounted to the mounting block 80*a*. In other embodiments the shaft 82*d* may be mechanically linked to the position controlled motor by an appropriate linking arrangement. For example, the position controlled motor and shaft may be mechanically linked by a belt, chain or the like. In other embodiments the cam (cam piece) may be driven for rotation by a position controlled motor in any appropriate manner. For example, in some embodiments the cam may be driven for rotation by the position controlled motor without driving an intermediate shaft to which the cam is mounted—for example a belt driven by the position controlled motor may directly drive the cam.

In the described embodiment the position controlled motor is a stepper motor. In particular it is a 42 mm frame size Sanyo Denki motor (part number 103H5205-5210) marketed by Sanko Denki Europe SA, 95958 Roissy Charles de Gaulle, France.

Referring now to FIG. 19, the position controlled motor and attached cam piece 82 are shown in an initialisation position. It will be appreciated that if the position controlled motor is energised so as to rotate the shaft 82*d* and attached cam piece 82*c* in a clockwise direction (as shown in FIG. 19), then the end piece 82*a* may be urged in a direction (e.g.

towards the brake disc 74) such that the brake belt 76 is loosened around the brake disc 74. In other words, the tension in the brake belt 76 is reduced. Put another way, when the shaft 82*d* and attached cam piece 82*c* are rotated in a clockwise direction, the cam will urge (in this case via the end piece 82*a*) at least a portion of the second braking surface (the surface of the brake belt 76*b* which may contact the brake disc 74 in order to produce the braking force) towards the first portion of the belt 76*a* or in other words away from the cam or the second portion of the belt 76*b* (along the path of the brake belt between first and second ends 76*a*, 76*b*), thereby urging the second braking surface (i.e. the relevant surface of the belt 76) in a direction out of contact with the first braking surface (i.e. the braking surface of the brake disc 74). Consequently, energising the position controlled motor such that it causes the shaft 82*d* and attached cam piece 82*c* to rotate in a clockwise direction from the initialisation position shown in FIG. 19 will cause the braking force exerted by the belt 76 on the braking disc 74 (and hence attached spool support) to be reduced.

Conversely, if the position controlled motor is energised so as to rotate the shaft 82*d* and attached cam piece 82*c* in an anti-clockwise direction from the initialisation position shown in FIG. 19, then this will cause at least a portion of the brake belt 76 to be moved away from the first end 76*a* of the brake belt 76 (along the belt path between the first and second ends 76*a*, 76*b* of the belt 76). In other words, when the position controlled motor is energised such that the shaft 82*d* and attached cam piece 82*c* are rotated in an anti-clockwise direction from the position shown in FIG. 19, the tension in the brake belt 76 is increased, thereby increasing the braking force exerted on the brake disc 74. Put another way, then the cam (cam piece) is rotated in an anti-clockwise direction by the position controlled motor, the cam (cam piece) urges at least a portion of the second braking surface (surface of the belt 76 which contacts the brake disc 74 so as to apply the braking force) in a direction such that the second braking surface is urged towards the first braking surface (i.e. the outer circumference of the brake disc 74). In particular, the cam (cam piece 82*c*) urges a portion of the second braking surface towards the cam or second portion of the belt 76*b*, or in other words away from the first portion of the belt 76*a* and retaining pin 78 (along the path of the brake belt between first and second ends 76*a*, 76*b*).

In the way described above, the braking force applied to the spool support by the frictional interaction between the brake disc 74 and brake belt 76 can be controlled by controlling the position of the cam (e.g. cam piece 82*c*) using the position controlled motor. The brake assembly 70*a* is capable of applying a variable braking force to the supply spool support via the attached brake disc 74. Within this context, variable braking force may be taken to mean a range of braking forces, not merely a first braking force when the brake assembly is in a brake engaged position and a second lesser braking force when the brake assembly is in a brake disengaged position. For example, controlling the position controlled motor such that, in the context of FIG. 19, it causes the cam piece 82*c* to be rotated anti-clockwise will increase the braking force on the spool support, whereas controlling the position controlled motor such that the cam piece 82*c* is rotated clockwise will result in a reduced braking force applied to the spool support. It will be appreciated that within the embodiment shown in FIG. 19, if the cam piece 82*c* were rotated by more than about 90° clockwise or anti-clockwise from the initialisation position shown in FIG. 19, then the situation will be reversed (whilst the cam piece 82*c* is rotated by more than about 90° clockwise or anti-clockwise from the initialisation position)—i.e. further clockwise movement will result in increased braking force and anti-clockwise movement will result in decreased braking force.

Although within the previously described embodiment the first braking surface is the outside diameter of the brake disc 74 and the second braking surface is the surface of the brake belt 76, which can contact the brake disc, in other embodiments the first and second braking surfaces may be any appropriate first and second braking surfaces provided that when the first and second braking surfaces are urged into contact (or together, or towards one another) via the position controlled motor, friction between the first and second braking surfaces thereby producing the braking force. For example, the second braking surface may, in some embodiments, not be a brake belt—for example, it may be a brake pad, brake shoe etc. Likewise, the first braking surface may not form part of a brake disc. Any appropriate cooperating first and second braking surfaces and corresponding braking method may be used.

A resilient biasing member (which in this embodiment is a spiral spring 82*e*, but may be any other appropriate resilient biasing member) biases the shaft 82*d* and attached cam piece 82*c* in a direction such that, within FIG. 19, the shaft 82*d* and cam piece 82*c* are urged in an anti-clockwise direction.

In the illustrated embodiment the spiral spring has a 25.4 mm outer diameter and an 11 mm inner diameter. The spring consists of 4.5 turns of 0.31 mm thick spring steel having a width of 3.20 mm and produces 33.6 Nmm of force at 1.5 turns of deflection from its natural state. Of course, any appropriate type of spiral spring may be used in other embodiments.

The spiral spring 82*e* is fixed at a first, outer end to the mounting block 80*a* by fixing bolt 82*f* and at a second inner end (not shown) to the cam piece 82*c*. The resilient biasing member biases the cam piece 82*c* in a direction to cause the brake belt 76 to contact the outer circumference 88 of the brake disc 74 so as to apply a braking force to the brake disc 74 and therefore resist rotation of the brake disc 74 and attached spool support. The biasing of the cam by the resilient biasing member (and hence the biasing of the brake belt towards the brake disc) ensures that when no power is supplied to the position controlled motor (for example when the labelling machine is powered down), the resilient biasing member causes a braking force to be applied to the brake disc 74 and hence the spool support. This may help to prevent the spool support from undesirably rotating when the labelling machine is powered down.

During use of the labelling machine, if it is desired to reduce the amount of braking force applied by the brake belt 76 to the brake disc 74 (and hence to the spool support) the position controlled motor is energised such that the biasing force produced by the resilient biasing means is overcome in order to enable rotation of the cam in a clockwise direction as shown in FIG. 19.

As previously discussed, by controlling the position controlled motor such that the rotary position of the shaft 82*d* and attached cam piece 82*c* is controlled, the amount of braking force applied to the spool support via the brake disc 74 can be varied. A position controlled motor controller may be used to control the position of the position controlled motor and hence the position of the cam piece 82*c* to thereby control the braking force. The position controlled motor controller may be configured such that it is programmed with a position which corresponds to a maximum braking force to be applied and a position which corresponds to a minimum braking force to be applied. In such embodiments, in order to control the braking force applied by the braking assembly, the position controlled motor is controlled such that, as required, its position is the position which corresponds to the maximum braking force; its position is the position which corresponds to the minimum braking force; or its position is between these two positions.

In some embodiments, the cam piece 82*c* may be urged in a direction by a resilient biasing member which urges the brake assembly to apply a braking force to one of the spool supports as previously discussed. The resilient biasing member acting on the cam may define a bias force defined maximum braking position of the cam and attached motor. The bias force defined maximum braking position corresponds to the position of the cam piece and attached motor when the resilient biasing means applies a given biasing force to the cam piece when the motor of the braking assembly is de-energised.

The position controlled motor controller may be programmed with the angular distance between a maximum braking position (for example the bias force defined maximum braking position, although any appropriately defined maximum braking position may be used) and a minimum braking position of the position controlled motor. The angular distance may, for example, be a number of encoder pulses produced by a servo motor or a number of steps of a stepper motor. However, any appropriate parameter may be programmed into the controller which corresponds to the angular distance between the maximum braking position and the minimum braking position of the position controlled motor. In such an embodiment, when the machine is started up, the position controlled motor controller will know that the current position of the position controlled motor is a maximum braking position which is equivalent to the bias force defined maximum braking position (because in the powered-down state of the labelling machine the resilient biasing means has biased the cam piece into the bias force defined maximum braking position) and that the minimum braking position of the position controlled motor is substantially a clockwise rotation of the cam piece by said known angular distance between the maximum braking position and the minimum braking position.

For example, if the position controlled motor is a stepper motor, then the position controlled motor controller may be programmed with information about the angular distance between the maximum braking position of the stepper motor and the minimum braking position of the stepper motor in the manner of a known number of motor steps. Of course, the exact number of steps will depend on many variables such as the particular type of stepper motor used, the type of mechanical linkage between the stepper motor and the cam piece, and the geometry of the braking arrangement.

In one embodiment of the present invention, the position controlled motor is a stepper motor. In this embodiment the stepper motor has 200 full steps per complete rotation. The stepper motor is driven by a stepper motor driver such that it is microstepped, as is well known in the art. In this embodiment each full step is split into 8 microsteps. Therefore, in this embodiment, there are 1600 microsteps per complete rotation. Other embodiments may utilise a stepper motor which has any appropriate number of steps/microsteps per full rotation.

The cam piece 82*c* may be urged towards a bias force defined maximum braking position by a resilient biasing member as previously discussed. When the labelling machine (and hence stepper motor) is in a powered off state the cam piece and attached stepper motor will be biased into the bias force defined maximum braking position by the resilient biasing member. When the labelling machine (and hence stepper motor) is energised from the powered off state the cam piece and stepper motor will enter the initialisation position as shown in FIG. 19. The initialisation position may be slightly different to the bias force defined maximum braking position. The reason for this is that, when energised, the stepper motor rotor will move from the bias force defined maximum braking position to the closest stable position of the stepper motor rotor relative to the stepper motor stator. This may result in a movement between the bias force defined maximum braking position and initialisation position of up to 2 steps (equivalent to 16 microsteps in this case) either clockwise or anticlockwise. In order to compensate for the fact that in the initialisation position the cam may cause the brake belt to apply a braking force which is less than the bias force defined maximum braking force, upon initialisation the controller commands the stepper motor to rotate 2 steps (16 microsteps) anticlockwise (as shown in FIG. 19) from the initialisation position. This position may be referred to as the compensated maximum braking position. The controller stores this position as the position of the stepper motor which corresponds to maximum applied braking force. The controller also sets the position of the stepper motor which corresponds to minimum applied braking force to be 355 microsteps clockwise rotation from the position of the stepper motor which corresponds to maximum applied braking force.

It will be appreciated that the compensated maximum braking position (and hence compensated maximum braking force) will be the same as the bias force defined maximum braking position in the case where the initialisation position is 2 steps clockwise of the bias force defined maximum braking position. Otherwise, if the initialisation position is 1 step clockwise of the bias force defined maximum braking position, the same as the bias force defined maximum braking position, or 1 or 2 steps anti-clockwise of the bias force defined maximum braking position, then the compensated maximum braking position will be anti-clockwise of the bias force defined maximum braking position, and hence the braking force at the compensated maximum braking position may be greater than the braking force at the bias force defined maximum braking position. In the case that the position controlled motor is a stepper motor, the position controlled motor controller may include a stepper motor driver. Where the position controlled motor is another type of motor, the person skilled in the art will appreciate that the position controlled motor controller will include appropriate drive means for the relevant type of motor.

The position controlled motor controller may replace the solenoid armature position control scheme 204 within the dancing arm position control algorithm shown schematically in FIG. 17. The constants $K_{P2}$, $K_{I2}$, and $K_{D2}$ within the dancing arm position control algorithm may be suitably adjusted to ensure that the set point value SP(t) provided to the position controlled motor controller fall within a suitable range for the position controlled motor controller. The position controlled motor controller may then be configured to convert the set point signal SP(t) into a desired position of the position controlled motor which is between the maximum braking position and minimum braking position. For example, in one embodiment $K_{P2}$=0.6, $K_{I2}$=0.005, and $K_{D2}$=0.6.

In general terms, the dancing arm position control algorithm will co-operate with the position controlled motor controller such that if the dancing arm position is different to the desired dancing arm position, the position controlled motor controller will actuate the braking assembly in order to try to move the dancing arm towards to desired dancing arm position. In general, the greater the difference between the dancing arm position and the desired dancing arm position, the greater the magnitude of the change in dancing arm position that the position controlled motor controller will effect in order to attempt to correct the dancing arm position. For example, if the position controlled motor is a stepper motor, the greater the difference between the dancing arm position and the desired dancing arm position, the greater the number of steps the position controlled motor controller will effect in a given time in order to attempt to correct the dancing arm position. It will be appreciated that the exact behaviour of the position controlled motor controller will be determined by the dancing arm position control algorithm.

In embodiments of the invention in which the braking assembly includes a position controlled motor in the form of a stepper motor, the controller may be configured such that it implements a control scheme for controlling the stepper motor which reduces the likelihood of the stepper motor stalling and thereby preventing operation of the braking assembly. Such a control scheme may include any number of the following aspects. First, a 'start delay' may be used which prevents the stepper motor from executing a step until a predetermined amount of time has passed from the motor coils of the stepper motor being energised. This helps to ensure that the motor is in a steady state before it starts operating. In some embodiments the predetermined amount of time is 2 ms, but any appropriate time may be used in other embodiments. Secondly, a turn-around delay may be implemented. This prevents the stepper motor from executing a step in the opposite direction to that in which the motor is currently travelling within a predetermined amount of time of the previous step. In some embodiments the predetermined amount of time is 5 ms, but any appropriate time may be used in other embodiments.

As previously discussed, the brake assembly 70*a* is configured such that in a powered down state of the labelling machine the brake assembly applies a braking force to the spool support such that the spool support and supported spool is substantially prevented from rotating. In some situations it may be desirable to provide a manual override for the brake assembly which enables a user to manually reduce the braking force applied by the brake assembly whilst the machine is in a powered-down state. For example, if the spool support which is braked by the braking assembly is the supply spool support, and if it is desired to mount a new roll of label stock to the supply spool support whist the machine is powered off, it may be beneficial for the supply spool support and attached supply spool to be able to rotate so that the label stock can be mounted on the supply spool, pulled from the supply spool, fed along the label path and then attached to the take up spool support.

FIG. 20 shows an arrangement which enables the braking force applied by the braking assembly to be manually reduced whilst the labelling machine is in a powered down state. In this embodiment the dancing arm 28*a* includes a brake release arm 28*b* which is attached to the dancing arm 28*a* such that the brake release arm 28*b* co-rotates with the dancing arm 28*a*.

A brake release catch 28*c* is mounted on the shaft 82*d* which supports the cam piece 82*c* (the cam piece is not shown in FIG. 20, but located on the other side of the mounting block 80*a* to the brake release catch 28*c*). In the present embodiment the shaft 82*d* is the shaft of the position controlled motor. The shaft 82*d* extends out of both ends of the position controlled motor such that the cam piece 82*c* is mounted to the portion of the shaft 82*d* which extends out of a first end of the position controlled motor (and which in this case is on a first side of the mounting block 80*a*), and such that the brake release catch 28*c* is mounted to a portion of the shaft 82*d* which extends out of a second end (opposite to the first end) of the position controlled motor (and which in this case is on a second side (opposite the first side) of the mounting block 80*a*).

It will be appreciated that, whilst in this embodiment the brake release catch is mechanically linked to the second braking surface via the shaft 82*d*, cam piece 82*c* and end piece 82*a*, in other embodiments the brake release catch may be mechanically linked to the second braking surface in any appropriate manner. For example, in some embodiments the second braking surface may not be mechanically linked to a position controlled motor and the brake release catch may be mechanically linked to the second braking surface by another method. The brake release arm 28*b* and brake release catch 28*c* are configured such that when the dancing arm 28*a* is rotated clockwise as shown in FIG. 20 beyond a certain position, the brake release arm 28*b* engages the brake release catch 28*c*. Once the brake release arm 28*b* and brake release catch 28*c* are engaged, further clockwise rotation of the dancing arm 28*a* causes the brake release catch 28*c* to rotate the shaft 82*d* in anti-clockwise direction as shown in FIG. 20. This causes the brake release catch 28*c* to rotate the shaft 82*d* in an anti-clockwise direction as shown in FIG. 20. Referring now to FIG. 19, rotation of the shaft 82*d* within FIG. 20 in an anti-clockwise direction as shown in FIG. 20 will result in the cam piece 82*c* within FIG. 19 rotating in a clockwise direction as shown in FIG. 19, thereby reducing tension in the brake belt 76 and hence releasing the brake, reducing the braking force applied by the brake assembly to the spool support. It follows that, using the brake release arrangement shown in FIG. 20, if an operator wants to release the braking force applied by the braking assembly, this can be achieved by the operator rotating and holding the dancing arm in a clockwise direction as shown in FIG. 20 such that the brake release arm 28*b* and brake release catch 28*c* engage so as to cause the braking force applied by the brake assembly to be released as previously discussed. In some embodiments the dancing arm may be rotated and held in a clockwise direction as shown in FIG. 20 by the action of a user passing label web from a new supply spool mounted to the supply spool support around the dancing arm and the user pulling the label web along the web path to the take up spool support. In this way, when a user is feeding label web along the web path to the take up spool support from a newly mounted supply spool, the brake assembly is automatically released thereby enabling the supply spool support to pay out label web from the supply spool.

Although the above described braking assembly utilises a position controlled motor, in other embodiments any appropriate type of motor may be used, providing the control scheme for its operation is suitably modified. For example, in some embodiments a torque controlled motor such as a DC motor may be used. In such an embodiment, as is well known in the art, the amount of braking force applied by the motor is proportional to the current supplied to the motor. Consequently, the control scheme for such an embodiment may be configured such that the current supplied to the motor is a function of the braking force required. For example, the output of the dancing arm position control algorithm may be a current determined by the dancing arm position control algorithm which is provided to the motor.

Furthermore, in the above described braking assembly movement of the motor is transmitted to the brake belt via a cam. In other embodiments any appropriate means may be used for transmitting movement of the motor to the brake belt (or any suitable second braking surface). For example, the motor may be linked to a crank which is moved by the motor so a portion of the brake belt is wound on to the crank or unwound from the crank by the motor in order to urge the second braking surface towards the first braking surface (or otherwise) and thereby control the braking force applied to the spool support.

The desired tension within the label stock (and hence the desired position of the dancing arm) may be dependent on various factors. For example the desired tension may be greater than the minimum tension required to keep the label stock taut enough as it passes a print head so that the printer can successfully print on the labels of the label stock. In addition, the desired tension may be dependent on the width and/or thickness of the web of the label stock (i.e. perpendicular to the web path). The desired tension may be chosen such that the stress within the web of the label stock (which is given by the tension in the web divided by the cross sectional area of the web; where the cross sectional area of the web is the product of the width of the web and the thickness of the web) is less than the breaking stress of the web. This ensures the tension in the web does not lead to the web of the label stock snapping. For example, in some embodiments, the desired tension in the web may be between 1N and 50N.

In some labelling machines the desired tension of the label stock is determined (e.g. calculated) by a controller based upon the width of the label stock and is subsequently set. In some labelling machines the width of the label stock is input into the controller of the labelling machine by a user. In some applications, reliance on a user inputting the width of the label stock may lead to problems. For example, if the width of the label stock is inputted incorrectly, then the labelling machine may incorrectly determine and set tension within the label stock. Incorrect label stock tension may lead to the label stock breaking or to the label stock being fed incorrectly by the labelling machine.

A labelling machine in accordance with an embodiment of the invention is capable of determining a measure indicative of the width of the label stock as described below.

The labelling machine includes a spool support configured to support a spool of label stock, a rotation monitor configured to monitor rotation of the spool support and a torque application member.

The torque application member is configured to (either directly or indirectly) apply a known torque to the spool support (and any supported spool). For example, the torque application member may be a movable member, such as a dancing arm, which is configured to apply a known force to the label stock. The force applied to the label stock by the movable member results in a tension in the label stock which applies a torque to the spool support via the spool of label stock supported by the spool support. It can be said that the movable member applies a torque to the spool support indirectly—in this case torque is applied to the spool support by the movable member via the label stock. In another example, the torque application member may be a motor, such as a DC motor. The motor mechanically linked to the spool support may be energised to apply a known torque to the spool support. It can be said that motor applies torque to the spool support directly because it is mechanically linked to the spool support.

The torque application member is configured such that the torque applied to the spool support causes the spool support to be accelerated such that it rotates, also referred to as angular acceleration. The rotation (change in angular position) of the spool support due to this angular acceleration is measured by the rotation monitor. For an applied torque T the angular acceleration A is related to the moment of inertia MI by the following equation:

$$T=\mathrm{MI}\cdot A \tag{19}$$

The rotation monitor provides a signal to a controller which is indicative of the rotation of the spool support and supported spool. The controller is configured to determine the angular acceleration of the spool support based on the signal indicative of the rotation of the spool support. Based on the angular acceleration of the spool support determined by the controller and the known torque applied to the spool support by the torque application member, the controller can determine the total moment of inertia of the spool support and supported spool.

The controller is also provided with information concerning the moment of inertia of the spool support. The controller can subtract the contribution to the total moment of inertia of the spool support from the total moment of inertia so as to determine the moment of inertia of the supported spool.

The controller is further provided with information concerning the outer diameter of the spool supported by the spool support and the outer diameter of the spool support. If the supported spool is modelled as a thick-walled cylinder then the moment of inertia I of the cylinder is given by $$I=\frac{1}{2}m(r_1^2+r_2^2) \tag{20}$$

where $r_1$ is the outer radius of the spool support, $r_2$ is the outer radius of the supported spool and m is the mass of the supported spool. Based on this the controller can determine the mass of the supported spool of label stock. Again, modelling the spool as a thick-walled cylinder, the mass of the spool of label stock is given by $$m=\rho\pi w(r_2^2-r_1^2) \tag{21}$$

where ρ is the average density of the spool of label stock and w is the width of the label stock. Consequently, the controller is provided with the average density of the spool of label stock and based on this and the equation above the controller can determine the width of the spool of label stock supported by the spool support.

The average density of the spool of label stock will differ for different types of label stock. In some embodiments the average density of the spool of label stock is known and inputted to the controller by a user or is determined by any appropriate known density determining method. In other embodiments a fixed value for the average density of the spool of label stock is used regardless of what type of label stock is mounted to the spool support. This is possible because the majority of types of label stock have a similar average density of the spool of label stock. In these embodiments, because the average density of the spool of label stock used by the controller to determine the width of the label stock is an approximation, the width of the spool of label stock determined by the controller will also be an approximation. However, this approximate width of the spool of label stock, or indication of the width of the spool of label stock is, in some embodiments, sufficient for the controller to determine a correct tension to be applied to the label stock as indicated above.

In some embodiments, the labelling machine includes a supply spool support, take up spool support, motive means configured to move label stock from the supply spool support to the take up spool support, a brake assembly configured to apply a braking force to the supply spool, and a movable member (e.g. a dancing arm) which defines a portion of the web path between the supply spool support and take up spool support. The movable member is biased towards a home position by biasing means (e.g. a spring). The biasing means may include a biasing member. Movement of the movable member away from the home position, against the action of the biasing member, causes the length of the web path between the supply spool support and take up spool support to decrease.

In this embodiment, the take up spool support, supply spool support, motive means, brake assembly, biasing member and movable member are as previously described, although it will be appreciated that in other embodiments any appropriate take up spool support, supply spool support, motive means, brake assembly, biasing member and/or movable member may be used.

In this embodiment, the width of the label stock is determined as follows. The brake assembly is provided with a signal by a controller such that it enters a braking mode in which the brake assembly applies a braking force to the supply spool which substantially prevents the supply spool support and supported supply spool from rotating. The motor which rotates the take up spool support and supported take up spool is energised by the controller in a direction such that it increases the tension within the label stock between the supply spool support and the take up spool support. The increase in tension in the label stock causes the dancing arm 28 to move away from its home position against the action of the spring 130. The controller energises the motor until the position of the dancing arm measured by the sensor configured to produce a sensor signal indicative of the position of the moveable element (in this case dancing arm 28) is a desired position.

Based on the position of the movable element and at least one known property of the biasing member which biases the movable member towards the home position the controller determines the force being applied by the movable member to the label stock when the movable member is at the desired position. In this case the at least one known property of the biasing member is the extension of the spring 130 and the spring constant (or rate) of the spring 130. Based on the force being applied to the label stock by the moveable member and the radius of the supply spool (which may be determined in any appropriate manner, including any of those discussed within the present application) the controller can determine the torque applied to the supply spool support and the supply spool by the movable member. Consequently, in this embodiment, the movable member is the torque application member.

The brake assembly is provided with a signal from the controller such that it enters an un-braked mode such that the brake assembly provides substantially no braking force to the supply spool. In the un-braked mode of the brake assembly the supply spool support (and supported supply spool) is free to rotate. The force applied to the label stock by the movable member due to the action of the biasing member causes the supply spool support and supported supply spool to undergo angular acceleration as discussed above. A rotation monitor, as discussed above, provides a signal to the controller which is indicative of the amount of rotation and/or rate of rotation of the supply spool. Based on this information, as discussed above, the controller can determine an indication of the width of the label stock which is supported by the supply spool support.

The embodiment discussed above requires a rotation monitor configured to monitor rotation of the spool support. The rotation monitor may monitor rotation of the supply spool support (and hence the supported supply spool) directly or in directly, For example, the rotation monitor may monitor rotation directly by using a tachometer mounted to the supply spool support. A further example of a rotation monitor which monitors rotation of the supply spool directly is a trigger device which produces a signal every time the spool support rotates through a given portion of a complete rotation. An example of a suitable trigger device has already been discussed earlier in this application.

An example of a rotation monitor which monitors the rotation of the supply spool indirectly is a movable member (for example a dancing arm) which monitors a change in the web path length between the supply spool support and take-up spool support. The change in web path length may be equivalent to the length of label stock which has been removed from the supply spool support. If the controller has information as to the diameter of the supply spool (which may be determined in any of the ways discussed within), then based on the change in web path length (and hence the length of label stock which is removed from the supply spool) the controller may calculate the amount and/or rate of rotation of the supply spool (and hence supply spool support). In some embodiments the movable member may be the dancing arm 28, whereas in other embodiments the movable member may be any appropriate movable member, for example a dancing arm which is not dancing arm 28. In some embodiments, the rotation monitor may monitor the rotation of the supply spool in a combination of both directly and indirectly.

In the embodiment described above an indication of the width of the label stock is measured with reference to the supply spool support and supported supply spool. It will be appreciated that in other embodiments an indication of the width of the label stock may be measured in the same manner as described above, but instead with reference to the take up spool support and supported take up spool.

In the embodiment discussed above, the torque is applied by the movable member (i.e. the torque application member) to the spool support and supported spool via the label stock. In this case it may be said that the torque is applied to the spool support and supported spool by the torque application member in an indirect manner (i.e. via an intermediate—in this case the label stock). In other embodiments the torque may be applied to the spool support and supported spool in any appropriate manner. For example, the torque may be applied directly to the spool support. In one example the spool support is linked to a DC motor which can rotate the spool support. The torque applied to the spool support (and supported spool) is proportional to the current supplied to the DC motor. Consequently, by calibrating the DC motor such that the relationship between torque and applied current is known, and by measuring the current supplied to the motor, the controller can determine the torque provide to the spool support and supported spool. It follows that in this embodiment the DC motor is the torque application member.

As previously discussed, and as seen best in FIG. 3, an embodiment of the present invention includes a gap sensor including an electromagnetic radiation source 50 and an electromagnetic radiation detector 52.

Known labelling machines which incorporate a gap sensor of this type may incorrectly sense the edge of certain labels. This is explained further in conjunction with FIGS. 21 to 23.

FIG. 21 shows a portion of label stock 18 which may pass between the electromagnetic radiation detector 52 and the electromagnetic radiation transmitter 50 of the gap sensor. The label stock has a width $W_{LS}$. The position on the label stock 18 at which the beam of electromagnetic radiation 58 passes through the label stock 18 (as the label stock 18 moves past the beam of electromagnetic radiation 58) is indicated by a line h. It can be seen that the line h is located approximately halfway across the width $W_{LS}$ of the label stock 18. As the label stock 18 travels along the web path in the direction C the gap sensor will detect the leading edge of label 62 when the label stock 18 is aligned with the gap sensor such that the beam 58 of electromagnetic radiation produced by the electromagnetic transmitter 50 of the gap sensor passes through point H. The gap sensor then provides a signal to a controller to indicate the position on the label stock at which a leading edge of a label has been detected.

The controller then advances the label stock 18 in the direction C a fixed 'feed' distance to dispense a label. If the label pitch of the label stock is larger than the distance $D_B$ (shown in FIG. 3) then the feed distance will be approximately $D_B$. This distance $D_B$ is the distance between the edge 66 of the labelling peel beak 30 and the point at which the beam 58 of radiation passes from the transmitter 50 to the detector 52 as was described above. If the label pitch of the label stock is less than the distance $D_B$, then feed distance will be smaller than $D_B$. to ensure that only one label is dispensed. In either case the exact distance fed to dispense one label is usually provided with manual adjustment since different applications may require the label to stop at different places relative to the labelling peel beak 30.

Another reason why manual adjustment of the feed distance is generally provided is that known gap sensors typically have a single emitter and single detector and so only sense a single position along a label edge as shown by the line h in FIG. 21. This means that the position of the sensor will typically be manually moved, across the width of the label i.e. in a direction perpendicular to direction C, to accommodate different shapes and sizes of label. If the labels in use do not have leading edges which are straight and perpendicular to the direction of movement C, then the position of the gap sensor along a line perpendicular to the direction of movement C will affect the stopping position of the label. Such manual adjustment of the gap sensor can be a further source of variation in label positioning relative to the labelling peel beak 30.

FIGS. 22 and 23 show portions of two different label stocks 18*a*, 18*b* which have differently shaped labels, 62*b* and 62*d* respectively, compared to those shown in FIG. 21. More particularly, FIG. 22 shows parallelogram shaped labels having two edges arranged parallel to the direction of travel of the label 18*a*, while FIG. 23 shows crescent shaped labels. It can be seen that as the label stocks 18*a*, 18*b* are advanced in the direction C the gap sensor of the labelling machine will sense the leading edge of the labels 62*b* and 62*d* when the beam 58 of radiation passes through points I and J respectively. Thus it can be seen that variation in the position of the gap sensor, in the direction perpendicular to direction C, will cause variation in the position along the direction C at which a label edge is detected and hence in the label stopping position.

An embodiment of the present invention described below obviates or mitigates the above described problem by removing the need for manual adjustment of the sensor position in the direction perpendicular to the direction C. FIG. 24 shows a portion of the label stock 18*a* shown in FIG. 22 passing through a portion of a labelling machine having a gap sensor according to an embodiment of the present invention.

In this embodiment the gap sensor includes a transmitter portion and receiver portion which are similar to those shown in FIG. 3. The transmitter portion and receiver portion are configured to receive a portion of the label stock 18*a* between them.

However, the gap sensor of this embodiment is configured to produce a sensor signal which is a function of a property of a portion of the label stock 18*a* at a plurality of positions. That is to say, at any given time, the gap sensor produces a sensor signal which is a function of a property of the label stock at a plurality of positions at said given time.

In the case shown in FIG. 24 the transmitter portion includes two electromagnetic radiation sources (for example light emitting diodes, although in other embodiments any appropriate electromagnetic radiation source may be used). The electromagnetic radiation sources each produce a beam of electromagnetic radiation which passes through the label stock 18*a*. The positions on the label stock 18*a* at which the beams of electromagnetic radiation produced by the electromagnetic radiation sources pass through the label stock 18 (as the label stock 18 moves past the gap sensor) are indicated by lines k and 1 respectively. It can be seen that in this embodiment the electromagnetic radiation sources of the transmitter portion are located such that the lines k and 1 are spaced approximately one-fifth of the label stock width $W_{LS}$ from a respective edge of the label stock 18*a*. It will be appreciated that in other embodiments, the lines k and 1 may be positioned at any appropriate spacing from a respective edge of the label stock 18*a*. Furthermore, in some embodiments, the lines k and 1 may be spaced different distances from their respective edges.

The receiver portion of the sensor includes at least one electromagnetic radiation detector. The one or more electromagnetic radiation detectors are configured such that the beams of electromagnetic radiation which are emitted by the transmitter portion and passed through the label stock 18*a* are incident on the one or more electromagnetic radiation detectors. In some embodiments there may be only one electromagnetic radiation detector upon which both of the beams of electromagnetic radiation are incident. In other embodiments, each of the beams of electromagnetic radiation may be incident upon its own electromagnetic radiation detector.

The receiver portion outputs a signal based on the amount of electromagnetic radiation emitted by the transmitter portion which is transmitted through the label stock 18*a* and is incident on the receiver portion.

As can be seen from FIG. 24, as the label stock 18*a* passes along the web path in the transportation direction C the label 62*b* will at least partially obscure the beam of radiation passing through point K when the label stock 18*a* (and hence label 62*b*) is positioned relative to the transmitter and receiver portions as shown in FIG. 24. Due to the label 62*b* at least partially obscuring the beam of electromagnetic radiation passing through point K the sensor signal produced by the receiver portion of the sensor will differ from the sensor signal before the label 62*b* reaches point K (i.e., when the beam of radiation at point K is only passing through the web and not a label) such that the controller determines that, when the label stock 18*a* is at a position relative to the transmitter and receiver portion as shown in FIG. 24, a leading edge 62*h* of a label 62*b* has been detected.

The controller may be configured such that, based upon a change in the sensor signal (for example, the change in the sensor signal between when the label stock is positioned such that the beams of electromagnetic radiation pass through only the web, and when at least one of the beams of electromagnetic radiation is at least partially occluded by the leading edge 62*h* of a label 62*b*) the controller may control the motive means which advances the label stock 18*a* along the web path in the direction C so as to position a portion of the label stock at a desired location along the web path.

Some of the previously described embodiments operate such that in attempting to position a desired portion of each label (for example the forward-most point, with respect to the direction of travel C, of the leading edge of each label) at a desired position along the web path (for example at the edge 66 of the labelling peel beak 30), the gap sensor attempts to detect the desired portion of each label and then, once the desired portion of each label has been detected, the controller advances the label stock a known distance along the web path between the gap sensor and the desired position along the web path. In other embodiments this need not be the case.

For example, some embodiments may operate as follows. The gap sensor is positioned so as to detect a first portion of each label. Once the first portion of the label has been detected, the controller advances the label stock a predetermined distance along the web path such that the desired portion of the label (which is different to the first portion of the label) is positioned at the desired position along the web path. For example, if the gap sensor is configured to detect a first portion of each label which is located 2 cm behind (in a direction parallel to the direction of travel C) the forward-most point (with respect to the direction of travel C) of the leading edge of the label. If it is desired to locate the forward-most point of the label at the edge of the labelling peel beak then this may be achieved as follows. Once the gap sensor has detected the first portion of a label, the controller controls the take up motor to advance the label stock along the web path by the distance along the web path between the edge of the labelling peel beak and the gap sensor, minus a distance of 2 cm (i.e. the displacement in the direction of travel C between the portion of the label detected by the gap sensor and the desired portion of the label).

In some embodiments the distance along the web path between the desired position along the web path and the gap sensor, and the displacement in the direction of travel C between the portion of the label detected by the gap sensor and the desired portion of the label may be measured using any appropriate distance measuring apparatus. In other embodiments the distance along the web path between the desired position along the web path and the gap sensor, and the displacement in the direction of travel C between the portion of the label detected by the gap sensor and the desired portion of the label may be manually set by the user of the labelling machine. For example, the user may manually adjust the distance (also known as the feed distance) which the controller controls the take up motor to advance the label stock along the web path after the first portion of a label has been sensed, so that the desired portion of each label is located at the desired position along the web path after the label stock is advanced by the feed distance subsequent to the first portion of each label being detected by the gap sensor.

The feed distance is generally kept constant for a given combination of gap sensor configuration and type of label stock. In order for these types of labelling machine to operate correctly, it may be important for the gap sensor to correctly detect the position of the first portion of each label. The position at which the first portion of each label is detected by the gap sensor may be referred to as the trigger position. It is desirable that the trigger position corresponds to the same portion of each label as the label stock passes the gap sensor, even if the label stock tracks (i.e. moves in a direction perpendicular to the direction of travel C).

FIG. 26 shows a portion of label stock 18*b* in solid line which passes through a known gap sensor of the type discussed in relation to FIGS. 21 to 23. The label stock 18*b* passes between a detector and a transmitter of the gap sensor in the manner previously discussed. The beam of electromagnetic radiation produced by the transmitter portion of the gap sensor is incident on the label stock 18*b*. As the label stock 18*b* moves past the beam of electromagnetic radiation the beam of electromagnetic radiation traces a path along the label stock indicated by line n. It can be seen that, in this case, line n is located approximately halfway across the label stock 18*b*.

In this example the gap sensor is located across the web path (i.e. at a position perpendicular to the direction of travel C of the label stock) so that the trigger point for each label is a leading edge of each label. As the label stock 18*b* travels along the web path in the direction C, the gap sensor will detect the leading edge 62*m* of the label 62*n* when the label stock 18*b* is aligned with the gap sensor such that the beam of electromagnetic radiation produced by the electromagnetic transmitter of the gap sensor passes through point indicated by P. The gap sensor then provides a signal to the controller to indicate trigger position. In this case the trigger position correctly corresponds to the position of the label stock 18*b* at which the leading edge 62*m* of a label 62*n* has been detected by the gap sensor. The controller may then use this information to advance the label stock a desired distance so as to position a desired portion of the label 62*n* at a desired position along the web path. For example, the controller may control the take up motor to advance the leading edge 62*m* of the label 62*n* so that it is located at the edge of the labelling peel beak.

In some labelling machines, as the label stock moves along the web path between the supply spool support and the take up spool support, the label stock may move in a direction perpendicular to the direction of travel C of the label stock 18*b*. Such movement of the label stock 18*b* in a direction perpendicular to the direction of travel C may in some cases be undesirable and may be referred to as 'tracking' of the label web.

FIG. 27 also shows in dashed-line a portion of label stock 18*c* which is equivalent to the label stock 18*b* but has undergone tracking (i.e., movement perpendicular to the direction of travel of the label stock C) relative to the label stock 18*b* by moving upwards (with respect to the orientation of the Figure) by a distance $d_{TR}$. Due to the fact that the label stock 18*c* (and hence the attached labels 62*q*) has moved upwards the leading edge 62*p* of the label 62*q* will no longer be detected by the gap sensor as the label stock moves along the web path in direction C. Instead, a second edge 62*r* of the label 62*q* will be detected. That is to say, the gap sensor will detect the second edge 62*r* of the label 62*q* when the label stock 18*c* is aligned with the gap sensor such that the beam of electromagnetic radiation produced by the electromagnetic transmitter of the gap sensor passes through point indicated by Q. The gap sensor then provides a signal to the controller to indicate trigger position. Due to the fact that the label web 18*c* has undergone tracking relative to the label web 18*b*, the trigger position no longer correctly corresponds to the position of the label stock 18*c* at which the leading edge 62*p* of a label 62*q* has been detected by the gap sensor. Instead, the trigger position incorrectly corresponds to the position of the label stock 18*c* at which the second edge 62*r* of a label 62*q* has been detected by the gap sensor. Consequently, tracking of the label stock has resulted in the trigger position becoming incorrect.

Incorrect determination of the trigger position by the gap sensor may be problematic as follows. The labelling machine may be configured such that the feed distance (i.e. the distance the controller advances the label stock after the gap sensor has detected the trigger position) is appropriate for when the trigger position is when a particular portion of the label is detected by the gap sensor. If, instead, the trigger position becomes when another portion of the label is detected by the gap sensor then the feed distance will no longer be the correct distance to advance the label stock after the gap sensor has detected the trigger position in order that the desired portion of the label is located at the desired position along the web path. This is illustrated below.

It can be seen that positions P and the position Q are both on the line n. However, the points P and Q are spaced by a distance $d_{TE}$. Thus, it will be clear that tracking of the label stock by a distance $d_{TR}$ has caused trigger position measured by the gap sensor to be displaced by a distance $d_{TE}$. In particular, the trigger position is now incorrectly detected a distance $d_{TE}$ behind where it is correctly located. The feed distance has been set such that it is a distance FD based on the trigger point being point P. If the trigger point is incorrectly measured by the gap sensor to be point Q and the label stock is advanced by distance FD when the gap sensor triggers at point Q then the label stock will be advanced to a position where the desired portion of the label stock is a distance $d_{TE}$ further along the web path in the direction C than it should be. This may lead to incorrect dispensing of the labels such that they do not affix to a desired product adjacent the labelling machine in a desired position, or may lead to jamming of the labelling machine.

An embodiment of the present invention seeks to obviate or mitigate the above discussed problem.

FIG. 27 shows a portion of label stock 18*d* and an attached label 62*r* passing a gap sensor according to an embodiment of the present invention. In this case, as in the embodiment shown in FIG. 24, the gap sensor comprises a transmitter portion and receiver portion which are capable of producing a sensor signal which is a function of a property of a portion of the label stock at two positions which are spaced from one another in a direction non-parallel to the web path. In particular, the gap sensor comprises a transmitter portion which includes two electromagnetic radiation sources. The electromagnetic radiation sources each produce a beam of electromagnetic radiation which passes through the label stock 18*d*. The positions on the label stock 18*d* at which the beams of electromagnetic radiation produced by the electromagnetic radiation sources pass through the label stock (as the label stock moves past the gap sensor) are indicated by lines s and t respectively. It can be seen that line t corresponds to line n in FIG. 26.

The receiver portion of the sensor includes at least one electromagnetic radiation detector. The one or more electromagnetic radiation detectors are configured such that the beams of electromagnetic radiation which are emitted by the transmitter portion and passed through the label stock 18*d* are incident on the one or more electromagnetic radiation detectors. In some embodiments there may be only one electromagnetic radiation detector upon which both of the beams of electromagnetic radiation are incident. In other embodiments, each of the beams of electromagnetic radiation may be incident upon its own electromagnetic radiation detector.

The receiver portion outputs a signal based on the amount of electromagnetic radiation emitted by the transmitter portion which is transmitted through the label stock 18*d* and is incident on the receiver portion.

As the label stock 18*d* travels along the web path in the direction C, the electromagnetic radiation of the transmitter of the gap sensor which is incident on line s will be occluded by the leading edge 62*s* of the label 62*r* when the label stock 18*d* is aligned with the gap sensor such that the first beam of electromagnetic radiation produced by the electromagnetic transmitter of the gap sensor passes through the point indicated by V. Likewise, as the label stock 18*d* travels along the web path in the direction C, the electromagnetic radiation of the transmitter of the gap sensor which is incident on line t will be occluded by the leading edge 62*s* of the label 62*r* when the label stock 18*d* is aligned with the gap sensor such that the second beam of electromagnetic radiation produced by the electromagnetic transmitter of the gap sensor passes through the point indicated by U.

The controller is configured to process the signal produced by the receiver of the gap sensor and determines that the reduction in electromagnetic radiation received by the receiver, which occurs due to the label 62*r* occluding the electromagnetic radiation at points V and U when the label stock 18*d* is positioned as shown in FIG. 27, is indicative of the trigger position. In this case it is desired that the trigger position occurs when the leading edge 62*s* of the label 62*r* is at the gap sensor. As such, the controller correctly identifies the trigger position.

FIG. 27 also shows, in dashed-line, a label stock 18*e* having a label 62*t* which is equivalent to the label stock 18*d*, but has moved (or tracked) in a direction perpendicular to the direction of travel C of the label web by a distance $d_{TR}$. As previously discussed, the distance $d_{TR}$ may be referred to as a tracking distance which has been moved by the label stock 18*e*.

As the label stock 18*e* travels along the web path in the direction C, the electromagnetic radiation of the transmitter of the gap sensor which is incident on line s will be occluded by the leading edge 62*u* of the label 62*t* when the label stock 18*e* is aligned with the gap sensor such that the first beam of electromagnetic radiation produced by the electromagnetic transmitter of the gap sensor passes through the point indicated by V. Likewise, as the label stock 18*e* travels along the web path in the direction C, the electromagnetic radiation of the transmitter of the gap sensor which is incident on line t will be occluded by the second edge 62*w* of the label 62*t* when the label stock 18*e* is aligned with the gap sensor such that the second beam of electromagnetic radiation produced by the electromagnetic transmitter of the gap sensor passes through the point indicated by W.

In the embodiment shown in FIG. 27, even though, as is the case for the known gap sensor shown in FIG. 26, the second beam of radiation produced by the gap sensor (which traces the line t) is not occluded by the leading edge 62*u* of the label 62*t* (but rather is occluded by the second edge 62*w* of the label), the controller still detects the trigger position for label 62*t* is the same as for label 62*r*. That is to say. The trigger position for both label 62*r* and label 62*t* is the same and is when the leading edge 62*s*, 62*u* of the label 62*r*, 62*t* is at a position along the web path such that it is at the gap sensor. Because of this, tracking of the label by a distance $d_{TR}$ has not changed the trigger point and consequently the labelling machine will continue to feed labels to the desired position despite the fact that tracking has occurred.

As discussed, the controller detects the trigger position for label 62*t* is the same as for label 62*r*. This is because the controller is configured to monitor the signal produced by the gap sensor and, in order to detect the trigger position, require that the label 62*t* only occludes the electromagnetic radiation at one of the positions (i.e. whilst the radiation at the other position is not occluded). This may be achieved in various ways. One example is that the controller may monitor the electromagnetic radiation received at each position individually. Once the controller detects that at one position the electromagnetic radiation has gone from being free to pass through the label web to being occluded by a label, then this may cause the controller to detect a trigger position. In another example, the controller may monitor the total amount of electromagnetic radiation received by the receiver at both positions. The controller may then detect a trigger position when the total amount of electromagnetic radiation received by the receiver falls within a predetermined range (for example below a predetermined threshold).

Although the above described embodiment of the invention comprises a gap sensor which includes transmitter portion with two discrete sources of radiation and receiver with two discrete electromagnetic detectors, other embodiments may include a gap sensor with any appropriate configuration of transmitter and receiver. For example, the receiver may include an elongate, planar photodiode which extends lengthways in a direction that is non-parallel to the direction of travel of the label stock. In some embodiments the planar photodiode may be substantially rectangular. An example of a suitable photodiode is an SLCD-61N4 produced by Silonex, Canada.

In some embodiments, the signal produced by the gap sensor may be monitored by the controller and the maximum and/or minimum value of the signal output by the gap sensor may be monitored to a measure of the amount by which the label stock and attached labels have tracked (i.e. moved in a direction perpendicular to the direction of travel of the label web). In other embodiments the controller may monitor the signal from each of a plurality of positions spaced from one another in a direction non-parallel to the web path and based upon the duration that each position is occluded by a label as a label passes and/or based upon whether each position is occluded by a label at all, determine a measure of the amount by which the label stock and attached labels have tracked.

It will be appreciated that although the transmitter portion and receiver portion of the sensor comprise an electromagnetic radiation source and an electromagnetic radiation detector respectively such that they can collectively produce a sensor signal which is a function of the electromagnetic transmittance of a portion of the label stock at a plurality of positions spaced from one another in a direction non-parallel to the web path, any appropriate sensor which can produce a sensor signal which is a function of any appropriate property of a portion of the label stock at a plurality of positions spaced from one another in a direction non-parallel to the web path may be used. For example, a sensor which is capable of producing a sensor signal which is a function of the thickness of a portion of the label stock at a plurality of positions spaced from one another in a direction non-parallel to the web path (for example perpendicular to the web path) may be used.

As previously discussed, the sensor which is used in combination with the label stock shown in FIG. 24 comprises a transmitter portion and receiver portion which are capable of producing a sensor signal which is a function of a property of a portion of the label stock at two positions which are spaced from one another in a direction non-parallel to the web path. In some embodiments the sensor may comprise a transmitter portion and a receiver portion which are capable of producing a sensor signal which is a function of a property of a portion of the label stock at more than two positions which are spaced from one another in a direction non-parallel to the web path. In some embodiments in which the sensor comprises a transmitter portion and a receiver portion which are capable of producing a sensor signal which is a function of a property of a portion of the label stock at two or more positions which are spaced from one another in a direction non-parallel to the web path, the transmitter portion and a receiver portion may be configured such that there is a discrete receiver portion for each position at which the property of the label stock is measured.

In this case, the sensor may be used to measure the length of a label in the following way. The controller may measure a property of a portion of the label stock using each receiver portion. The controller will count the number of motor steps during which each receiver portion produces a signal which is indicative of the presence of a label (e.g. reduced electromagnetic radiation measured by the receiver). This number of motor steps is the same as the number of motor steps between when each receiver portion produces a signal which is indicative of the absence of a label either side of the label concerned. The controller will then compare the counted number of motor steps for each receiver portion and will determine which receiver portion counted the greatest number of steps. The greatest number of steps will then be used to determine the label length by multiplying the number of steps by the linear label stock displacement per step. The greatest number of steps is used to determine the label length because this corresponds to the number of steps for the receiver portion which detected the presence of a label for the greatest amount of time. The receiver portion which detects the presence of a label for the greatest amount of time will detect a length of the label which is closest to the actual length of the label.

FIG. 25 shows a portion of label stock 18*a* which is the same as that shown in FIGS. 22 and 24 passing through a labelling machine having an alternative gap sensor. In this embodiment the sensor of the labelling machine has a transmitter portion which includes an emitter of electromagnetic radiation which produces a beam of electromagnetic radiation which is strip-like and which is incident on the label stock 18*a* so as to form a line indicated by M. In some embodiments, the emitter of electromagnetic radiation may be configured such that the intensity of the radiation produced by the emitter, which, in use, is incident on the label stock, is substantially uniform along the length of the beam. In some embodiments, the emitter of electromagnetic radiation may be a linear array of LEDs. In this case, the line M extends across approximately 90% of the width $W_{LS}$ of the label stock 18*a*. It will be appreciated that in other embodiments the line may have any appropriate length. For example, the line may extend beyond the width of the label stock. In other embodiments the line M may extend across less than 90% of $W_{LS}$. For example, in some embodiments the line M may extend across approximately 50% of $W_{LS}$. This may be particularly appropriate if the labels being used are substantially symmetrical about a line which is substantially parallel to the path of the label stock. In this situation the gap sensor may be configured such that the line M extends only across a portion of the label stock which is one side of the line of symmetry of the labels of the label stock.

The electromagnetic radiation produced by the transmitter portion in this embodiment (which is henceforth referred to as the strip of electromagnetic radiation) may be produced by a strip LED device. The strip of electromagnetic radiation is incident on the label stock 18*a* at the position M and passes through the label stock where it is incident on a receiver portion. The receiver portion may comprise a planar photodiode. The transmitter portion of the sensor may be configured such that the strip of electromagnetic radiation has a substantially uniform intensity of electromagnetic radiation produced along its entire length.

It will be appreciated that, in this embodiment, the strip of electromagnetic radiation is incident on the label stock at a plurality of positions which are spaced from one another in a direction non-parallel to the web path C (in fact, the positions are spaced from one another in a direction which is substantially perpendicular to the web path, although this need not be the case in other embodiments). This is because the line M includes a plurality of positions along that line.

A portion of the strip of electromagnetic radiation M which is incident on the label stock 18*a* passes through the label stock 18*a* and is incident on the receiver portion. In this case the receiver portion includes a planar photodiode. An example of a suitable photodiode is an SLCD-61N4 produced by Silonex, Canada. The planar photodiode outputs a sensor signal which is a function of the total amount of electromagnetic radiation which is incident upon it. Consequently, due to the fact that the electromagnetic radiation strip M must pass through the label stock 18*a* in order to reach the planar photodiode of the receiver portion, the sensor signal produced by the planar photodiode of the receiver portion is a function of the transmittance of electromagnetic radiation of the portion of the label stock through which the strip of electromagnetic radiation M passes. Hence the sensor signal is a function of the transmittance of electromagnetic radiation of a plurality of positions across the width of the label stock through which the strip of electromagnetic radiation M passes. The plurality of positions through which the strip of electromagnetic radiation passes are spaced from one another in a direction which is non-parallel to the direction of transport C along the web path.

As can be seen in FIG. 25, when the label stock 18*a* advances along the web path in the direction C and when the label stock 18*a* is located relative to the transmitter portion and receiver portion of the sensor such that the strip of electromagnetic radiation M is located as shown in FIG. 25, as the label stock 18*a* advances further in the direction C, the label 62*b* will begin to occlude at least a portion of the strip M of electromagnetic radiation. Consequently, as the label stock advances in direction C beyond the position shown in FIG. 25, the amount of electromagnetic radiation transmitted through the label stock 18*a* such that it is incident on the planar photodiode of the receiver portion will reduce. The sensor signal is provided to the controller and the controller may identify the presence of an edge (in this case the leading edge 62*h*) of the label 62*b* based on a change in the sensor signal produced by the planar photodiode. For example, if the planar photodiode produces a signal which decreases with decreasing total electromagnetic radiation incident upon it, then the controller may determine the presence of an edge of a label due to a reduction in the magnitude of the sensor signal.

Because the strip M of electromagnetic radiation produced in the described embodiment may be occluded by the very tip of a label, such that this occlusion is detected by the sensor, then the sensor of this embodiment is capable of substantially determining the exact position of the forward-most (with respect to direction C) point of the label 62*b*, such that the controller may correctly position the portion of the label stock at a desired location along the web path. For example, the very tip 62*k* of the label 62*b* may be positioned at the edge 66 of the labelling peel beak 30 as shown in FIG. 3.

In some labelling machines which include any of the gap sensors described above, the controller may, based on the sensor signal produced by the gap sensor, position a desired portion of the label stock at a desired location along the web path which differs from locating the forward-most portion of a label at the edge of the labelling peel beak. For example, in some labelling machines it may be desirable to position the forward-most portion of a label so that it is spaced from the edge of the labelling peel beak. In some labelling machines the forward-most portion of the label may be positioned so that it is spaced a predetermined distance before or after (with respect to the label stock transport direction) the edge of the labelling peel beak. This predetermined distance may be set by a user of the labelling machine based on the application of the labelling machine. In some labelling machines the predetermined distance may be referred to as a feed distance.

In some embodiments the controller is further configured to control the motive means based upon particular characteristics of the sensor signal. For example, the controller is configured to control the motive means based on the derivative (also referred to as rate of change or gradient) of the sensor signal, based on the second order or greater derivative of the sensor signal and/or based a signature of the sensor signal. An example of a signature of the sensor signal is where a particular label passing the sensor causes the sensor to produce a sensor signal with a given pattern. For example, the pattern may be a positive derivative, followed by a substantially zero derivative, followed by a positive derivative, followed by a substantially zero derivative, followed by a negative derivative, followed by a substantially zero derivative, followed by a negative derivative. Each time the controller receives a signal from the sensor which has a signature having this pattern then the controller will know that a single label has passed the sensor. Any appropriate signature having any appropriate pattern of sensor signal may be used. Furthermore, a feature of the signature may correspond to a feature of the label stock (for example, the leading edge or trailing edge of a label) and the controller may detect this feature of the signature so as to detect said feature of the label stock.

In some situations, monitoring a particular characteristic of the signal may enable a correct portion of an edge or other feature of a label to be correctly determined by the controller such that the controller can control the motive means so as to locate the determined edge portion or other portion of the label correctly at a desired location. For example, the controller may detect the presence of a leading edge of a label (or other appropriate feature of the label stock) by comparing a characteristic (e.g. magnitude, derivative, second order or greater derivative) of the sensor signal to a threshold value. When the characteristic of the sensor signal is greater than (or less than depending on the application) the threshold then the controller will detect the presence of the leading edge of the label (or other appropriate feature of the label stock). The threshold may be chosen based on the size and/or shape of the labels of a particular label stock. Consequently, the labelling machine may be configured such that the threshold is determined depending on the type of label stock being used. Hence the labelling machine may be configured to use different threshold values depending on the size and/or shape of labels of a particular label stock.

The various gap sensors described within this description are fixed in that their position parallel to the web path and perpendicular to the web path is fixed. In other embodiments, the position of the gap sensor may be user adjustable—i.e. the position of the gap sensor along the web path and/or perpendicular to the web path may be adjusted by a user.

FIG. 28 shows a schematic view of a portion of an alternative labelling machine 300 in which various of the aforementioned features are applied. The labelling machine 300 includes a supply spool support 10 which supports a spool 16 of label stock. The label stock 18 travels in a direction C along a web path 20 between the supply spool support 10 and a take up spool support 12. The take up spool support 12 wraps a portion of the label stock 18 around it to form a take up spool 34. As the label stock 18 travels along the web path 20 it passes a printer 36 which is suitable for printing on a portion of the label stock 18. The labelling machine 300 also includes a labelling peel beak 30 which functions so as to separate labels which pass the labelling peel beak 30 from the label stock 18. A motor 14 is linked to the take up spool support 12 so as to drive the take up spool support so as to propel the web of the label stock 18 along the web path 20 from the supply spool support 10 to the take up spool support 12. It will be appreciated that, although in the embodiment shown the motor 14 constitutes motive means configured to propel the web along the web path from the supply spool support towards the take up spool support, in other embodiments any appropriate motive means may be used as has been discussed previously in relation to the embodiment shown in FIGS. 1 and 2.

The operation of the labelling machine 300 as so far described is substantially identical to the operation of the labelling machine shown in FIG. 2. Corresponding features have been given the same numbering.

The labelling machine 300 shown in FIG. 28 differs from that shown in FIG. 2 in that it additionally includes a path length adjustor 302.

FIG. 29 shows a portion of the labelling machine shown in FIG. 28. FIG. 29 shows the printer 36 for printing on the labels of the label stock 18. FIG. 29 also shows the labelling peel beak 30 which is configured to separate labels passing the labelling peel beak on the web of the label stock. The labelling peel beak 30 may be referred to as a labelling component which is configured to perform a labelling operation (in this case separating the labels from the label web). It will be appreciated that in other embodiments the labelling peel beak 30 may be replaced by a labelling component which is configured to perform any appropriate labelling operation. For example, the labelling component may another type of dispenser, e.g. a vacuum pad.

The path length adjustor 302 includes a pair of fixed rollers 304, 306 and a movable member (in this case a movable roller 308). The rollers 304, 306 and movable member 308 are configured to contact a portion of the label stock 18 and define a portion of the web path 20 between the printer 36 and the labelling component 30.

In the present embodiment the movable member is a roller around which the label stock 18 passes. The roller is movable along a substantially linear track 310 by a motor 312 which is linked to the movable roller 308. The movable member 308 is movable by the motor 312 in a direction N which is generally away from the fixed rollers 304, 306, or in a direction which is opposite (or anti parallel) to the direction N in which the movable member 308 moves in a direction along the track 310 which is substantially towards the fixed rollers 304, 306. By moving the movable member 308 in the direction N, the path length between the printer 36 and labelling component 30 will increase. Conversely, by moving the movable member 308 in a direction opposite (or anti-parallel) to the direction N, the path length between the printer 36 and the labelling component 30 will decrease. Consequently, it may be said that the movable member 308 is configured such that movement of the movable member modifies a length of the web path between the printer and the labelling component.

It will be appreciated that the motor which moves the movable roller 308 may be any appropriate motor, for example a position-controlled motor such as a stepper motor.

The printer 36 is configured to perform a printing operation at a first linear speed. That is to say, the printer 36 is configured to print on a portion of the label stock (for example the labels) whilst the label stock travels along the web path past the printer at a first linear speed. The labelling component 30 (in this case a labelling peel beak) is configured to perform a labelling operation (in this case separation of the labels from the label web) at a second linear speed. That is to say that the labelling component is configured to perform a labelling operation with label stock travelling along the web path and passing the labelling component at the second linear speed.

In some embodiments the first linear speed will be less than the second linear speed. This may be due to the fact that in some cases the maximum linear speed at which certain printers may operate is less than the maximum speed at which the labelling component (e.g. labelling peel beak) may operate. For example, in some cases, the maximum speed of the printer may be limited by the printing technology used by the printer; e.g. thermal transfer printers may operate at relatively slow speeds.

In known labelling machines which do not include a path length adjustor according to the present invention, if the printer is configured to perform the printing operation at a first linear speed which is slower than a second linear speed at which a labelling component is configured to perform a labelling operation, then the labelling machine must be operated such that the label stock travels along the web path at the lower of the two speeds: in this case the first linear speed. Consequently, the speed at which the labelling component can operate is limited by the linear speed at which the label stock must pass the printer.

A labelling machine according to one embodiment which includes a path length adjustor attempts to obviate or mitigate this problem. This is achieved as follows.

A controller which forms part of the labelling machine is configured to control movement of the movable member and control the motive means so as to allow a first portion of the label stock to pass the printer at the first linear speed and a second portion of the label stock to pass the labelling component at the second linear speed. This is achieved as follows.

The following explanation relates to the situation (as shown in the figures) whereby the label stock travels along the web path 20 such that the labelling component 30 is downstream of the printer 36. If the first linear speed (i.e. print speed) is less than the second linear speed (i.e. labelling speed), then the path length adjustor 302 must shorten the length of the web path between the printer 36 and labelling component 30 during a printing operation in order to compensate for the difference between the first and second linear speeds. If the first linear speed is greater than the second linear speed, then the path length of the web path between the printer 36 and the labelling component 30 must be increased during a printing operation in order to compensate for the difference between the first and second linear speeds.

In both cases, whilst a printing operation is not occurring, the linear member is moved in the opposite direction to achieve the opposite effect.

As previously discussed, the path length adjustor 302 modifies the length of the web path between the printer and the labelling component by moving the movable member 308. In particular, the controller may control movement of the movable member such that, for a given time t the magnitude of the change in the length of the web path $L_{PL}$ is given by:

$$L_{PL} = \left|\frac{S_1 - S_2}{t}\right| \tag{22}$$

where $S_1$ is the first linear speed and $S_2$ is the second linear speed.

For example, in the embodiment shown in FIG. 29, for a movement of the movable member 308 in a particular direction by a given amount, the length of the web path between the printer and the labelling component will be changed by twice the given amount.

It will be appreciated that in the embodiment shown in FIG. 29 there is a limit to the amount of movement the movable member 308 can undertake along the track 310. Consequently, there is a limit to the amount the movable member 308 can change the length of the web path between the printer and the labelling component so as to compensate for the difference between the first and second linear speeds. This may be acceptable in some embodiments provided that the difference between the first and second linear speeds and the total time for which the labelling machine is run with the printer and labelling component operating at different first and second linear speeds results in a required compensation in the length of the web path between the printer and the labelling component which is sufficiently small such that it can be compensated for by the movement of the movable member of the path length adjustor.

In some embodiments, the path length adjuster may be located along the web path between two components (neither of which need be a printer) of a labelling machine. One of the components may have a slow speed mode. For example, the slow speed mode may be a safe mode which is utilised when trying to diagnose a fault with said component. When the component enters the slow speed mode, the path length adjuster may be used to accommodate a difference between the component speed (linear speed of a portion of the label stock past the component) past the component in the slow speed mode, and the component speed of the other component. Likewise, the path length adjuster may accommodate any difference between the component speeds when the component operating at the slow speed is accelerated back to a normal operating speed.

In other embodiments the different first and second speeds may be accommodated in a different way. FIG. 30 shows a portion of label stock 320 which may be used in a labelling machine which includes a path length adjustor. The label stock 320 consists of a web 322 and a plurality of spaced labels 324 which are attached to the web 322. Each label 324 includes a first region 326 and a second region 328 which are not printed on by the printer (these may be referred to as non-printable regions). Each label also includes a printable region 330 which may be printed on by the printer. The label stock 320 moves along the web path in the direction C. The length of each label is $L_L$. The length of the first region 326 of the label 324 is $L_1$. Likewise, the length of the second region 328 of the label 324 is $L_2$. The length of the printable region 330 is $L_3$. Finally, the length of the gap between adjacent labels is $L_G$.

The distance between any feature of one label 324 and the same feature on the adjacent label is referred to as the pitch length $L_P$. The pitch length $L_P$ is given by the sum of the length $L_1$ of the first region 326, the length $L_2$ of the second region 328, the length $L_3$ of the printable region 330 and the length $L_G$ of the gap between adjacent labels 324. Consequently, the pitch length $L_P$ is also equal to the sum of the label length $L_L$ and the gap length $L_G$ as was noted above. In each of these cases, the length has been measured in a direction parallel to the direction C of travel of the label stock 320.

The length between adjacent printable areas is given by the sum of length $L_2$ of the second region 328, $L_G$ of the gap between adjacent labels 324, and the length $L_1$ of the first region 326 of the label 324. The length between the printable regions 330 of adjacent labels 324 is indicated by $L_{NP}$. The length $L_{NP}$ may also be referred to as the non-printable length and may be defined as the pitch length $L_P$ minus the length $L_3$ of the printable region 330.

It will be appreciated that the labels of the label stock shown in FIG. 30 are such that the printable region 330 is sandwiched between two regions 324 and 328 which are not printed. In other embodiments there may be any appropriate number of printed regions and unprinted regions which form part of each label. For example, a label may include only a single non-printable region and a single printable region. In other embodiments the label may include a plurality of printable regions and a plurality of non-printable regions.

The label stock 320 shown in FIG. 30 is utilised in conjunction with the path length adjustor 302 shown in FIG. 29 as follows. It will be apparent that, as previously discussed, when the region of each label 330 which is to be printed upon by the printer 36 passes the printer 36 it does so at the first linear speed due to the fact that the printer is configured to perform the printing operation at the first linear speed. Conversely, when any region of the label stock 320 which is not to be printed upon by the printer 36 (i.e., the portion of the label stock between the printable regions 330 of adjacent labels 324 indicated by $L_{NP}$), then these regions may travel past the printer 36 at any appropriate speed because the printer 36 does not have to carry out a printing operation on these regions and hence these regions do not have to pass the printer 36 at the first linear speed at which the printer is configured to carry out the printing operation.

In the case where the first linear speed is less than the second linear speed, and as a consequence of the fact that the printable region of each label must pass the printer at the first linear speed, but any other region of the label stock can pass the printer 36 at any appropriate speed, the path length adjustor 302 may be operated as follows.

Whilst a printable region 330 of each label 324 passes the printer 36, the controller of the labelling machine will control movement of the movable member 308 and the motive means (for example the motor which drives the take up spool support) so that the printable region 330 of the label 324 passes the printer 36 at the first linear speed. The controller will control the movement of the movable member and the motive means so as to allow the length $L_3$ of the printable portion 330 to pass the printer 36 at the first linear speed. During this time (i.e., the time at which the printable region 330 of the label 324 is passing the printer 36) the controller also controls movement of the movable member and the motive means so as to allow a second portion of the label stock (i.e., that adjacent the labelling peel beak 30) to pass the labelling peel beak 30 at the second linear speed.

In this example, due to the fact that the first linear speed is less than the second linear speed, the controller achieves the movement of the first and second portions of the label stock past the printer and the labelling peel beak respectively by rotating the take up spool support at a sufficient speed so as to move the label stock downstream of the path length adjustor 302 at the second linear speed. Simultaneously, the controller will control the movement of the movable member 308 (in this case by controlling the movement of the motor 312) so as to decrease the path length between the printer 36 and the labelling peel beak 30. In this case, decreasing the length of the web path between the printer 36 and the labelling peel beak 30 will involve the controller operating the motor 312 so as to move the movable member 308 in a direction which is opposite (or anti-parallel) to the direction N.

Once the printer 36 has carried out the printing operation at the first linear speed on the printable region 330 of the label 324, then the label stock adjacent the printer may be advanced at any appropriate speed until the printable region 330 of the next label 324 reaches the printer 36. Consequently, during the time it takes for the label stock to advance the length $L_{NP}$ between the printable region 330 of adjacent labels 324 the label stock 320 may be advanced at any appropriate speed past the printer such as, for example, a speed which exceeds the first linear speed and also exceeds the second linear speed.

During this period of movement of the label stock 320 past the printer 36, the controller controls movement of the movable member 308 and the motive means (for example a motor which drives the take up spool support) so as to allow a first portion of the label stock (i.e., that adjacent to the printer 36) to pass the printer at a speed which exceeds the second linear speed, and also to allow a second portion of the label stock 320 (i.e., that adjacent to the labelling peel beak 30) to pass the labelling peel beak 30 at the second linear speed. This is achieved as follows.

The controller controls the motive means so as to rotate the take up spool support at a speed such that the linear speed of the label stock 320 downstream of the path length adjustor 302 (and hence past the labelling peel beak 30) is the second linear speed. Simultaneously, the controller controls the movement of the movable member 308 of the path length adjustor 302 so as to increase the length of the web path between the labelling peel beak 30 and the printer 36. In this case, the increase in the length of the web path between the labelling peel beak 30 and printer 36 is achieved by the controller controlling the motor 312 so as to move the movable member 308 in the direction N.

The combination of the motive means causing the label stock downstream of the path length adjustor to advance along the web path at the second linear speed, and the path length adjustor 302 increasing the length of the web path between the labelling peel beak 30 and printer 36 is that the label stock 320 upstream of the path length adjustor (i.e., that which passes the printer 36) will move at a linear speed which exceeds the second linear speed. In fact, the linear speed at which the label stock 320 moves along the web path upstream of the path length adjustor 302 will be given by the second linear speed plus the rate at which the movable element 308 of the path length adjustor 302 causes the length of the web path between the printer 36 and the labelling peel beak 30 to increase.

Once the portion $L_{NP}$ of the label stock 320 between the printable regions 330 of adjacent labels has been moved past the printer 36 such that the next printable region 330 is located adjacent the printer, then the cycle described above will repeat.

It will be appreciated that during any one cycle, whilst the printable region 330 of a label 324 passes the printer 36 the movable member 308 of the path length adjustor 302 will move in a direction which is opposite (or anti-parallel) to the direction N. Conversely, during the part of a cycle in which the region of the label stock (indicated by $L_{NP}$) between the printable area 330 of adjacent labels 324 passes the printer 36 the movable member 308 of the path length adjustor 302 will move in the direction N. Consequently, as the labelling machine undergoes a number of cycles, the position of the movable member 308 will oscillate.

In a preferred embodiment, the controller is configured to control the movement of the movable member and the motive means such that the distance travelled by the movable member 308 in the direction N (whilst the label stock 320 is advanced between printable regions 330 of adjacent labels) is substantially the same as the distance moved by the movable member 308 in a direction opposite (or anti-parallel) to the direction N (i.e., whilst a printable region 330 of a label 324 passes the printer 35 at the first linear speed). In this way, provided that the track 310 is capable of accommodating the movement of the movable member in the direction N and in the direction opposite (or anti-parallel) to the direction N for a single cycle, the track 310 will also be capable of accommodating the movement of the movable member in the direction N and in the direction opposite (or anti-parallel) to the direction N for any number of cycles and hence any length of label stock.

During operation, the movement of the movable member is controlled such that for the time t for one cycle:

$$V_L t = V_P a t + V_F b t \tag{23}$$

where $V_L$ is the labelling speed (i.e. linear speed of the label stock past the labelling component), $V_P$ is the average linear speed of the label stock past the printer during a printing operation, $V_F$ is the average linear speed of the label stock past the printer whilst the printer is not carrying out a printing operation, a is the proportion of time t that the printer is carrying out the printing operation and b is the proportion of time t that the printer is not carrying out the printing operation. This expression is also applicable where the printer and labelling component are replaced by any other appropriate components which operate at different speeds.

It will be appreciated that although the above described embodiment is such that the first linear speed is less than the second linear speed, in other embodiments this need not be the case. It will be appreciated that if the first linear speed is greater than the second linear speed, then the path length adjustor would have to operate in the opposite manner (i.e., so as to increase the length of the web path between the labelling component 30 and printer 36 whilst the label stock travels past the printer at the first linear speed and simultaneously a second portion of the label stock travels past the labelling component at the second linear speed).

In the embodiment described above it is assumed that label stock is constantly moved past the labelling component. This need not be the case in all embodiments. For example, the take up spool support may be energised such that the label stock moves past the labelling component in an intermittent manner. That is to say, at some points in time the label stock may be stationary at the labelling component. At other points in time the label stock may move past the labelling component at a relatively high speed (which exceeds the speed at which the printer can operate).

The time during which the label stock is substantially stationary at the labelling component may be referred to as a dwell time. During the dwell time a path length adjuster (for example, like the one described above, although any appropriate path length adjuster may be used) may be controlled by the controller such that the path length adjuster increases the path length between the printer and the labelling component at a desired rate to the cause the label stock to pass the printer at a desired rate (for example the operating speed of the printer). Once a label is printed it is then 'stored' within a portion of the web path between the labelling component and the printer.

Subsequently, after the dwell time, when the label stock is moved past the labelling component (for example by energising the take up motor), the path length adjuster is controlled by the controller to reduce the path length between the printer and labelling component at a desired rate (for example, which is substantially equivalent to the speed at which the label stock is moved past the labelling component) in order to allow the 'stored' printed labels to be acted upon (for example dispensed in the case of a labelling beak) by the labelling component. Within this embodiment, it will be appreciated that if the path length adjuster is the same as that discussed further above, then the path length adjuster increases the path length between the printer and the labelling component by the controller controlling the motor 312 so as to move the movable member 308 in the direction N. Furthermore, the path length adjuster decreases the path length between the printer and the labelling component by the controller controlling the motor 312 so as to move the movable member 308 in the direction opposite to N.

It will be apparent from the foregoing description that the various features described can be used alongside one another in a single labelling machine. That is, unless the context otherwise requires, or unless explicitly stated to the contrary herein, it is envisaged that the features described can advantageously be used in a single labelling machine to realise the various benefits described herein. That said, it will also be appreciated that many of the features described herein can be used separately of one another and as such a labelling machine including one or more (but not necessarily all) of the features described herein is envisaged.

Where a labelling machine including various features described above is implemented, the following processing, as illustrated in FIG. 31, may be carried out at start-up of the labelling machine.

At S1 the controller determines the position of the dancing arm 28. In order to do this the controller sends a control signal to the position controlled motor so as to energise the position controlled motor to rotate the shaft 82*d* and attached cam piece 82*c* in a clockwise direction (as shown in FIG. 19), to the extent that substantially no braking force is applied by the brake belt 76 to the brake disc 74. Alternatively, the controller sends a control signal to the solenoid so as to energise the solenoid such that sufficient current is provided to the coil of the solenoid 94 to move the armature 92 of the solenoid 94 in the direction F to the extent that substantially no braking force is applied by the brake belt 76 to the brake disc 74.

Consequently, the supply spool support 10 (and the supported supply spool) is free to rotate.

Whilst the supply spool support 10 is free to rotate, the force provided by spring 130 on the dancing arm 28 is sufficient to rotate the dancing arm 28 about axis A in the direction G. In order to enable the dancing arm 28 to rotate about axis A in the direction G the supply spool support 10 may also rotate about axis A in the direction G (as previously discussed, the supply spool support 10 is free to move because the brake assembly is not applying a braking force to the supply spool support). The dancing arm 28 rotates about axis A in the direction G until it reaches the home position which is detected by the home position sensor. Processing passes from step S1 to step S2.

At steps S2 to S4 the controller determines the diameter of the take up spool supported by the take up spool support 12.

At S2 the controller places the supply spool support brake assembly under the control of the dancing arm position control algorithm, as described in relation to FIG. 17. For example, applying the dancing arm control algorithm, the controller may supply a control signal to the position controlled motor and attached cam piece 82*c* which will act to apply the brake fully, until such a time as the dancing arm moves from the home position beyond the set point. This allows tension to be introduced into the label web. Alternatively, in embodiments including a solenoid, the controller sends a control signal to the solenoid 94 (and more particularly to the coil driver 114) such an amount of current (which may be no current) is provided to the coil of the solenoid 94 in order for the armature 92 of the solenoid 94 to move sufficiently in the direction F' such that the brake is applied fully, until such a time as the dancing arm moves from the home position beyond the set point. Again, this allows tension to be introduced into the label web.

The label stock is then tensioned as follows. At step S3 the controller energises the motor 14 so that it rotates the take up spool support 12 to wind web of the label stock on to the take up spool support 12. As this happens, the tension in the web of the label stock increases. Increasing tension in the web of the label stock causes the web of the label stock to apply greater force to the roller 32 of the dancing arm 28. The force applied by the label stock to the dancing arm opposes the spring biasing of the dancing arm 28 in the direction G by the spring 130. Consequently, increasing tension in the label stock due to rotation of the take up spool support causes the dancing arm 28 to move in the opposite direction to G. As previously discussed, the position of the dancing arm 28 is indicative of the tension in the label stock. When the controller is provided with a signal from the sensor which senses the position of the dancing arm which indicates that the dancing arm is at a desired position which is equivalent to a desired tension, processing then advances to step S4. In some embodiments the desired tension is a predetermined or calculated tension. In other embodiments the desired tension may be any appropriate tension other than no tension—that is to say, the desired tension may be any appropriate tension which removes slack from the label stock.

At step S4 the controller commands the motor 14 to rotate a given number of steps (for example 50-150 steps) so as to wind more label stock on to the take up spool support 12. This causes the dancing arm 28 to move from its position at the beginning of S4. Based upon the number of commanded steps the motor 14 advances in step S4 and on the movement of the dancing arm 28 detected by the dancing arm movement sensor (also referred to as the sensor configured to produce a sensor signal indicative of the position of the moveable element) during the rotation of the motor 14 the controller calculates the diameter of the spool supported by the take up spool support 12. This process has been discussed in detail above.

At S5 the controller determines the pitch length $L_P$ of the label stock 18. This is achieved as follows. In this embodiment, this is done with the supply spool support brake assembly under control of the dancing arm position control algorithm, although in other embodiments this need not be the case. For example, in other embodiments the pitch length of the label stock may be determined with the brake assembly released (i.e. not applying a braking force). Again, in order to release the brake assembly, the controller sends a control signal to the solenoid 94 (and more particularly to the coil driver 114) such that sufficient current is provided to the coil of the solenoid 94 to move the armature 92 of the solenoid 94 in the direction F to the extent that substantially no braking force is applied by the brake belt 76 to the brake disc 74. Consequently, the supply spool support 10 (and the supported supply spool) is free to rotate.

The controller advances the motor which drives the take up spool support. The controller also monitors the signal 56 provided by the detector 52 of the gap sensor. The controller counts the number of steps the motor 14 is commanded to advance whilst a label is sensed and, as previously described, uses this information and the diameter of the spool supported by the take up spool support (determined in step S4) to determine the length of a label $L_L$. Likewise, the controller counts the number of steps the motor 14 is commanded to advance whilst a gap is sensed and, as previously described, uses this information and the diameter of the spool supported by the take up spool support (as determined in step S4) to determine the length of a gap $L_G$. The controller then sums $L_P$ and $L_G$ in order to calculate $L_P$.

In some embodiments, the controller may count the number of steps the motor 14 is commanded to advance whilst a plurality of labels and gaps are sensed by the detector of the gap sensor. The controller may then work out the label length, gap length and/or pitch length by averaging the measured label length, gap length and/or pitch length. For example, the controller may count the number of steps the motor 14 is advanced whilst the controller monitors the signal 56 and senses that a total of three labels and three gaps have passed the gap sensor. The controller may then divide the number of steps counted by the controller by three to give the average pitch length $L_P$ of the labels as a number of steps. This average pitch length of the labels given in steps can then be used in combination with the measured diameter of the take up spool in order to determine the label pitch in a desired unit.

In some embodiments in which the controller counts the number of steps the motor is commanded to advance whilst a plurality of labels and gaps are sensed by the detector of the gap sensor, the controller may count the number of steps whilst the motor is commanded to advance a number of steps which is at least a determined number of steps which is equivalent to a predetermined length of label stock. The controller may determine the determined number of steps $N_S$ using the diameter of the take up spool (which may be obtained in any manner discussed within) and the predetermined length of label stock $L_{LP}$ according to the equation:

$$N_S = \frac{2L_{LP}}{A_S D_S} \tag{24}$$

where $A_S$ is the angle by which the spool support rotates per step of the motor and $D_S$ is the spool diameter.

The predetermined length of the label stock is preferably in excess of twice the greatest pitch length of label stock that will be utilised by the labelling machine. The predetermined length of label stock may be 300 mm.

In other embodiments the take up spool diameter may be determined at step S4 and the label pitch length may be determined at step S5 using the print roller encoder.

For example, the take up spool diameter may be determined at step S4 as follows. The controller may energise the motor 14 to rotate so as to wind more label stock on to the take up spool support 12. The controller may be energised so as to wind a predetermined length of label stock on to the take up spool support 12 as measured by the print roller encoder. The controller monitors the number of steps of the motor 14 which are required to wind the predetermined length of label stock on to the take up spool support 12. The controller then calculates the take up spool diameter based upon a knowledge of the number of steps of the motor 14 required for the motor to complete a single revolution, the length of the predetermined distance, and the number of steps the motor 14 executes in winding the predetermined length of label stock on to the take up spool support 12.

In other embodiments the controller may be energised so as to rotate the motor 14 by a predetermined number of steps so as to wind label stock on to the take up spool support 12. The controller monitors the length of label stock wound on to the take up spool support 12 measured by the print roller encoder whilst the motor 14 executes the predetermined number of steps. The controller then calculates the take up spool diameter based upon a knowledge of the number of steps of the motor 14 required for the motor to complete a single revolution, the predetermined number of steps the motor 14 executes, and the length of label stock wound on to the take up spool support 12 measured by the print roller encoder whilst the motor 14 executes the predetermined number of steps.

The label pitch length may be determined at step S5 using the print roller encoder as follows.

The controller advances the motor which drives the take up spool support. The controller also monitors the signal output by the print roller encoder and the signal 56 provided by the detector 52 of the gap sensor. The controller uses the signal output by the print roller encoder to measure the distance along the web path the label stock moves whilst a label is sensed and hence determines the length of a label $L_L$. Likewise, the controller uses the signal output by the print roller encoder to measure the distance along the web path the label stock moves whilst a gap is sensed and hence determines the length of a gap $L_G$. The controller then sums $L_L$ and $L_G$ in order to calculate $L_P$. In some embodiments the controller may use the signal output by the print roller encoder to measure the distance along the web path the label stock moves between the gap sensor sensing a leading edge of a first label and a leading edge of the subsequent label—this distance is then set by the controller as the pitch length $L_P$ of the label stock 18.

In some embodiments, the controller may use the signal output by the print roller encoder to measure the distance along the web path the label stock moves whilst a plurality of labels and gaps are sensed by the detector of the gap sensor. The controller may then work out the label length, gap length and/or pitch length by averaging the measured label length, gap length and/or pitch length. For example, the controller may measure the distance along the web path the label stock moves whilst the controller monitors the signal 56 and senses that a total of three labels and three gaps have passed the gap sensor. The controller may then divide the measured distance by three to give the average pitch length $L_P$ of the labels.

In some embodiments the take up spool diameter may be determined at step S4 and the label pitch length may be determined at step S5 at the same time—i.e. steps S4 and S5 may be carried out at the same time. For example, the controller may determine the pitch length of the label stock as described above by advancing the motor which drives the take up spool support and monitoring the signal output by the print roller encoder and the signal 56 provided by the detector 52 of the gap sensor. The controller may advance the label stock along the label web path such that the signal 56 indicates that one label and gap have passed the gap sensor. The controller may then use signal output by the print roller encoder to determine how far the label stock has advanced along the web path during said advancement and hence determine the pitch length of the label stock. At the same time, whilst the label stock has been advanced along the web path, the controller counts the number of steps the motor has executed to produce the advancement of the label stock. The controller then calculates the diameter of the take up spool based upon the number of steps of the motor 14 required for the motor to complete a single revolution, the distance the label stock has advanced along the web path during said advancement as measured by the print roller encoder, and the number of steps the motor 14 has executed in producing said advancement of the label stock along the label web path used to determine the pitch length of the label stock. In some embodiments, the controller may advance the label stock along the label web path by a distance such that a plurality of labels and gaps have passed the gap sensor—the pitch length is then determined as an average as determined above. The diameter of the take up spool may then be determined using the advancement distance which is equivalent to a plurality of labels and gaps.

In some labelling machines the main source of inaccuracy in measuring the pitch length of the label stock may be the edge detection performance of the gap sensor. For instance the gap sensor may detect edges to within an error of +/−0.25 mm Therefore the distance between two edges may be measured within an error of +/−0.5 mm Shorter labels (hence label stock with a shorter label pitch) will have an error which is proportionally larger compared to that of longer labels (hence label stock with a longer label pitch). For this reason, it may be advantageous in certain embodiments to measure the length of a plurality of labels and gaps (as discussed above) and determine an average label length, average gap length and/or average pitch length.

In some embodiments erroneous data regarding measured label length or measured gap length may be rejected whilst determining an average label length, an average gap length and/or an average pitch length.

One potential cause of erroneous data may be missing labels. For example, if a label is missing then it will cause the controller to measure a large gap between the labels either side of where the missing label would have been located, the gap being larger than the standard gap between adjacent labels. It will be appreciated that if the length of such a large gap resulting from a missing label were measured and then averaged in addition to the length of other, standard, measured gaps, then this would result in an incorrect average of greater length than the average length of standard gaps which would otherwise be determined.

In some embodiments erroneous data regarding measured gap length is rejected as follows. The controller monitors the measured gap length for each measured gap. The controller may check that the measured gap length is above a minimum predetermined gap length and/or below a maximum predetermined gap length. In one embodiment the minimum predetermined gap length is 1 mm and the maximum predetermined gap length is 10 mm, however, it will be appreciated that other embodiments may use any appropriate minimum and/or maximum predetermined gap length. If a measured gap length is not greater than the minimum predetermined gap length and/or not less than the maximum predetermined gap length, then such a measured gap length is not included by the controller when determining an average gap length of the label stock and/or an average pitch length of the label stock.

In some embodiments erroneous data regarding measured label length is rejected as follows. The controller monitors the measured label length for each measured label. The controller may check the measured label length and compare it to the measured label length for the preceding measured label. If the difference in length between the measured label length and the measured label length of the preceding measured label is greater than a predetermined amount then the measured label length is not included by the controller when determining an average label length of the label stock and/or an average pitch length of the label stock. In one example the predetermined amount is 50% of measured label length for the preceding measured label. It will be appreciated that in other embodiments the predetermined amount may be any appropriate amount.

In some embodiments erroneous data regarding measured label length is rejected as follows. The controller monitors the measured label length for first measured label after the labelling machine has been switched on. The controller may then check the measured label length and compare it to the measured label length for the subsequent measured label. If the difference in length between the measured label length of the first measured label and the measured label length of the subsequent measured label is greater than a predetermined amount then the measured label length of the first label is not included by the controller when determining an average label length of the label stock and/or an average pitch length of the label stock. In one example the predetermined amount is 50% of measured label length of the subsequent label. It will be appreciated that in other embodiments the predetermined amount may be any appropriate amount.

At step S6 the controller positions the leading edge of a label at the edge of the labelling peel beak 30. This is achieved as follows. The controller monitors the signal 56 provided by the detector 52 of the gap sensor so as to detect the leading edge of a label. The controller then commands the motor 14 to advance a calculated number of steps such that the label stock advances by a linear displacement equal to the distance $D_B$ (as shown in FIG. 3) between the detector 52 and the edge 66 of the labelling peel beak 30. The number of steps is calculated by dividing the distance $D_B$ by the radius of the take up spool and by the rotation angle per step in radians. In other embodiments, once the controller determines from the signal 56 provided by the detector 52 of the gap sensor that the leading edge of a label has been detected, the controller then commands the motor 14 to advance until the distance of advancement of the label stock along the label web path measured by the print roller encoder is equal to the distance $D_B$ between the detector 52 and the edge 66 of the labelling peel beak 30.

At S7 the labelling machine is ready to operate.

During operation, periodically steps S8 and S9 are carried out.

At step S8 the controller calculates and updates the diameter of the spool mounted to the supply spool support 10.

The process of calculating and updating the supply spool diameter is first discussed below in the case where the movable element (dancing arm) does not move during the process. Subsequently, the case where the movable element moves during the process is discussed.

In one embodiment, in order to achieve this, for a given amount of time the controller monitors the signal 56 provided by the detector 52 of the gap sensor. The controller counts the number of periods of the signal 56 during said given time and multiplies this by $L_P$ in order to determine the linear displacement of the label stock during said given time. During said given time the controller also monitors a signal provided to it by a rotation monitoring sensor which monitors the rotation of the supply spool support 10 (and supported supply spool). Hence the controller determines the amount of rotation of the supply spool support 10 (and supported supply spool). As discussed above, the controller can then determine the diameter of the supply spool based upon the linear displacement of the label stock and the amount of rotation of the supply spool support 10 during said given time. The given amount of time may be defined as the time it takes for a predetermined number of periods of the signal 56 to be received by the controller, or may be defined as the time it takes for the supply spool to rotate by a predetermined number of rotations (as measured by the rotation monitoring sensor).

In an alternative embodiment at step S8 the controller calculates and updates the diameter of the spool mounted to the supply spool support 10 as follows. For a given amount of time the controller monitors the amount of rotation of the supply spool support by monitoring the signal produced by the supply spool rotation monitor. For example, the given amount of time may be the time it takes for the supply spool support to undergo an integer number of complete rotations (as measured by the supply spool rotation monitor). During the given amount of time the controller counts the number of steps that the take up motor is commanded to advance. Based upon this information and on the diameter of the take up spool which has been determined by the controller in either step S4 or step S9, the controller can calculate the length of label stock which has been wound on to the take up spool in the given amount of time. In alternative embodiments, the given amount of time may be defined as the time it takes to advance the take up motor a predetermined number of steps, and rotation of the supply spool measured by supply spool rotation monitor during this time may be used to determine the diameter of the supply spool.

In a further embodiment, at step S8 the controller calculates and updates the diameter of the spool mounted to the supply spool support 10 as follows. The supply spool diameter may be determined using the signal output by the print roller encoder and the signal produced by the supply spool rotation monitor. The controller may energise the motor 14 to rotate so as to wind more label stock on to the take up spool support 12. The controller may be energised so as to wind a predetermined length of label stock on to the take up spool support 12 as measured by the print roller encoder. The controller monitors the signal produced by the supply spool rotation monitor to determine the amount of rotation of the supply spool whilst the predetermined length of label stock is wound on to the take up spool support 12. The controller then calculates the supply spool diameter based upon knowledge of the amount of rotation of the supply spool and the predetermined length.

In other embodiments the controller may be energised so as to rotate the motor 14 by a predetermined number of steps so as to wind label stock on to the take up spool support 12. The controller monitors the length of label stock wound on to the take up spool support 12 measured by the print roller encoder whilst the motor 14 executes the predetermined number of steps. The controller also monitors the signal produced by the supply spool rotation monitor to determine the amount of rotation of the supply spool whilst the predetermined number of steps is executed by the motor 14. The controller then calculates the supply spool diameter based upon a knowledge of the length of label stock wound on to the take up spool support 12 measured by the print roller encoder whilst the motor 14 executes the predetermined number of steps, and amount of rotation of the supply spool whilst the predetermined number of steps is executed by the motor 14.

In an alternative embodiment at step S8 the controller calculates and updates the diameter of the spool mounted to the supply spool support 10 as follows. For a given amount of rotation of the supply spool support determined by monitoring the signal produced by the supply spool rotation monitor, the controller monitors the amount of label stock wound on to the take up spool by monitoring the signal output by the print roller encoder. The controller then calculates the supply spool diameter based upon knowledge of the length of label stock wound on to the take up spool measured by the print roller encoder and the given amount of rotation of the supply spool measured by the supply spool rotation monitor. For example, in an embodiment in which the supply spool rotation monitor includes a pair of magnets attached to the spool support and a Hall Effect sensor such that the Hall Effect sensor outputs two pulses for every full rotation of the spool support, as previously discussed, the given amount of rotation of the supply spool discussed above may be a given number of pulses output by the Hall Effect sensor.

During the given amount of time, given amount of rotation of the supply spool, predetermined distance or predetermined number of steps the controller also monitors the position of the dancing arm by monitoring the signal provided to the controller by the sensor configured to produce a sensor signal indicative of the position of the moveable element (dancing arm). By comparing the position of the dancing arm at the beginning of the given amount of time, given amount of rotation of the supply spool, predetermined distance or predetermined number of steps, and at the end of the given amount of time, given amount of rotation of the supply spool, predetermined distance or predetermined number of steps, as discussed above, the controller can determine the change in path length between the supply spool support and take up spool support which has occurred between the beginning of the given amount of time, given amount of rotation of the supply spool, predetermined distance or predetermined number of steps, and the end of the given amount of time, given amount of rotation of the supply spool, predetermined distance or predetermined number of steps. The controller then adds the change in path length (which is positive if the path length has increased and negative if the path length has decreased) between the supply spool support and take up spool support during the given amount of time to the amount of label stock wound onto the take up spool support during the given amount of time. This gives the amount of label stock which has been unwound from the from the supply spool support during the given amount of time given amount of rotation of the supply spool, predetermined distance or predetermined number of steps. Based upon the amount of rotation of the supply spool support during the given amount of time, given amount of rotation of the supply spool, predetermined distance or predetermined number of steps and on the amount of label stock which has been unwound from the supply spool support during the given amount of time the controller can determine the diameter of the supply spool.

At step S9 the controller calculates and updates the diameter of the spool mounted to the take up spool support 12. In one embodiment, in order to achieve this, for a given amount of time the controller monitors the signal 56 provided by the detector 52 of the gap sensor. The controller counts the number of periods of the signal 56 during said given time and multiplies this by $L_P$ in order to determine the linear displacement of the label stock during said given time. For example, the given time may be such that the number of periods of the signal 56 during said given time is an integer number between 1 and 10. However, any appropriate given time may be used. During said given time the controller also counts the number of steps that the motor 14 is commanded to take. Hence the controller determines the amount of rotation of the take up spool support 12 (and supported supply spool). As discussed above, the controller can then determine the diameter of the take up spool based upon the linear displacement of the label stock and the amount of rotation of the take up spool support 10 during said given time.

In some embodiments the given amount of time the controller monitors the signal 56 provided by the detector 52 of the gap sensor may be the time it takes the label web to advance a predetermined linear distance. The predetermined linear distance is preferably in excess of twice the greatest pitch length of label stock that will be utilised by the labelling machine. The predetermined length of label stock may be 300 mm.

In other embodiments, at step S9, the controller calculates and updates the diameter of the spool mounted to the take up spool support 12 using the print roller encoder in the same manner as discussed in relation to step S4.

In some embodiments, such as those which do not include an encoder measuring movement of the label stock using an encoder which measures rotation of a print roller, the controller may determine the take up spool diameter and then wait until the take up spool has subsequently completed one rotation before re-determining the take up spool diameter. Likewise, in some embodiments the controller may determine the supply spool diameter and then wait until the supply spool has subsequently completed one rotation before re-determining the supply spool diameter.

In order to determine whether the take up spool has completed one rotation, the controller may wait for the take up motor to execute the number of steps equal to that for a complete rotation. Alternatively, the controller may use the determined diameter of the take up spool to determine the circumference of the take up spool. The controller can then monitor the signal output by the printer roller encoder to determine when the distance moved by the label stock along the label web path is equal to the determined circumference.

In order to determine whether the supply spool has completed one rotation, the controller may monitor the supply spool rotation monitor to determine when the supply spool has completed a rotation. Alternatively, the controller may use the determined diameter of the supply spool to determine the circumference of the supply spool. The controller can then monitor the signal output by the printer roller encoder and the movable element (e.g. dancing arm) position sensor to determine when the distance of label stock unwound from the supply spool is equal to the determined circumference.

In some embodiments determination of the supply spool diameter at step S8 may occur concurrently with at least one of steps S3, S4, S5 and S6.

Whilst the controller calculates and updates the diameter of the spool mounted to the take up spool support 12 the controller may carry out checks to detect erroneous data regarding measured label length or measured gap length. If any erroneous data is detected then the process of calculating and updating the diameter of the spool mounted to the take up spool support 12 may be aborted (such that no update of the diameter is carried out based upon the erroneous data). Subsequently, process of calculating and updating the diameter of the spool mounted to the take up spool support 12 is restarted (such that an update can be carried out without being affected by erroneous data). The controller may detect the presence of erroneous data in any appropriate manner. For example, the controller may detect the presence of erroneous data in any of the manners discussed above in relation to step S5.

In some embodiments, the start-up procedure may include a check to see whether the dancing arm position changed while the machine was powered off. In order to do this the controller uses the sensor configured to produce a sensor signal indicative of the position of the moveable element to measure and record the position of the movable element before the machine is switched off. Subsequently, when the machine is switched on, the controller uses the sensor configured to produce a sensor signal indicative of the position of the moveable element to measure the position of the movable element and compare it to the position of the movable element recorded before the machine was switched off. If the position of the movable element is substantially the same when the machine is switched on compared to when it was switched off then certain steps within the above start-up routine may be omitted. For example, steps S2 to S4, S3 to S5, S3 to S6 or S3 to S4 may be omitted. In this case the labelling machine may resume operation using the last known value (i.e. before the machine was switched off) of the take-up spool diameter. This is based upon the assumption that the label stock cannot move (thereby changing the diameter of the spools) without changing the position of the movable element (e.g. dancing arm). The purpose of omitting unnecessary steps is to reduce start-up time which may be beneficial in some applications. In some embodiments data indicative of the position of the movable element, the diameter of the take up spool and/or any other appropriate parameter may be stored in a battery-powered memory or any other suitable non-volatile memory. In some embodiments, data indicative of position of the movable member may be updated to the memory every time movement of the arm is detected by the controller. In other embodiments data indicative of the position of the movable element, the diameter of the take up spool and/or any other appropriate parameter may be updated to the memory at a suitable regular time interval.

In some embodiments, the start-up sequence may be modified compared to that discussed above. For example, in some embodiments the start-up sequence may be modified such that it proceeds in the order S1, S2, S3, S4, S6, S7, S5, S8, S9. Subsequently, as before, steps S7, S8 and S9 then repeat during on-going operation of the machine. In some applications this start-up sequence may be advantageous because by not determining the label pitch until the labelling machine is operating so as to dispense labels on to an article to be labelled this can reduce the time the start-up procedure (e.g. up to the ready to operate state S7) takes to complete and also prevent wastage of labels. This is because, in this embodiment, the labels dispensed whilst determining the label pitch are used by the labelling machine (i.e. applied to articles) as opposed to wasted (i.e. not applied to an article and dispensed only in order to determine label pitch).

The previously described start-up sequence may equally be applied in conjunction with a braking assembly including a solenoid as shown in FIGS. 5 to 11 or in conjunction with a braking assembly including a position controlled motor as shown in FIGS. 18 to 20.

As described above, some labelling machines may incorporate a printer and be referred to as print and apply labelling machines. A known type of print and apply labelling machine is a 'last label out' labelling machine. 'Last label out' labelling machines function so as to print a specific label for a specific article and then apply that label to the specific article. For example, a 'Last label out' labelling machine may operate such that for each article that passes the labelling machine a unique label is printed and then applied to the article. In some 'last label out' machines the printed label differs for each article, whereas in other 'last label out machines' the printed label may differ during the course of a production batch passing the labelling machine. Due to the fact that 'Last label out' labelling machines may print a unique label for each article before it is applied to the article, it is common for the printer of the labelling machine to be located in close proximity to the labelling peel beak. The location of the printer adjacent the labelling peel beak may make the portion of the labelling machine which includes the labelling peel beak bulky.

Certain known label and/or barcode positioning standards (e.g. the GS1 barcode positioning standard produced by GS1 UK) require that labels incorporating a barcode are applied by the labelling machine at a particular position on an article (which may also be referred to as a traded unit or an outer case). For example, if the labelling machine is configured to apply labels to articles which pass the labelling machine on a conveyor, then known label positioning standards may necessitate that the labelling machine is configured to apply labels to each article on the conveyor such that the bottom of a barcode symbol on each label is located at a height of approximately 32 mm from the base of the article (and hence approximately 32 mm from the conveyor). Known label positioning standards may necessitate that the labelling machine is configured to apply labels to each article on the conveyor such that a barcode symbol on each label is located at a distance of greater than approximately 19 mm from an edge of the article. The edge of the article may be a front edge of the article. The front edge of an article may be an edge of an article which is forward-most with respect to the direction of travel of the article on the conveyor.

In cases where known print and apply labelling machines of the 'last label out' type are required to apply labels to articles at a relatively low height from a conveyor (for example at a height such that the bottom of a barcode symbol on each label is located approximately 32 mm from the conveyor), due to the fact that the portion of the labelling machine which includes the labelling peel beak is bulky, it may not be possible to position such a known print and apply labelling machine of the 'last label out' type adjacent the conveyor such that labels can be printed and subsequently applied to an article at a position adjacent the labelling peel beak and printer of the labelling machine. In order to solve this problem, some known print and apply labelling machines of the 'last label out' type may be located at a position such that the labelling peel beak and printer are remote from the conveyor (and hence articles on the conveyor). Such labelling machines may then incorporate a tamp (or any other appropriate label transfer device) which is controllably moved so as to transfer each label from the labelling peel beak of the labelling machine and subsequently apply it to the required position on each article. However, the use of a tamp (or any other appropriate label transfer device) in this manner may be disadvantageous. For example, the label transfer means will increase the complexity and cost of the labelling machine. In addition, the label transfer device is an additional component of the labelling machine which may fail, thus causing the labelling machine to become inoperable. Furthermore, the time it takes for a printed label to be transferred by the label transfer device from the labelling machine to the desired article on the conveyor may increase the time it take for labels to be applied to an article, thereby reducing the throughput of the labelling machine and/or conveyor.

A labelling machine according to an embodiment of the present invention seeks to obviate or mitigate the above problem.

FIG. 32 shows a schematic cross-sectional view of a portion of a production line to which a labelling machine 400 according to an embodiment of the present invention is mounted.

The portion of the production line 402 shown in the figure includes a base 403 having a sidewall 404. The base 403 supports a conveyor belt 406. The conveyor belt 406 is driven such that it travels in a direction which is into the page as shown in FIG. 32. The conveyor belt 406 is configured to support articles to be labelled by the labelling machine 400. The figure shows one such article 408 to be labelled. In this case, the article 408 is a generally cuboid box, although may be any appropriate article.

The sidewall 404 of the base extends above the surface of the conveyor belt 406 which supports the articles to be labelled by the labelling machine 400. Thus, the sidewall 404 acts as a barrier to prevent any articles being supported by the conveyor belt 406 from falling off the side of the conveyor belt 406. In other embodiments the sidewall may be separate to the base. In some embodiments, the sidewall may extend inboard of an edge of the conveyor belt.

The labelling machine 400 is mounted to the production line. In this case the labelling machine is mounted to the sidewall 404 of the base 403 of the production line 402. It will be appreciated that in other embodiments the labelling machine may be mounted in any appropriate manner to the production line. In some embodiments the labelling machine may not be mounted directly to the production line. The labelling machine may be mounted in any appropriate manner providing that the labelling machine has a fixed positional relationship with a portion of the production line (for example the conveyor (e.g. conveyor belt)).

The labelling machine 400 shown in FIG. 32 may have the same configuration as (or a similar configuration to) any of the previously discussed embodiments. The view of the labelling machine shown in FIG. 32 has been simplified so as to aid clarity. Various components of the labelling machine have been omitted. Furthermore, although label stock and print ribbon are shown supported by the take up spool support and ribbon take up spool support respectively (discussed in more detail below), neither the label stock or print ribbon are shown extending along their respective paths through the machine. Features of the labelling machine shown in FIG. 32 which correspond to features already discussed in relation to other embodiments have been given the same numbering.

The labelling machine 400 comprises a take up spool support 12 for supporting label stock as it is wound onto the take up spool support 12. The labelling machine 400 also comprises a printer including a ribbon take up spool support 40, for supporting printer ribbon as it is wound onto the ribbon take up spool support 40. The take up spool support 12 and ribbon take up spool support 40 are both driven for rotation by respective motors 14 and 414.

All of the components of the labelling machine mentioned in the preceding paragraph are mounted to a base plate 410 and are housed in a casing 412. Each of the take up spool support 12, ribbon take up spool support 40 and motors 14 and 414 comprise a main body and a rotatable shaft which extends from the main body. The main body of each of the take up spool support 12, ribbon take up spool support 40 and motors 14 and 414 is mounted to an upper surface 410*a* of a base plate 410 such that their respective rotatable shafts pass through respective apertures in the base plate 410 and extend beyond a lower surface 410*b* of the base plate 410. Pulleys 416, 420, 418, 422 are mounted to each of the respective shafts of the take up spool support 12, ribbon take up spool support 40 and motors 14 and 414 such that each pulley 416, 420, 418, 422 is located on the other side of the base plate 410 compared to the respective main body.

The pulley 416 of the take up spool support 12 is connected to the pulley 418 of the motor 14 by a first belt (shown in dashed line and indicated by 424), such that the motor 14 can drive the take up spool support 12 for rotation via the pulleys 416, 418 and the belt 424. The pulley 420 of the ribbon take up spool support 40 is connected to the pulley 422 of the motor 414 by a second belt (shown in dashed line and indicated by 426), such that the motor 414 can drive the ribbon take up spool support 40 for rotation via the pulleys 420, 422 and the belt 426.

The supply spool support which supports the label stock and the ribbon supply spool support which supports the printer ribbon are not shown so as to improve the clarity of the figure. The supply spool support and ribbon supply spool support are also mounted to the upper surface 410*a* of the base plate 410. If either of the supply spool support and ribbon supply spool support are driven for rotation by a respective motor, then they may be driven by a motor via a belt and pulleys in a similar manner to that discussed above. Any such motor may have a main body secured to the upper surface 410*a* of the base plate 410. Again, the shaft of any motor or driven supply spool support or driven ribbon supply spool support passes through a respective aperture in the base plate.

A labelling peel beak 30 is also mounted to the base plate 410. In use, the motor 14 drives the take up spool support 12 such that a portion of the web of the label stock is wound onto the take up spool support 12. A print head (not shown) is controlled to transfer ink from the print ribbon onto labels of the label stock to form a desired image on each label as it passes the print head. When required the motor 414 drives the ribbon take up spool support 40 to advance the print ribbon. The advancement of the conveyor 406 is co-ordinated with the drive of the take up motor 14 such that as an article 408 passes on the conveyor 406, the take up motor 14 is driven to advance the label stock such that a label which has been printed for the article is advanced to the labelling peel beak and then separated from the web by the labelling peel beak 30 and subsequently applied to the article 408.

The arrangement of the labelling machine as discussed above, whereby the main body of each component is located on the same side of the base plate may be advantageous in certain applications. For example, due to the fact that there is little more than the pulleys and associated belts on the lower side of the of base plate (i.e. the side of the base plate which includes the lower surface), the distance between the bottom of the labelling machine and the labelling peel beak (i.e. the point at which labels are dispensed from the machine) is reduced. A reduction in the distance between the bottom of the labelling machine and the labelling peel beak means that if the labelling machine (and mere specifically has to be positioned above some feature to the side of the conveyor of the production line (for example a side wall as shown in FIG. 32), then the height h between the conveyor (e.g. the surface of the conveyor on which the conveyed articles are supported) and the labelling peel beak is minimised. By minimising the height h between the conveyor and the labelling peel beak, the minimum height on an article conveyed by the conveyor at which the labelling machine can apply a label is also reduced. This may allow the labelling machine to apply a label to an article at a height which meets a desired standard (e.g. the GS1 standard) without the need for a label transfer device.

Within the embodiment described above, all the components driven by motor are driven via a linkage (a pair of pulleys and a belt). This need not be the case. For example, in some embodiments at least one of the take up spool support, supply spool support, ribbon take up spool support and ribbon supply spool support may be driven directly. By directly driven it is meant that the spool support may be mounted co-axially with the shaft of the motor which drives the spool support for rotation. The spool support may be mounted to a motor spindle of a motor. In some embodiments, both the ribbon take up spool support and ribbon supply spool support may be driven directly. In the case where a spool support is driven directly by a motor, the motor may be mounted such that none of the motor protrudes past the lower surface of the base plate or such that the amount of the motor which protrudes past the lower surface of the base plate is minimised.

Although the base plate 410 in the described embodiment is a single component, in other embodiments the base plate may be constructed from a plurality of components.

Although the embodiment discussed above includes an aperture in the base plate for each component shaft to pass through the base plate, in other embodiments more than one component shaft may pass through a single aperture. In some embodiments there may be a single aperture in the base plate through which all of the component shafts pass.

Although in the embodiment above the linkage between a spool support and motor comprises a belt and two pulleys, it will be appreciated that in other embodiments any appropriate linkage may be used. For example, chains and gears may be used instead, or alternatively meshing gear wheels may be used. In some embodiments any linkage linking a motor to a spool support may be located on the upper side of the base plate such that there is no linkage on the lower side of the base plate. That is to say, the spool support, motor and linkage linking the spool support and motor may all be located on the same side of the base plate.

The construction and operation of various embodiments of a labelling machine have been described above. As has been mentioned, such labelling machines may be used to apply labels to articles/products passing on a conveyor of a production line. Having carried out a start-up procedure, for example, as described above, operation of the labelling machine to dispense labels can begin.

The controller determines a linear speed $V_t$ at which the web is to be fed. In some applications it is necessary for this linear speed to match the speed at which a product is conveyed past the labelling machine by a conveyor. The speed at which the product is conveyed past the labelling machine can be provided as an input to the controller from a line encoder. Any appropriate encoder may be used to determine the speed of the conveyor (and hence the speed at which the product is conveyed past the labelling machine). In one example, the line encoder may be attached to a wheel of known diameter which runs against the conveyor such that the linear movement of the wheel matches the linear movement of the conveyor. The line encoder can thus provide details of a distance through which the wheel has turned. Given knowledge of the time taken to travel that distance, the speed of the conveyor can easily be determined.

In alternative applications the speed at which the label stock is to be moved may be input to the controller by an operator, as a manual input.

Operation of the labeller is normally initiated by a product sensor being triggered indicating that a product is approaching the labelling machine. It is preferred that the controller is programmed with a so-called "registration delay". Such a registration delay can indicate a time which should elapse (monitored by a simple timer) after detection of the product by the product sensor before the labelling process begins, or alternatively indicate a distance through which the conveyor should move (as monitored by the encoder) before the labelling process begins. The registration delay may be input to the controller by an operator of the labelling machine. It will be appreciated that by adjusting the registration delay, the position at which a label is affixed to a passing product may be adjusted.

Movement of the label stock during a label feed operation is illustrated by the speed/distance graph of FIG. 33. It can be seen that the total distance through which the label stock is moved in dispensing a single label is indicated $N_p$, denoting that the stepper motor turns through $N_p$ steps to cause the movement of the label stock. Having detected a label edge, the stepper motor turns through $N_0$ steps before the label stock comes to rest, where $N_0$ is determined as described below to ensure that a label edge is aligned with the edge of the labelling peel beak. In alternative embodiments which include an encoder which outputs a signal which can be used by the controller to determine an amount of movement of the label stock along the label web path (e.g. an encoder which monitors rotation of a print roller), the total distance through which the label stock is moved in dispensing a single label is indicated $N_p$, denoting the distance measured by the encoder through which the label stock is moved in dispensing a single label. Having detected a label edge, the stepper motor advances the label stock by a distance $N_0$ as measured by the encoder before the label stock comes to rest.

The label stock is accelerated from rest to the target speed $V_t$. The label stock then moves at the target speed $V_t$ before being decelerated to rest. $N_d$ indicates the number of steps through which the stepper motor driving the take up spool support turns to decelerate the label stock. It will be appreciated that the numbers of steps $N_p$ $N_0$ and $N_d$ are determined with reference to the diameter of the take-up spool $d_t$ (which may be determined using any appropriate method, including those described above) as is now described. Although the graph of FIG. 33 shows a simple speed/distance profile for the label stock, it will be appreciated that in some circumstances different speed/distance profiles may be appropriate. In particular, it may sometimes be appropriate to vary the target speed $V_t$ as the label stock is moved. It will also be appreciated that to achieve a particular target linear speed (i.e. speed of label stock moving along the web path) the speed of the take up motor may change during the operation of the labelling machine as a function of changing take up/supply spool diameters.

FIG. 34 is a flow chart showing operation of the labelling machine to feed a single label. Processing begins at step S25 where a check is carried out to determine whether the product sensor has been triggered by a passing product. If this is the case, processing passes to step S29 otherwise, processing remains at step S25 until the product sensor is triggered by a passing product.

At step S29 pulses provided by the line encoder discussed above are counted. At step S30 a check is carried out to determine whether the number of pulses received is equal to the distance which corresponds to a predetermined registration delay $R_d$. If this is not the case processing returns from step S30 to step S29 and a loop is thereby established until the conveyor has moved through the distance specified by the registration delay $R_d$. Processing then passes to step S26

At step S26 a check is carried out to determine whether an additional time registration delay is required. If an additional time registration delay is required, processing passes from step S26 to step S27 where a timer is initialised. Processing then passes to step S28 where a check is carried out to determine whether the elapsed time is equal to the required time registration delay $R_{td}$. Processing remains at step S28 until the elapsed time is equal to the required time registration delay $R_{td}$.

When the distance (and, if applicable, additional time) of the registration delay has passed, processing passes from step S28 or step S26 to step S31, where the controller calculates various parameters required to define the way in which the label stock will be moved. More particularly the controller computes the numbers of steps through which the stepper motor is to be turned to cause the desired movement of the label stock, the number of steps through which the stepper motor should be turned after detection of an edge so as to allow a label edge to be properly aligned with the labelling peel beak, and the step rate $M_r$ at which the stepper motor which drives the take up spool support should be turned given the desired linear label stock speed which is determined as described above.

In some embodiments, the total number of steps $N_p$ through which the stepper motor which drives the take up spool is to be turned is given by equation (25)

$$N_p = L_p \frac{N_{revolution}}{\pi d_t} \tag{25}$$

where $L_P$ is the pitch length of the label stock, $N_{revolution}$ is the number of steps through which the stepper motor turns to rotate the take up spool support a single revolution and $d_t$ is the diameter of the take-up spool.

The distance $E_0$ through which the label stock should be fed following detection of an edge by the gap sensor in order to cause the leading edge of a label to be aligned with the edge of the labelling peal beak can, if required, be converted into a number of steps $N_0$ using equation (26):

$$N_o = E_o \frac{N_{revolution}}{\pi d_t} \tag{26}$$

The step rate $M_r$ at which the take up stepper motor should step is determined with reference to the desired linear speed of the label stock $V_t$ which as described above can either by input by an operator, or alternatively determined using an encoder. The step rate $M_r$ is given by equation (27):

$$M_r = V_t \frac{N_{revolution}}{\pi d_t} \tag{27}$$

Referring again to FIG. 34, having determined the necessary parameters at step S31, processing passes to step S33.

At step S33, the number of steps $N_g$ remaining in the current feed is set to be equal to the total number of steps $N_p$ in a single label feed. A parameter $C_r$ indicating the current step rate is initialized to a value of zero.

In alternative embodiments which include an encoder which outputs a signal which can be used by the controller to determine an amount of movement of the label stock along the label web path (e.g. an encoder which monitors rotation of a print roller), at step S33, if the total distance $N_p$ required to feed a single label is already known then the distance $N_g$ to be measured by the encoder remaining in the current feed is set to be the total distance $N_p$ required to feed a single label. The total distance $N_p$ required to feed a single label may already be known when the pitch of the label web $L_P$ is less than the distance between the gap sensor and the label peel beak. In such cases, the trailing edge of next label to be dispensed during the label feed will have already passed the gap sensor.

However, if the total distance $N_p$ required to feed a single label is not already known then $N_g$ is set to an amount larger than the longest possible pitch of label stock which may be utilised in conjunction with the labelling machine. For example, in some embodiments $N_g$ is set to 500 mm. The total distance $N_p$ required to feed a single label is not already known when the pitch of the label web $L_P$ is greater than the distance between the gap sensor and the label peel beak. In such cases, the trailing edge of next label to be dispensed during the label feed will not yet have passed the gap sensor. Only when the trailing edge of next label to be dispensed during the label feed passes the gap sensor will the remaining distance the label stock has to be advanced to dispense the next label be known.

Processing passes from step S33 to step S34 where a number of steps $N_d$ required to decelerate the label stock from its current speed to rest is determined. $D_{max}$ is the maximum deceleration of the label stock which can be achieved using the take up stepper motor. The maximum deceleration may be determined in any appropriate way known in the art. For example, it may be determined as described in PCT application WO2010/018368 which is incorporated herein by reference. The linear distances through which the label stock is moved to decelerate from a current linear speed $V_c$ to a target linear speed $U_t$ is given by the familiar equation:

$$U_t^2 = V_c^2 - 2D_{max}s \tag{28}$$

where s represents distance.

Given that the target linear speed $U_t$ is zero, and rearranging equation (28), the following expression for the linear distance s can be derived:

$$s = \frac{V_c^2}{2D_{max}} \tag{29}$$

The linear distance s can be converted into a number of steps $N_d$, such that equation (29) becomes:

$$N_d = \left(\frac{V_c^2}{2D_{max}}\right)\left(\frac{N_{revolution}}{\pi d_t}\right) \tag{30}$$

Processing passes from step S34 of FIG. 34 to step S35. At step S35 a check is carried out to determine whether the label position sensor (also referred to as the gap sensor) has detected a label edge. If this is the case, processing passes from step S35 to step S36 where the number of steps remaining in the current label feed $N_g$ is set to be equal to the number of steps $N_0$ through which the label stock should be moved to align a label edge with the labelling peel beak.

In alternative embodiments which include an encoder which outputs a signal which can be used by the controller to determine an amount of movement of the label stock along the label web path (e.g. an encoder which monitors rotation of a print roller), at step S35, if label position sensor (also referred to as the gap sensor) has detected a label edge, and if $N_g$ was set to be an amount larger than the longest possible pitch of label stock which may be utilised in conjunction with the labelling machine at step S33, then processing passes from step S35 to step S36 where the distance as measured by the encoder remaining in the current label feed $N_g$ is set to be the distance $E_0$ through which the label stock should be moved to align a label edge with the labelling peel beak.

Processing then passes to step S37. If a label edge has not been detected by the label position sensor 52, processing passes directly from step S35 to step S37.

At step S37 a check is carried out to determine whether the number of steps remaining in the current feed is equal to zero. If this is the case processing passes to step S38 where the feed ends.

If this is not the case, processing passes to step S39 where a check is carried out to determine whether the number of steps remaining in the current label feed $N_g$ is less than or equal to the number of steps $N_d$ required to decelerate the label stock. If this is the case, processing passes to step S40 where a deceleration step rate is determined. In alternative embodiments which include an encoder which outputs a signal which can be used by the controller to determine an amount of movement of the label stock along the label web path (e.g. an encoder which monitors rotation of a print roller), at step S39, a check is carried out to determine whether the distance remaining in the current label feed $N_g$ based upon the output of the encoder is less than or equal to the distance s required to decelerate the label stock. If this is the case, processing passes to step S40 where a deceleration step rate is determined. Once it has been determined by the controller that the distance remaining in the current label feed $N_g$ based upon the output of the encoder is equal to the distance s required to decelerate the label stock, the controller enters a deceleration mode in which the distance remaining in the current label feed $N_g$ is converted by the controller to a number of steps $N_g$ remaining in the current label feed (which is equal to the number of steps $N_d$ required for the deceleration of the label stock). Subsequent control of the movement of the label stock by the controller in deceleration mode is based upon the number of steps $N_g$ remaining in the current label feed and not on the signal output by the encoder.

The deceleration step rate is determined by determining the lowest rate $C_{r+1}$ at which the motor can be caused to step, given the limitation of the maximum possible deceleration $D_{max}$ and the current step rate $C_r$. It is determined using equation (31):

$$C_{r+1} = \sqrt{C_r^2 - \frac{2D_{max}N_{revolution}}{\pi d_t}} \tag{31}$$

Equation (31) is based upon equation (28) which can be expressed as follows:

$$V_{c+1}^2 = V_c^2 - 2D_{max}S_w \tag{32}$$

where $V_c$ is the current linear label stock speed;

$V_{c+1}$ is the new linear label stock speed; and $S_w$ is the linear distance through which the label stock is moved in a single step.

Equation (32) can be rearranged to give:

$$V_{c+1} = \sqrt{V_c^2 - 2D_{max}S_w} \tag{33}$$

The linear distance $S_w$ through which the label stock is moved in a single step is given by equation (34):

$$S_w = \frac{\pi d_t}{N_{revolution}} \tag{34}$$

The new linear label stock speed can be related to a step rate using equation (35):

$$V_{c+1} = \frac{C_{r+1}\pi d_t}{N_{revolution}} \tag{35}$$

Equation (35) can be rearranged to give:

$$C_{r+1} = V_{c+1}\frac{N_{revolution}}{\pi d_t} \tag{36}$$

Substituting equation (33) into equation (36) gives:

$$C_{r+1} = \sqrt{V_c^2 - 2D_{max}S_w}\left(\frac{N_{revolution}}{\pi D_t}\right) \tag{37}$$

The current linear label stock speed $V_c$ is related to the current step rate by equation (38):

$$V_c = \frac{C_r\pi d_t}{N_{revolution}} \tag{38}$$

Substituting equations (34) and (38) into equation (37) gives:

$$C_{r+1} = \left(\sqrt{\left(\frac{C_r \cdot \pi d_t}{N_{revolution}}\right)^2 - 2D_{max}\frac{\pi d_t}{N_{revolution}}}\right)\frac{N_{revolution}}{\pi d_t} \tag{39}$$

Equation 39 can be rearranged to give equation (31), viz:

$$\begin{aligned} C_{r+1}^2 &= \left(\left(\frac{C_r \cdot \pi d_t}{N_{revolution^*}}\right)^2 - 2D_{max}\frac{\pi d_t}{N_{revolution^*}}\right)\cdot\left(\frac{N_{revolution^*}}{\pi d_t}\right)^2 = \\ &\left(\frac{(C_r \cdot \pi d_t)^2}{(N_{revolution^*})^2} - 2D_{max}\frac{\pi d_t}{N_{revolution^*}}\right)\cdot\frac{(N_{revolution^*})^2}{(\pi d_t)^2} = \\ &\left(\frac{C_r^2 \cdot \pi d_t^2}{(N_{revolution^*})^2} - 2D_{max}\frac{\pi d_t}{N_{revolution^*}}\right)\cdot\frac{(N_{revolution^*})^2}{(\pi d_t)^2} = \\ &\left(\frac{C_r^2}{(N_{revolution^*})^2} - 2D_{max}\frac{1}{N_{revolution^*}\cdot\pi d_t}\right)\cdot(N_{revolution^*})^2 = \\ &C_r^2 - 2D_{\max}\frac{\pi d_t}{N_{revolution}} \therefore C_{r+1} = \sqrt{C_r^2 - \frac{2D_{max}N_{revolution}}{\pi d_t}} \end{aligned} \tag{31}$$

Referring back to FIG. 34, having determined a step rate to effect deceleration at step S40, processing passes to step S51, which is described in further detail below.

If the check of step S39 determines that the number of steps remaining in the current label feed $N_g$ is not less than or equal to the number of steps $N_d$ required to decelerate the label stock, (or that the distance $N_g$ remaining in the current label feed is not less than or equal to the distance s required to decelerate the label stock) processing passes to step S41.

The check of step S39 is required to ensure proper operation where the target speed $V_t$ and consequently the target step rate $M_r$ varies during movement of the label stock. If it were the case that the target step rate did not vary, the check of step 39 need not be carried out.

At step S41 a check is carried out to determine whether the current step rate is too fast. This check determines whether the inequality of equation (40) is true:

$$C_r > M_r \tag{40}$$

If this is the case, processing passes from step S41 to step S42, where a step rate to effect deceleration is calculated using equation (31) set out above. Processing passes from step S42 to step S43 where a check is carried out to determine whether the step rate determined at step S42 is less than the target step rate $M_r$ if this is the case, the step rate is set to be equal to the target step rate $M_r$ at step S44. Processing passes from step S44 to step S51, otherwise, processing passes directly from step S43 to step S51.

If the check of step S41 indicates that the step rate is not too high, processing passes from step S41 to step S45. At step S45 a check is carried out to determine whether it is possible to accelerate the label stock, and still have a sufficient number of steps to decelerate the label stock to rest, given the number of steps $N_g$ remaining in the current feed. This is determined by determining whether the number of steps $N_g$ remaining in the current feed is greater than or equal to one more than the number of steps required to decelerate the label stock to rest if the label stock is accelerated. If this is not the case, it is determined that the label stock should not be accelerated, and processing passes to step S46 where the step rate is set to remain constant, before processing passes to step S51.

In alternative embodiments which include an encoder which outputs a signal which can be used by the controller to determine an amount of movement of the label stock along the label web path (e.g. an encoder which monitors rotation of a print roller), at step S45 a check is carried out to determine whether it is possible to accelerate the label stock, and still have a sufficient distance to decelerate the label stock to rest, given the distance measured by the encoder $N_g$ remaining in the current feed. In order to achieve this the controller may convert the distance $N_g$ remaining in the current feed into an equivalent number of remaining steps of the motor (based upon the diameter of the take up spool) and determine whether the remaining number of steps is greater than or equal to one more than the number of steps required to decelerate the label stock to rest if the label stock is accelerated. If this is not the case, it is determined that the label stock should not be accelerated, and processing passes to step S46 where the step rate is set to remain constant, before processing passes to step S51.

If the check of step S45 is satisfied (i.e. acceleration can be carried out while still allowing sufficient steps for deceleration of the label stock to rest), processing passes from step S45 to step S47. Here a check is carried out to determine whether the current step rate is less than a target step rate. If this is the case, a step rate to effect acceleration is calculated at step S48, according to equation (41):

$$C_{r+1} = \sqrt{C_r^2 + \frac{2A_{max}N_{revolution}}{\pi d_t}} \tag{41}$$

where $A_{max}$ is the maximum possible acceleration.

It can be seen that equation (41) has a similar form to equation (31) and its derivation therefore has the general form set out above.

Processing passes from step S48 to step S49 where a check is carried out to determine whether the step rate $C_{r+1}$ calculated at step S48 exceeds the target step rate $M_r$. If this is the case, the step rate $C_{r+1}$ is set to be equal to the target step rate at step S50, before processing passes from step S50 to step S51. If the step rate $C_{r+1}$ calculated at step S48 does not exceed the target step rate $M_r$ processing passes directly from step S49 to step S51. At step S51 the motor is caused to turn one step at the determined step rate.

If the check of step S47 determines that the current step rate is not too slow, processing passes from step S47 to step S52. It is known (given operation of steps S41 and S47 that the step rate is equal to the target step rate, and the motor is turned through one step at that step rate at step S52.

Processing passes from each of steps S51 and S52 to step S53 where the number of steps remaining in the current feed $N_g$ is decremented by one, before processing returns to step S34.

In alternative embodiments which include an encoder which outputs a signal which can be used by the controller to determine an amount of movement of the label stock along the label web path (e.g. an encoder which monitors rotation of a print roller), if the label stock is not being decelerated (i.e. if the distance remaining in the current label feed $N_g$ based upon the output of the encoder is greater than the distance s required to decelerate the label stock) then step S53 is omitted such that processing passes back to step S34. In such embodiments an encoder increment/decrement routine shown schematically in a flow chart of FIG. 35 is processed concurrently with the routine shown schematically in the flow chart of FIG. 34.

Referring to FIG. 35, at step E1 the controller monitors the encoder. At step E2 the controller waits until an update from the encoder is available. If an update from the encoder is available (e.g. if the encoder has output a signal which is indicative of movement), processing passes to step E3.

In this particular embodiment the encoder can output a first type of pulse which is indicative of the label stock advancing forward along the label web path (i.e. towards the take up spool) by a distance $E_d$. The encoder can also output a second type of pulse which is indicative of the label stock retreating backward along the label web path (i.e. towards the supply spool) by a distance $E_d$.

At step E3 the controller processes the signal received from the encoder and determines whether the signal is indicative of the label stock advancing forward along the label web path (i.e. towards the take up spool) or whether the signal is indicative of the label stock retreating backward along the label web path (i.e. towards the supply spool). In this embodiment, if the encoder outputs the first type of pulse then the label stock has advanced forward and processing passes to step E4. If the encoder outputs the second type of pulse then the label stock has retreated backward and processing passes to step E5.

At step E4 the controller sets the value of the distance $N_g$ remaining in the current feed to be equal to the current value of the distance $N_g$ remaining in the current feed minus distance $E_d$.

At step E5 the controller sets the value of the distance $N_g$ remaining in the current feed to be equal to the current value of the distance $N_g$ remaining in the current feed plus distance $E_d$.

After either steps E4 and E5 processing returns to step E1.

Various features of the labelling machine have been described above. In some cases, exemplary components, configurations and methods suitable for realising these particular features have been described. However in many cases the skilled person will know of other components, configurations and methods which can similarly be used to realise the particular features which are described. Many of these components, configurations and methods will be known to the skilled person from the common general knowledge. It is envisaged that such alternative components, configurations and methods can be implemented in the described embodiments without difficulty given the disclosure presented herein.

While references have been made herein to a controller or controllers it will be appreciated that control functionality described herein can be provided by one or more controllers. Such controllers can take any suitable form. For example control may be provided by one or more appropriately programmed microprocessors (having associated storage for program code, such storage including volatile and/or non-volatile storage). Alternatively or additionally control may be provided by other control hardware such as, but not limited to, application specific integrated circuits (ASICs) and/or one or more appropriately configured field programmable gate arrays (FPGAs).

Where angles have been specified herein, such angles are measured in radians although modifications to use other angular measurements will be apparent to the skilled person.

While various embodiments of labelling machine(s) have been described herein, it will be appreciated that this description is in all respects illustrative, not restrictive. Various modifications will be apparent to the skilled person without departing from the spirit and scope of the invention.

The invention claimed is:

1. A labelling machine comprising:

a supply spool support for supporting a supply spool comprising a label stock comprising a web and a plurality of spaced labels attached to the web and which are separable from the web;

a take-up spool support adapted to take up a portion of the web;

a motive means configured to propel the web along a web path from the supply spool support to the take-up spool support;

a sensor comprising a transmitter portion and a receiver portion, the receiver portion comprising a plurality of receivers, the transmitter portion and the receiver portion being configured to receive a portion of the label stock therebetween, and the plurality of receivers each configured to produce a respective sensor signal which is a function of a property of a portion of the label stock at a plurality of positions spaced from one another in a direction non-parallel to the web path; and a controller configured to monitor each of the sensor signals produced by the plurality of receivers and to select one of the sensor signals produced by the plurality of receivers based on said monitoring of each of the sensor signals produced by the plurality of receivers.

2. A labelling machine according to claim 1, wherein the controller is configured to control the motive means based upon a change in the selected sensor signal in order to position a target portion of the label stock at a desired location along the web path.

3. A labelling machine according to claim 2, wherein the target portion of the label stock is a leading edge of a label and the desired location along the web path is an edge of a labelling peel beak.

4. A labelling machine according to claim 1, wherein the controller is configured to detect a feature of the label stock based upon a change in the selected sensor signal.

5. A labelling machine according to claim 4, wherein the transmitter portion comprises an electromagnetic radiation source and the receiver portion comprises an electromagnetic radiation detector.

6. A labelling machine according to claim 5, wherein the transmitter portion is configured to produce a beam of electromagnetic radiation which has a power density or intensity which is substantially the same at said plurality of positions.

7. A labelling machine according to claim 5, wherein the electromagnetic radiation source comprises a plurality of light emitting diodes arranged in a substantially linear formation.

8. A labelling machine according to claim 1, wherein the transmitter portion comprises a plurality of transmitters.

9. A labelling machine according to claim 8, wherein each of the plurality of transmitters and the plurality of receivers form part of a sensor pair, each sensor pair comprising a transmitter and a receiver.

10. A labelling machine according to claim 1, wherein the portion of the label stock comprises the web and attached labels of the plurality of attached labels.

11. A labelling machine according to claim 10, wherein the controller is configured to control the motive means and/or detect a feature of the label stock based upon a first order or a second order differential of the selected sensor signal.

12. A labelling machine according to claim 10, wherein the controller is configured to control the motive means and/or detect a feature of the label stock based on whether at least one of the selected sensor signal, a first order derivative of the selected sensor signal and a second order derivative of the selected sensor signal, have a predetermined relationship with a threshold value.

13. A labelling machine according to claim 10, wherein the controller is configured to control the motive means and/or detect a feature of the label stock based on whether at least one of the selected sensor signal, a first order derivative of the selected sensor signal and a second order derivative of the selected sensor signal exhibit a predetermined signature, wherein the predetermined signature is a predetermined temporal pattern in the values of said at least one of the selected sensor signal, the first order derivative of the selected sensor signal and the second order derivative of the selected sensor signal.

14. A labelling machine according to claim 1, wherein the controller is further configured to select one of the sensor signals produced by the receivers based on a predetermined criteria and wherein the predetermined criteria is selected from the group consisting of:

a sensor signal which exceeds a predetermined threshold for a greatest proportion of a monitoring time, a sensor signal which is less than a predetermined threshold for a greatest proportion of a monitoring time, a sensor signal which is the first sensor signal to exceed a predetermined threshold during a monitoring time, a sensor signal which is the last sensor signal to exceed a predetermined threshold during a monitoring time, a sensor signal which is the first sensor signal to be less than a predetermined threshold during a monitoring time, and a sensor signal which is the last sensor signal to be less than a predetermined threshold during a monitoring time.

15. A method of operating a labelling machine, the labelling machine comprising:

a supply spool support for supporting a supply spool comprising a label stock comprising a web and a plurality of spaced labels attached to the web and which are separable from the web;

a take-up spool support adapted to take up a portion of the web;

a motive means, a controller, and a sensor comprising a transmitter portion and a receiver portion, wherein the receiver portion of the sensor further comprises a plurality of receivers;

the method comprising:

the motive means propelling the web along a web path from the supply spool support towards the take up spool support;

the transmitter portion and the receiver portion receiving a portion of the label stock therebetween;

the plurality of receivers each producing a respective sensor signal which is a function of a property of a portion of the label stock at a plurality of positions spaced from one another in a direction non-parallel to the web path;

the controller monitoring each of the sensor signals produced by the plurality of receivers; and the controller selecting one of the sensor signals produced by the plurality of receivers based on said monitoring of each of the sensor signals produced by the plurality of receivers.

16. A labelling machine according to claim 1, wherein the motive means comprises a motor configured to rotate the take-up spool support.

* * * * *